US005250397A

United States Patent [19]

Kamada et al.

[11] Patent Number: 5,250,397

[45] Date of Patent: Oct. 5, 1993

[54] PROCESS FOR PROCESSING A SILVER HALIDE COLOR PHOTOGRAPHIC MATERIAL

[75] Inventors: Katsushige Kamada; Keiji Mihayashi; Yoshihiro Fujita, all of Kanagawa, Japan

[73] Assignee: Fuji Photo Film Co., Ltd., Kanagawa, Japan

[21] Appl. No.: 679,418

[22] Filed: Apr. 2, 1991

[30] Foreign Application Priority Data

Apr. 2, 1990 [JP] Japan ..... 2-88076
Apr. 17, 1990 [JP] Japan ..... 2-101157

[51] Int. Cl.[5] ..... G03C 7/30; G03C 7/34; G03C 7/40

[52] U.S. Cl. ..... 430/359; 430/226; 430/393; 430/399; 430/553

[58] Field of Search ..... 430/359, 226, 399, 393, 430/553, 549, 385

[56] References Cited

U.S. PATENT DOCUMENTS 3,996,055 12/1976 Minagawa et al. ..... 430/359
4,294,900 10/1981 Aono ..... 430/359
4,483,914 11/1984 Naito et al. ..... 430/226
4,647,527 3/1987 Ikenoue et al. ..... 430/359
5,064,750 11/1991 Naito ..... 430/553
5,068,170 11/1991 Abe ..... 430/399
5,075,207 12/1991 Langen et al. ..... 430/553
5,077,180 12/1991 Yoshida et al. ..... 430/399
5,112,730 5/1992 Ohkawa et al. ..... 430/359

FOREIGN PATENT DOCUMENTS 0353738 2/1990 European Pat. Off. .
0412532 2/1991 European Pat. Off. .
3815469 11/1989 Fed. Rep. of Germany .

OTHER PUBLICATIONS

Patent Abstracts of Japan, vol. 12, No. 58 (P-669)(2905), Feb. 20, 1988 and JP-A-62203161 (Fuji) Sep. 7, 1987.

Patent Abstracts of Japan, vol. 8, No. 151 (P-286)(1588), Jun. 13, 1984; and JP-A-5948764 (FUJI) Mar. 21, 1984.

*Primary Examiner*—Richard L. Schilling
*Attorney, Agent, or Firm*—Sughrue, Mion, Zinn, Macpeak & Seas

[57] ABSTRACT

A method for processing a silver halide color photographic material is disclosed, which comprises: color developing a silver halide color photographic material with a color developer containing an aromatic primary amine color developing agent, followed by processing with a processing solution having a bleaching ability, wherein the replenishment rate of said color developer is in the range of 600 ml or less per $m^2$ of the photographic material, and wherein said silver halide color photographic material contains at least one yellow colored cyan coupler.

21 Claims, No Drawings

PROCESS FOR PROCESSING A SILVER HALIDE COLOR PHOTOGRAPHIC MATERIAL

FIELD OF THE INVENTION

The present invention relates to a process for processing of a silver halide color photographic material. More particularly, the present invention relates to an improved process for the preparation of a silver halide color photographic material which provides an excellent desilvering property even if the replenishment rate of the color developer is reduced.

BACKGROUND OF THE INVENTION

The processing of a silver halide color photographic material (hereinafter referred to as "light-sensitive material") essentially consists of two steps; color development and desilvering. In other words, a light-sensitive material which has been exposed to light is transferred to a color development step where silver halide contained therein is reduced with a color developing agent to form silver and the resulting oxidation product of the color developing agent reacts with a coupler to give a dye image. The light-sensitive material is then transferred to a desilvering step where silver produced at the color development step is oxidized with an oxidizer (commonly known as a "bleaching agent"), dissolved, and removed by a silver ion complexing agent (commonly known as "a fixing agent"). A light-sensitive material subjected to these steps eventually forms a dye image. In addition to color development and desilvering, the development step also comprises auxiliary steps (e.g., a hardening bath, a stop bath, a rinse bath, and a stabilizing bath) to maintain the photographic and physical properties of the developed images or to improve image preservability.

The desilvering step may be effected in two ways. One way is effected in a beaching bath and a fixing bath which are separately provided; and the other is effected in only one step in a blix bath wherein a bleaching agent and a fixing agent are both present to simplify processing in order to expedite processing and save labor.

In recent years, to avoid water contamination and reduce processing costs, techniques for eliminating the amount of waste water in the processing steps have been studied and used in some processing steps. In particular, various approaches have been proposed to avoid the large amount of waste water discharged from the color development step. Examples of such approaches include methods utilizing electrodialysis as disclosed in JP-A-54-37731, JP-A-56-1048, JP-A-56-1049, JP-A-56-27142, JP-A-56-33644, JP-A-56-149036 (the term "JP-A" as used herein means an "unexamined published Japanese patent application"), and JP-B-61-10199 (the term "JP-B" as used herein means an "examined Japanese patent publication"); various color developer regeneration methods utilizing activated carbon as disclosed in JP-B-55-1571 and JP-A-58-14831; ion exchange membranes as disclosed in JP-A-52-105820; and ion exchange resins as disclosed in JP-A-55-144240, JP-A-57-146249, and JP-A-61-95352.

However, all these methods require controlling the formulation of the developer by analysis, and thus, require a high level of control and expensive apparatus. As a result, these methods are practiced in some large scale laboratories.

On the other hand, a low replenishment processing method has been practiced wherein the formulation of the color developer replenisher (hereinafter referred to as the "color development replenisher") is controlled to reduce the replenishment rate without using such a regeneration method. The control of the formulation of the replenisher in this low replenishment processing method simply comprises concentrating consumable components such as color developing agent and preservative so that these components can be supplied in the required amounts even if the replenishment rate is reduced. When a silver halide color photographic material is processed, halogen ions are released into the color developer. In this low replenishment processing, the color developer shows a rise in bromine ion concentration, inhibiting development. Therefore, in order to eliminate this difficulty, an approach is normally practiced wherein the bromide concentration in the replenisher is lower than the ordinary replenishment processing method.

In addition to inhibition of water contamination and reduction of the processing cost, such a low replenishment processing method can be advantageously practiced without continual analysis of the formulation of the processing solution.

On the other hand, it has been keenly desired to reduce the time required for the above mentioned processing steps to enable a rapid response to orders from customers. In particular, the reduction of the desilvering time, which has previously accounted for the largest part of the processing, was most desired. Particularly, it has been desired to expedite bleaching.

The rate of replenishment of the color developer which has been heretofore practiced depends on the type of the light-sensitive material. For color negative films for photographing, this value is normally in the range of 900 to 1,200 ml per $m^2$ of light-sensitive material. In some cases, the processing is effected at a replenishment rate of 600 ml per $m^2$ of light-sensitive material to meet the demand for low replenishment rate.

However, it has been found that when such a low replenishment method is employed to effect a rapid desilvering process, the problem of delay in desilvering becomes important. Therefore, it has been desired to develop an approach which can both meet the demand for rapid desilvering and exhibit the advantages of simple replenishment processing.

SUMMARY OF THE INVENTION

Accordingly, the first object of the present invention is to provide a processing method which gives rapid bleaching even if the color developer replenishment rate is reduced.

The second object of the present invention is to provide a method for processing a light-sensitive material which gives excellent reproduction of colors, particularly reddish colors, over all exposing light ranges.

These and other objects are obtained by a method for the processing of a silver halide color photographic material which comprises color developing a silver halide color photographic material with a color developer containing an aromatic primary amine color developing agent, followed by processing with a solution having a bleaching ability, wherein the replenishment rate of said color developer is in the range of 600 ml or less per $m^2$ of the photographic material, and wherein said silver halide color photographic material contains at least one yellow colored cyan coupler.

DETAILED DESCRIPTION OF THE INVENTION

In general, it is necessary to use a highly active and concentrated solution as a replenisher to reduce the replenishment rate and keep the necessary components in a predetermined concentration. Further, although reaction products are formed according to the amount of light-sensitive material to be processed (hereinafter referred to as "amount processed"), the replenishment rate (and thus the amount of overflow solution) is reduced. Therefore, it is thought that the concentration of reaction products accumulated in the processing solutions and elutes from the light-sensitive material increases. Accordingly, if the replenishment rate of the color developer is reduced, it means that the concentration of oxidation products of the color developing agent and mercapto compounds or other additives eluted from the light-sensitive material, such as fog inhibitors, groups releasable from couplers, and dyes such as sensitizing dyes, in the color developer, increases. The present invention is based on the presumption that the delay in bleaching accompanying the reduction in the replenishment rate is attributed to the rise in the quantities of these components in the light-sensitive material.

In other words, the present invention is based on the fact that if the color developer replenishment rate is as low as 600 ml/m$^2$ or less, the incorporation of a yellow colored cyan coupler of the present invention in a silver halide color photographic material not only enables elimination of delay in bleaching during processing with a solution having a bleaching ability but also provides a surprising effect of accelerating bleaching.

In the present method for processing a silver halide color photographic material (hereinafter also referred to as a "light-sensitive material"), a light-sensitive material which has been imagewise exposed to light is color-developed, and then processed with a processing solution having a bleaching ability.

In the present invention, the replenishment rate of the color developer is at the rate of 600 ml/m$^2$ or less. For better effects, the replenishment rate of the color developer is preferably in the range of 100 to 500 ml/m$^2$, more preferably 100 to 400 ml/m$^2$, and most preferably 100 to 300 ml/m$^2$ or less.

The yellow colored cyan coupler of the present invention is described in detail below.

In the present invention, the yellow colored cyan coupler is a cyan coupler which exhibits a maximum absorption between 400 nm and 500 nm in the visible absorption range and which undergoes coupling with an oxidation product of an aromatic primary amine development agent to form a cyan dye having a maximum absorption between 630 nm and 750 nm in the visible absorption range.

Among yellow colored cyan couplers of the present invention, it is preferable to use yellow colored cyan couplers which undergo a coupling reaction with an oxidation product of an aromatic primary amine developing agent to release a compound residue containing a water-soluble 6-hydroxy-2-pyridon-5-ylazo group, a water-soluble pyrazolon-4-ylazo group, a water-soluble 2-acylaminophenylazo group, or a water-soluble sulfonamidephenylazo group.

The yellow colored cyan couplers of the present invention are represented by the following general formulae (CI) to (CIV):

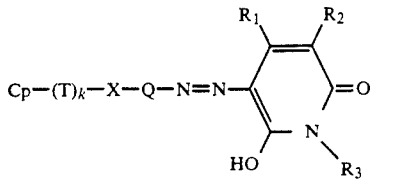
(CI)

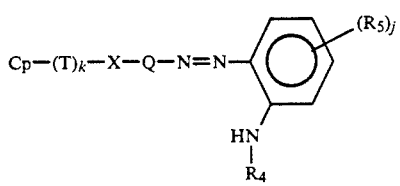
(CII)

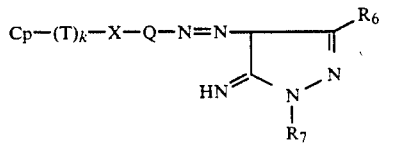
(CIII)

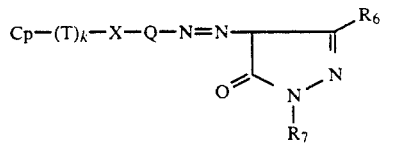
(CIV)

In general formulae (CI) to (CIV), Cp represents a cyan coupler residue (T is connected to the coupling position); T represents a timing group; k represents an integer of 0 or 1; X represents a divalent group containing N, O, or S and connecting $(T)_k$ to Q; and Q represents an arylene group or a divalent heterocyclic group.

In general formula (CI), $R_1$ and $R_2$ each independently represent a hydrogen atom, a carboxyl group, a sulfo group, a cyano group, an alkyl group, a cycloalkyl group, an aryl group, a heterocyclic group, a carbamoyl group, a sulfamoyl group, a carbonamide group, a sulfonamide group, or an alkylsulfonyl group; and $R_3$ represents a hydrogen atom, an alkyl group, a cycloalkyl group, an aryl group, or a heterocyclic group, with the proviso that at least one of T, X, Q, $R_1$, $R_2$ and $R_3$ contains a water-soluble group (e.g., a hydroxyl group, a carboxyl group, a sulfo group, an amino group, an ammoniumyl group, a phosphono group, a phosphino group, and a hydroxysulfonyloxy group).

The moiety

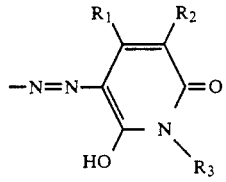

in general formula (CI) can exhibit the following tautomeric structures. These tautomeric structures are included in the structures specified in the general formula (CI) of the present invention.

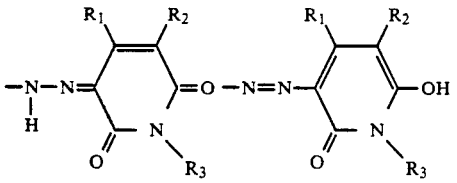

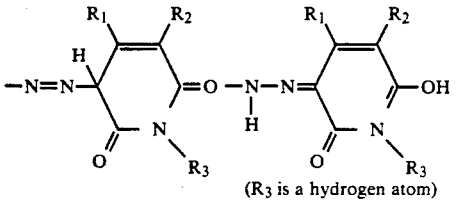

($R_3$ is a hydrogen atom)

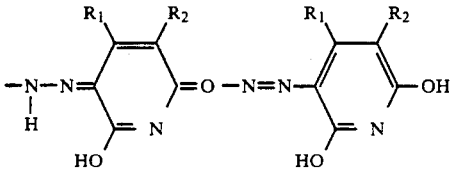

($R_3$ is a hydrogen atom) ($R_3$ is a hydrogen atom)

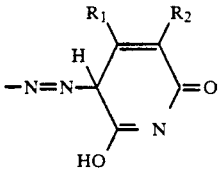

($R_3$ is a hydrogen atom)

In general formula (CII), $R_4$ represents an acyl group or a sulfonyl group; $R_5$ represents a substitutable group; and j represents an integer of 0 to 4 (when j is an integer of 2 to 4, the plurality of $R_4$s may be the same or different); with the proviso that at least one of T, X, Q, $R_4$, and $R_5$ contains a water-soluble group (e.g., a hydroxyl group, a carboxyl group, a sulfo group, a phosphono group, a phosphino group, a hydroxylsulfonyloxy group, an amino group, and an ammoniumyl group).

In general formulae (CIII) and (CIV), $R_6$ represents a hydrogen atom, a carboxyl group, a sulfo group, a cyano group, an alkyl group, a cycloalkyl group, an aryl group, an alkoxy group, a cycloalkyloxy group, an aryloxy group, a heterocyclic group, a carbamoyl group, a sulfamoyl group, a carbonamide group, a sulfonamide group, or an alkylsulfonyl group; and $R_7$ represents a hydrogen atom, an alkyl group, a cycloalkyl group, an aryl group, or a heterocyclic group; with the proviso that at least one of T, X, Q, $R_6$, and $R_7$ contains a water-soluble group (e.g., a hydroxyl group, a carboxyl group, a sulfo group, a phosphono group, a phosphino group, a hydroxylsulfonyloxy group, an amino group, an ammoniumyl group);

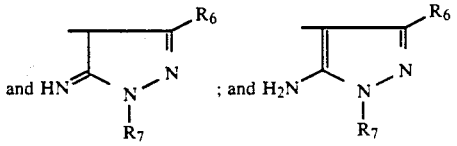

are in tautomerism with each other.

The compounds represented by general formulae (CI) to (CIV) are described further below.

Examples of coupler residue represented by Cp include known cyan coupler residues (e.g., a phenolic cyan coupler residue and a naphtholic cyan coupler residue).

Preferred examples of Cp include coupler residues represented by the following general formulae (Cp-6), (Cp-7), and (Cp-8):

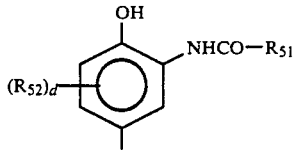

(Cp-6)

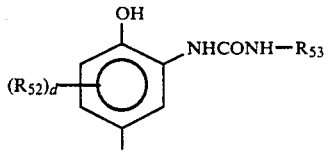

(Cp-7)

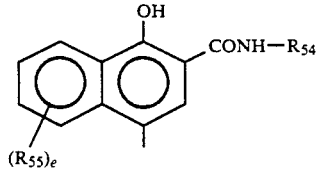

(Cp-8)

In Cp-6, Cp-7, and Cp-8, the free bonding hand derived from the coupling position indicates the position at which the coupling-separatable group is connected to the coupler residue.

In addition, in Cp-6, Cp-7, and Cp-8, if $R_{51}$, $R_{52}$, $R_{53}$, $R_{54}$, or $R_{55}$ contains a nondiffusive group, it is selected such that the total number of carbon atoms contained therein is from 8 to 40, preferably from 10 to 30. Otherwise, the total number of carbon atoms contained in $R_{51}$, $R_{52}$, $R_{53}$, $R_{54}$, or $R_{55}$ is preferably 15 or less. In the case of a bis type, telomer type, or polymer type coupler, any of these substituents can represent a divalent group which connects repeating units or the like; in which case, the total number of carbon atoms contained in these substituents may deviate from the range specified above.

In the following description, $R_{41}$ represents an aliphatic group, an aromatic group, or a heterocyclic group; $R_{42}$ represents an aromatic group or a heterocyclic group; and $R_{43}$, $R_{44}$, and $R_{45}$ each represent a hydrogen atom, an aliphatic group, an aromatic group, or a heterocyclic group.

For $R_{51}$, $R_{52}$, $R_{53}$, $R_{54}$, and $R_{55}$, d and e are described further, below.

$R_{51}$ has the same meaning as $R_{42}$. $R_{52}$ has the same meaning as $R_{41}$ or represents a $R_{41}CON(R_{43})$— group, a $R_{41}OCON(R_{43})$— group, a $R_{41}SO_2N(R_{43})$— group, a $R_{43}N(R_{44})CON(R_{43})$— group, a $R_{41}O$— group, a $R_{41}S$— group, a halogen atom, or a $R_{41}N(R_{43})$— group.

The suffix d represents an integer of 0 to 3. When d is plural, the plurality of $R_{52}$'s may be the same or different; or may be divalent groups which together form a cyclic structure. Typical examples of divalent groups which can form a cyclic structure include:

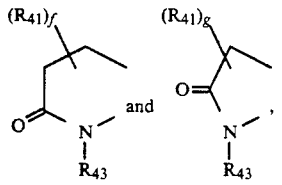

wherein f represents an integer of 0 to 4; and g represents an integer of 0 to 2. $R_{53}$ has the same meaning as $R_{41}$. $R_{54}$ has the same meaning as $R_{41}$. $R_{55}$ has the same meaning as $R_{41}$ or represents a $R_{41}OCONH$— group, a $R_{41}SO_2NH$— group, a $R_{43}N(R_{44})CON(R_{45})$— group, a $R_{43}N(R_{44})S_2N(R_{45})$— group, a $R_{43}O$— group, a $R_{41}S$— group, a halogen atom, or a $R_{41}N(R_{43})$— group. If there are a plurality of $R_{55}$'s, they may be the same or different. The suffix e represents an integer of 0 to 3.

In the foregoing description, the aliphatic group is a $C_{1-32}$, preferably $C_{1-22}$, saturated or unsaturated, chain or cyclic, straight-chain or branched, substituted or unsubstituted aliphatic hydrocarbon group. Typical examples of such an aliphatic hydrocarbon group include a methyl group, an ethyl group, a propyl group, an isopropyl group, a butyl group, a (t)-butyl group, an (i)-butyl group, a (t)-amino group, a hexyl group, a cyclohexyl group, a 2-ethylhexyl group, a octyl group, a 1,1,3,3-tetramethylbutyl group, a decyl group, a dodecyl group, a hexadecyl group, and a octadecyl group.

The aromatic group is a $C_{6-20}$, preferably substituted or unsubstituted phenyl group or substituted or unsubstituted naphthyl group.

The heterocyclic group is a $C_{1-20}$, preferably $C_{1-7}$ 3- to 8-membered substituted or unsubstituted heterocyclic group containing hetero atoms such as nitrogen, oxygen, and sulfur atoms. Typical examples of such a heterocyclic group include a 2-pyridyl group, a 2-thienyl group, a 2-furyl group, a 1,3,4-thiadiazol-2-yl group, a 2,4-dioxo-1,3-imidazolidin-5-yl group, a 1,2,4-triazol-2-yl group, and a 1-pyrazolyl group.

If the above mentioned aliphatic hydrocarbon group, aromatic group and heterocyclic group contain substituents, typical examples of such substituents include a halogen atom, a $R_{47}O$— group, a $R_{46}S$— group, a $R_{47}CON(R_{48})$— group, a $R_{47}N(R_{48})CO$— group, a $R_{46}OCON(R_{47})$— group, a $R_{46}SO_2N(R_{47})$— group, a $R_{47}N(R_{48})SO_2$— group, a $R_{46}O_2$— group, a $R_{47}OCO$— group, a $R_{47}N(R_{48})CON(R_{49})$— group, groups having the same meaning as $R_{46}$, a

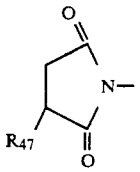

group, a $R_{46}COO$— group, a $R_{47}OSO_2$— group, a cyano group, and a nitro group. $R_{46}$ represents an aliphatic group, an aromatic group, or a heterocyclic group; and $R_{47}$, $R_{48}$, and $R_{49}$ each represent an aliphatic group, an aromatic group, a heterocyclic group, or a hydrogen atom. The aliphatic group, aromatic group, or heterocyclic group is as defined above.

In general formula (Cp-6), $R_{51}$ is preferably an aliphatic group or aromatic group. $R_{52}$ is preferably a chlorine atom, an aliphatic group, or a $R_{41}CONH$— group. The suffix d is preferably 1 or 2. $R_{53}$ is preferably an aromatic group.

In general formula (Cp-7), $R_{52}$ is preferably $R_{41}CONH$— group. The suffix d is preferably 1. $R_{53}$ is preferably an aliphatic or aromatic group.

In general formula (Cp-8), e is preferably 0 or 1. $R_{55}$ is preferably a $R_{41}OCONH$— group, a $R_1CONH$— group, or a $R_{41}SO_2NH$— group. $R_{55}$ is preferably connected to the 5-position of the naphthol ring.

The timing group represented by T is a group which undergoes cleavage of a bond to Cp followed by cleavage of a bond to X upon the coupling reaction of a coupler and an oxidation product of an aromatic primary amine developing agent. The timing group can be used, for example, for the purpose of controling the coupling reactivity and the release timing of X and lower units, stabilizing couplers, and like purposes. Examples of such a timing group include known groups as set forth below. In the following general formulae, the marks * and ** indicate the position at which the timing group is connected to Cp and X or Q, respectively.

(T-1)

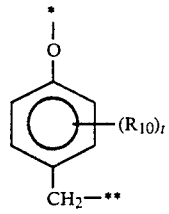

(T-2)

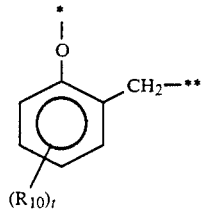

(T-3)

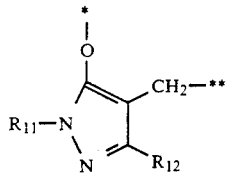

(T-4)

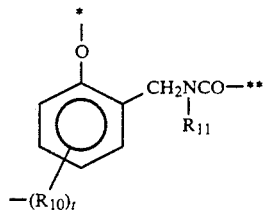

(T-5)

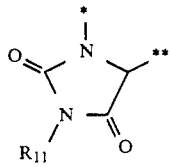

*—$OCH_2$—* (T-6)

-continued $$*-\overset{\overset{\displaystyle O}{\|}}{C}-O-** \quad \text{(T-7)}$$

In general formulae T-1 to T-7, $R_{10}$ represents a group which can substitute for a hydrogen atom in a benzene ring; $R_{11}$ has the same meaning as $R_{41}$; and $R_{12}$ represents a hydrogen atom or a substituent group. The suffix t represents an integer of 0 to 4. Examples of substituent groups represented by $R_{10}$ and $R_{12}$ include a $R_{41}$ group, a halogen atom, a $R_{43}O$— group, a $R_{43}S$— group, a $R_{43}(R_{44})NCO$— group, a $R_{43}OOC$— group, a $R_{43}SO_2$— group, a $R_{43}(R_{44})NSO_2$— group, a $R_{43}CON(R_{43})$— group, a $R_{41}SO_2N(R_{43})$— group, a $R_{43}CO$— group, a $R_{41}COO$— group, a $R_{41}SO$— group, a nitro group, a $R_{43}(R_{44})NCON(R_{45})$— group, a cyano group, a $R_{41}OCON(R_{43})$— group, a $R_{43}OSO_2$— group, a $R_{43}(R_{44})N$— group, a $R_{43}(R_{44})NSO_2N(R_{45})$— group, and a

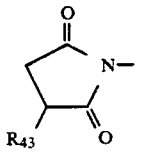

group.

The suffix k in CI to CIV is an integer of 0 or 1. In general, k is preferably 0. Namely, Cp and X are preferably directly connected to each other.

X represents a divalent linking group which is connected to $(T)_k$ or upper units via N, O, or S. Preferred examples of such a divalent linking group include an —O— group, an —S— group, an $-\overset{\overset{\displaystyle O}{\|}}{C}-$ group, a $-O\overset{\overset{\displaystyle O}{\|}}{C}O-$ group, a $-O\overset{\overset{\displaystyle O}{\|}}{C}S-$ group, a $-O\overset{\overset{\displaystyle O}{\|}}{C}NH-$ group, a $-OSO_2NH-$ group, a heterocyclic group which can be connected to $(T)_k$ or upper units via N (e.g., groups derived from pyrrolidine, piperidine, morpholine, piperadine, pyrrole, pyrazole, imidazole, 1,2,4-triazole, benzotriazole, succinimide, phthalimide, oxazolidine-2,4-dione, imidazolidine-2,4-dione, and1,2,4-triazolidine-3,5-dione),and composites thereof with an alkylene group (e.g., methylene, ethylene, and propylene), a cycloalkylene group (e.g., 1,4-cyclohexylene), an arylene group (e.g., o-phenylene, and p-phenylene), a divalent heterocyclic group (e.g., groups derived from pyridine and thiophene), a —CO— group, a $-SO_2-$ group, a —COO— group, a —CONH— group, a $-SO_2NH-$ group, a $-SO_2O-$ group, a —NHCO— group, a $-NHSO_2-$ group, a —NHCONH— group, a $-NHSO_2NH-$ group, a —NHCOO— group, etc.

X is more preferably represented by general formula (II):

$$*-X_1-(L-X_2)-_m** \quad \text{(II)}$$

In general formula (II), the mark * indicates the position at which X is connected to $(T)_k$ or upper units; the mark ** indicates the position at which X is connected to Q or lower units; $X_1$ represents an —O— group or an —S— group, L represents an alkylene group; $X_2$ represents a single bond, an —O— group, an —S— group, a —CO— group, a $-SO_2-$ group, a $-\overset{\overset{\displaystyle O}{\|}}{C}-$ group, a $-\overset{\overset{\displaystyle O}{\|}}{C}O-$ group, a $-\overset{\overset{\displaystyle O}{\|}}{C}NH-$ group, a $-\overset{\overset{\displaystyle O}{\|}}{C}NH-$ group, a $-SO_2NH-$ group, a $-NHSO_2-$ group, a $-SO_2O-$ group, a $-OSO_2-$ group, a $-\overset{\overset{\displaystyle O}{\|}}{C}O-$ group, a $-\overset{\overset{\displaystyle O}{\|}}{C}NH-$ group, a $-\overset{\overset{\displaystyle O}{\|}}{C}NHCO-$ group, a $-\overset{\overset{\displaystyle O}{\|}}{C}NHCNH-$ group, a $-NHSO_2NH-$ group, a $-\overset{\overset{\displaystyle O}{\|}}{C}S-$ group, a $-\overset{\overset{\displaystyle O}{\|}}{C}SCO-$ group, a $-OSO_2NH-$ group, or a $-NHSO_2O$ group; and m represents an integer of 0 to 3. The total number of carbon atoms contained in X is preferably from 0 to 12, more preferably 0 to 8. X is most preferably a $-OCH_2CH_2O-$ group.

Q in CI to CIV represents an arylene group or divalent heterocyclic group. The arylene group represented by Q may be a condensed ring or it may contain substituents (e.g., a halogen atom, a hydroxyl group, a carboxyl group, a sulfo group, a nitro group, a cyano group, an amino group, an ammonium group, a phosphono group, a phosphino group, an alkyl group, a cycloalkyl group, an aryl group, a carbonamide group, a sulfonamide group, an alkoxy group, an aryloxy group, an acyl group, a sulfonyl group, a carboxyl group, a carbamoyl group, and a sulfamoyl group). The number of carbon atoms contained in the arylene group is preferably from 6 to 15, more preferably from 6 to 10. The heterocyclic group represented by Q is a 3- to 8-membered, preferably 5- to 7-membered single or condensed heterocyclic group containing at least one hetero atom selected from the group consisting of N, O, S, P, Se, and Te (e.g., a pyridine group, a thiophene group, a furan group, a pyrrole group, a pyrazole group, an imidazole group, a thiazole group, an oxazole group, a benzothiazole group, a benzoxazole group, a benzofuran group, a benzothiophene group, a 1,3,4-thiadiazole group, an indole group, and a quinoline group). The heterocyclic group may contain substituents as defined with respect to the arylene group represented by Q. The number of carbon atoms contained in the heterocyclic group is preferably from 2 to 15, more preferably 2 to 10. Q is most preferably

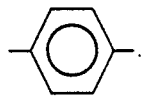

Therefore, $-(T)_k-X-Q-$ is most preferably

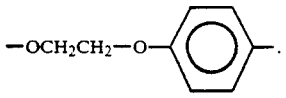

The alkyl group represented by $R_1$, $R_2$, or $R_3$ may be either straight-chain or branched. The alkyl group may also contain unsaturated bonds or substituents (e.g., a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamide group, a sulfonamide group, a carbamoyl group, a sulfamoyl group, and a sulfonyl group).

The cycloalkyl group represented by $R_1$, $R_2$, or $R_3$ is a 3- to 8-membered cycloalkyl group which may contain crosslinking groups, unsaturated bonds, or substituents as defined with respect to the alkyl group represented by $R_1$, $R_2$, or $R_3$.

The aryl group represented by $R_1$, $R_2$, or $R_3$ may be a condensed ring or may contain substituents (e.g., those defined with respect to the alkyl group represented by $R_1$, $R_2$, or $R_3$, an alkyl group, or a cycloalkyl group).

The heterocyclic group represented by $R_1$, $R_2$, or $R_3$ is a 3- to 8-membered, preferably a 5- to 7-membered single or condensed heterocyclic group containing at least one hetero atom selected from the group consisting of N, S, O, P, Se, and Te (e.g., an imidazolyl group, a thienyl group, a pyrazolyl group, a thiazolyl group, a pyridyl group, and a quinolinyl group). The heterocyclic group may contain substituents as defined with respect to the aryl group represented by $R_1$, $R_2$, or $R_3$.

The above mentioned carboxyl group, sulfo group, phosphino group and phosphono group may contain a carboxylate group, a sulfonate group, a phosphinate group, and a phosphonate group, respectively. Examples of counter ions contained in these groups include $Li^+$, $Na^+$, $K^+$, and ammonium.

$R_1$ in CI is preferably a hydrogen atom, a carboxyl group, a $C_{1-10}$ alkyl group (e.g., a methyl group, a t-butyl group, a carbomethyl group, a sulfomethyl group, a carboxymethyl group, a carboxymethyl group, a hydroxymethyl group, a benzyl group, an ethyl group, and an isopropyl group); or a $C_{6-12}$ aryl group (e.g., a phenyl group, a 4-methoxyphenyl group, a 4-sulfophenyl group). Particularly preferred among these groups are a hydrogen atom, a methyl group, and a carboxyl group.

$R_2$ in CI is preferably a cyano group, a carboxyl group, a $C_{1-10}$ carbamoyl group, a $C_{0-10}$ sulfamoyl group, a sulfo group, a $C_{1-10}$ alkyl group (e.g., a methyl group and a sulfomethyl group), a $C_{1-10}$ sulfonyl group (e.g., a methylsulfonyl group and a phenylsulfonyl group), a $C_{1-10}$ carbonamide group (e.g., an acetamide group and a benzamide group), or a $C_{1-10}$ sulfonamide group (e.g., a methanesulfonamide group and a toluenesulfonamide group). Particularly preferred among these groups are a cyano group, a carbamoyl group, and a carboxyl group.

$R_3$ in CI is preferably a hydrogen atom, a $C_{1-12}$ alkyl group (e.g., a methyl group, a sulfomethyl group, a carboxymethyl group, a sulfomethyl group, a carboxymethyl group, an ethyl group, a n-butyl group, a benzyl group, 4-sulfobenzyl group) or a $C_{6-15}$ aryl group (e.g., a phenyl group, a 4-carboxyphenyl group, a 3-carboxyphenyl group, a 4-methoxyphenyl group, a 2,4-dicarboxyphenyl group, a 2-sulfophenyl group, a 3-sulfophenyl group, a 4-sulfophenyl group, a 2,4-disulfophenyl group, a 2,5-disulfophenyl group), more preferably a $C_{1-7}$ alkyl group or a $C_{6-10}$ aryl group.

$R_4$ in CII is specifically an acyl group represented by general formula (III) or sulfonyl group represented by general formula (IV).

$$R_{14}\underset{\underset{O}{\|}}{C}- \quad \text{(III)}$$

$$R_{14}SO_2- \quad \text{(IV)}$$

$R_{14}$ represents an alkyl group, a cycloalkyl group, an aryl group or a heterocyclic group.

The alkyl group represented by $R_{14}$, for example, may be either straight-chain or branched, or may contain unsaturated bonds or substituents (e.g., a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamide group, a sulfonamide group, a carbamoyl group, a sulfamoyl group, and a sulfonyl group).

The cycloalkyl group represented by $R_{14}$ is a 3- to 8-membered cycloalkyl group which may contain crosslinking groups, unsaturated bonds, or substituents as defined with respect to the alkyl group represented by $R_{14}$).

The aryl group represented by $R_{14}$ may be condensed or may contain substituents (e.g., those defined with respect to the alkyl group represented by $R_{14}$, an alkyl group, and a cycloalkyl group).

The heterocyclic group represented by $R_{14}$ is a 3- to 8-membered, preferably 5- to 7-membered, single or condensed heterocyclic group containing at least one hetero atom selected from the group consisting of N, S, O, P, Se, and Te (e.g., an imidazolyl group, a thienyl group, a pyrazolyl group, a thiazolyl group, a pyridyl group, and a quinolinyl group). The heterocyclic group may contain substituents as defined with respect to the aryl group represented by $R_{14}$.

The above mentioned carboxyl group, sulfo group, phosphino group, and phosphono group may contain a carboxylate group, a sulfonate group, a phosphinate group, and a phosphonate group, respectively. Examples of counter ions contained in these groups include $Li^+$, $Na^+$, $K^+$, and ammonium.

$R_{14}$ is preferably a $C_{1-10}$ alkyl group (e.g., a methyl group, a carboxymethyl group, a sulfoethyl group, and a cyanoethyl group), a $C_{5-8}$ cycloalkyl group (e.g., a cyclohexyl group and a 2-carboxycyclohexy-1 group) or a $C_{6-10}$ aryl group (e.g., a phenyl group, a 1-naphthyl group, and a 4-sulfophenyl group). Particularly preferred among these groups are a $C_{1-3}$ alkyl group and a $C_6$ aryl group.

$R_5$ in CII is a substitutable group and may be the group represented by $R_7$. Preferably $R_5$ is an electron-donating group, particularly a $-NR_{15}R_{16}$ group or a $-OR_{17}$ group. The position at which $R_5$ substitutes for a hydrogen atom in the ring is preferably at the 4-position. $R_{15}$, $R_{16}$ and $R_{17}$ each represent a hydrogen atom, an alkyl group, a cycloalkyl group, an aryl group, or a heterocyclic group. $R_{15}$ and $R_{16}$ may together form a nitrogen-containing heterocyclic group which is preferably an aliphatic group.

The suffix j represents an integer of 0 to 4, preferably 1 or 2, and most preferably 1.

The alkyl group represented by $R_6$ or $R_7$ in CIV may be either straight-chain or branched and may contain unsaturated bonds or substituents (e.g., a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamide group, a sulfonamide group, a carbamoyl group, a sulfamoyl group, and a sulfonyl group).

The cycloalkyl group represented by $R_6$ or $R_7$ is a 3- to 8-membered cycloalkyl group which may contain crosslinking groups, unsaturated bonds, or substituents as defined with respect to the alkyl group represented by $R_6$ or $R_7$).

The aryl group represented by $R_6$ or $R_7$ may be condensed or may contain substituents (e.g., those defined with respect to the alkyl group represented by $R_6$ or $R_7$, an alkyl group, and a cycloalkyl group).

The heterocyclic group represented by $R_6$ or $R_7$ is a 3-to 8-membered, preferably 5- to 7-membered single or condensed heterocyclic group containing at least one hetero atom selected from the group consisting of N, S, O, P, Se, and Te (e.g., an imidazolyl group, a thienyl group, a pyrazolyl group, a thiazolyl group, a pyridyl group, and a quinolinyl group). The heterocyclic group may contain substituents as defined with respect to the aryl group represented by $R_6$ or $R_7$.

The above mentioned carboxyl group, sulfo group, phosphino group, and phosphono group may contain a carboxylate group, a sulfonate group, a phosphinate group, and a phosphonate group, respectively. Examples of counter ions contained in these groups include $Li^+$, $Na^+$, $K^+$, and ammonium.

$R_6$ in CIII and CIV is preferably a cyano group, a carboxyl group, a $C_{1-10}$ carbamoyl group, a $C_{2-10}$ alkoxycarbonyl group, a $C_{7-11}$ aryloxycarbonyl group, a $C_{0-10}$ sulfamoyl group, a sulfo group, a $C_{1-10}$ alkyl group (e.g., a methyl group, a carboxymethyl group and a sulfomethyl group), a $C_{1-10}$ sulfonyl group (e.g., a methylsulfonyl group and a phenylsulfonyl group), a $C_{1-10}$ carbonamide group (e.g., an acetamide group and a benzamide group), a $C_{1-10}$ sulfonamide group (e.g., a methanesulfonamide and a toluenesulfonamide group), an alkyloxy group (e.g., a methoxy group and an ethoxy group), or an aryloxy group (e.g., a phenoxy group). Particularly preferred among these groups are a cyano group, a carbamoyl group, an alkoxycarbonyl group, and a carboxyl group.

$R_7$ in CIII and CIV is preferably a hydrogen atom, a $C_{1-12}$ alkyl group (e.g., a methyl group, a sulfomethyl group, a carboxymethyl group, an ethyl group, a 2-sulfoethyl group, a 2-carboxyethyl group, a 3-sulfopropyl group, a 3-carboxypropyl group, a 5-sulfopentyl group, a 5-carboxypentyl group, and a 4-sulfobenzyl group), or a $C_{6-15}$ aryl group (e.g., a phenyl group, a 4-carboxyphenyl group, a 3-carboxyphenyl group, a 2,4-dicarboxyphenyl group, a 4-sulfophenyl group, a 3-sulfophenyl group, a 2,5-disulfophenyl group, and a 2,4-disulfophenyl group), more preferably a $C_{1-7}$ alkyl group, or a $C_{6-10}$ aryl group.

Specific examples of Cp, X, Q,

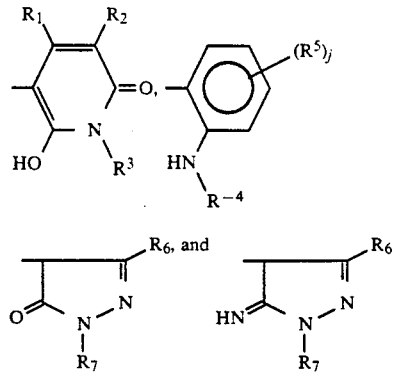

are set forth below.

Examples of Cp are:

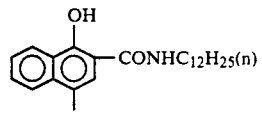

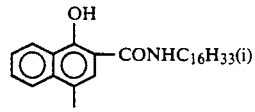

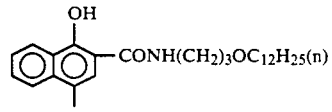

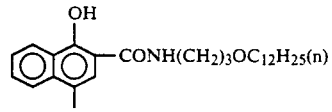

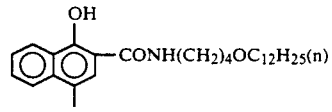

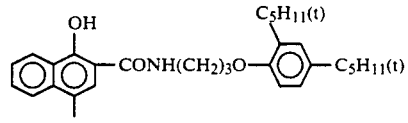

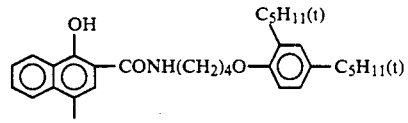

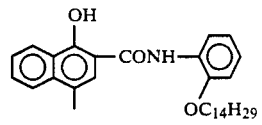

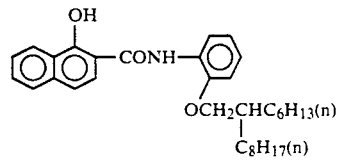

-continued
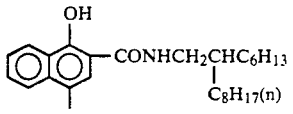
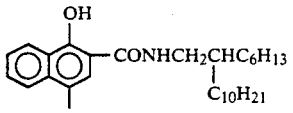
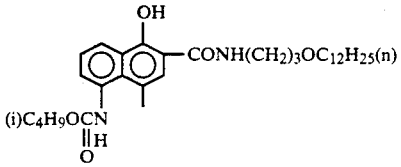
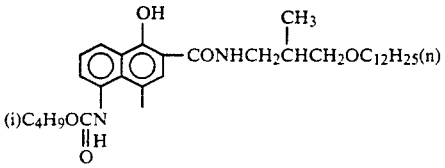
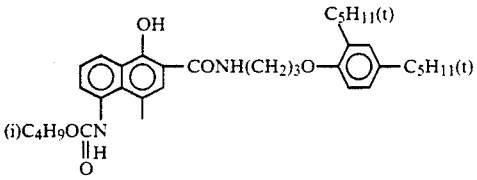
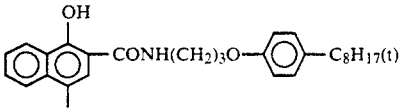
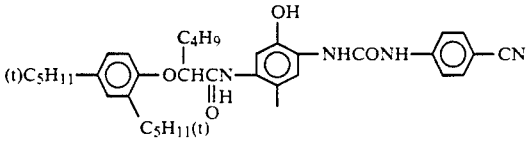
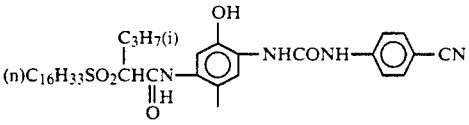
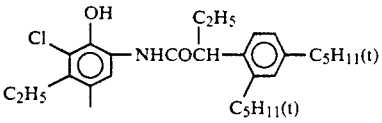
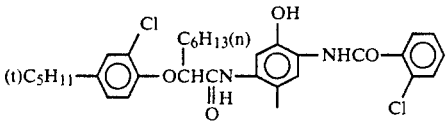
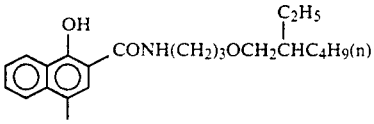
-continued
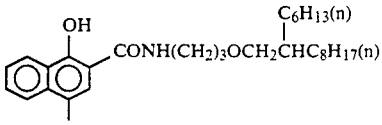
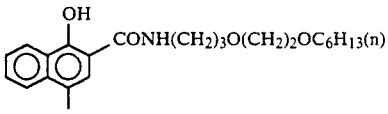
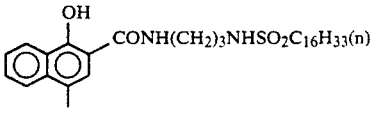
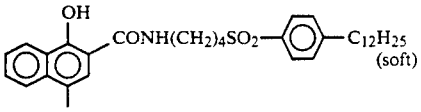
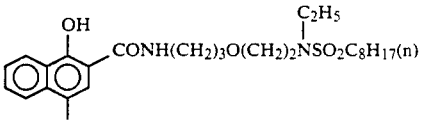
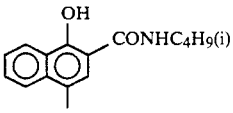
Examples of X are:
—O—, —S—, —$OCH_2$—, —$OCH_2CH_2$—, ——$OCH_2CH_2O$—, —$OCH_2CH_2CH_2O$—, ——$O(CH_2CH_2O)_2$—, —$OCH_2CH_2S$—, —$OCH_2CH_2NHCO$—, —$OCH_2CH_2NHSO_2$—, —$OCH_2CH_2SO_2$—, —$OCH_2CH_2OCO$—, —$OCH_2CH_2CO$—, —$SCH_2CONH$—, —$SCH_2COO$—,
—OCH(CH3)CONH—,
—$OCH_2CH_2OSO_2$—, —OCO—,
—$OCH_2CH(CO_2H)$—, —$OCH_2CH(CO_2H)CH_2$—,
—$OCH_2CH(CO_2H)O$—, —$OCH(CO_2H)CH_2O$—,
—$OCH_2CH(CO_2H)S$—, —$OCH_2CH(SO_3Na)O$—,
Examples of Q are:
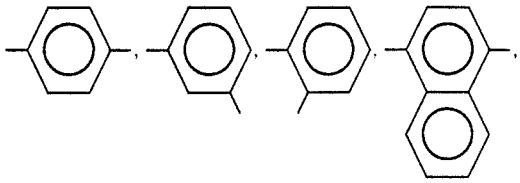

-continued
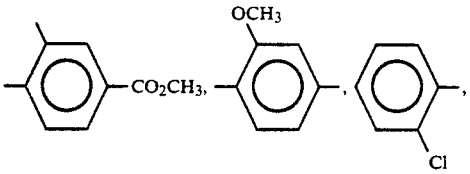
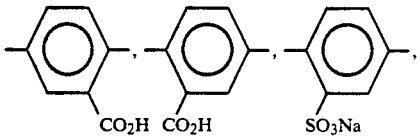
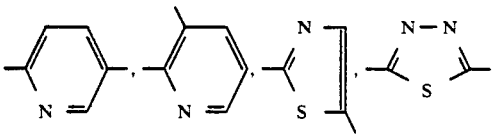
Examples of
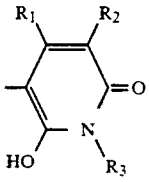
are:
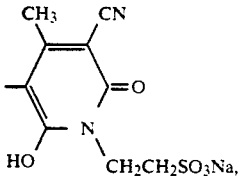
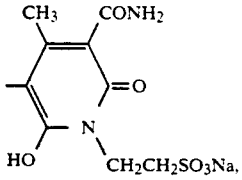
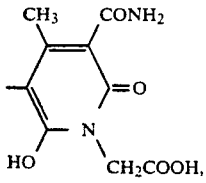
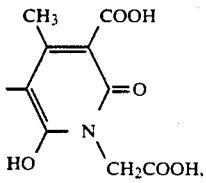
-continued
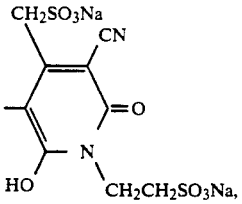
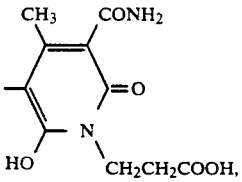
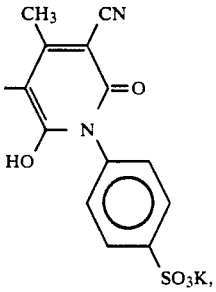
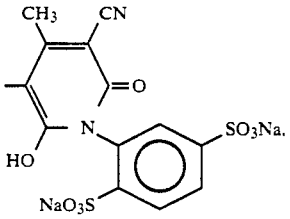
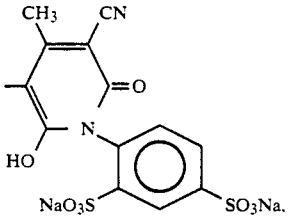
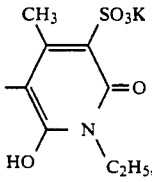
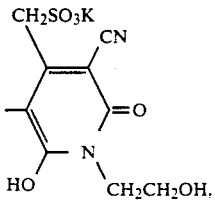

-continued
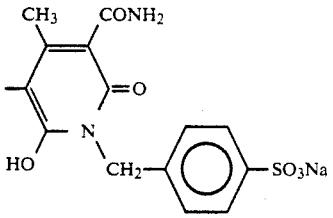
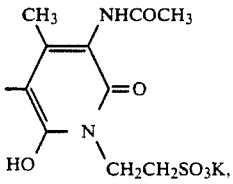
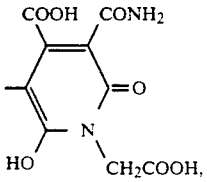
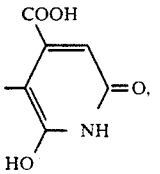
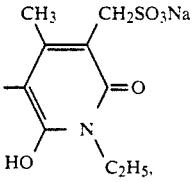
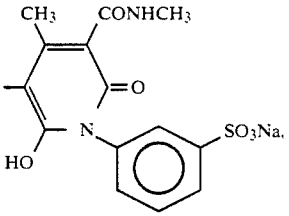
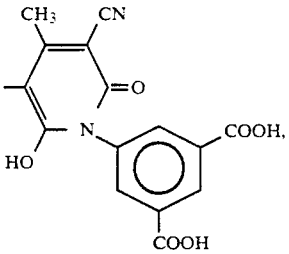
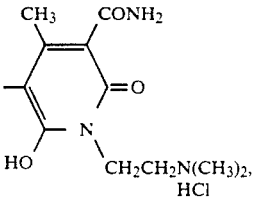
-continued
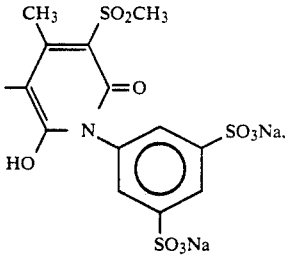
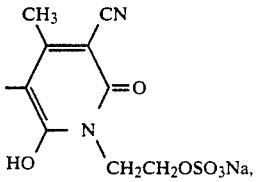
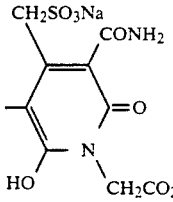
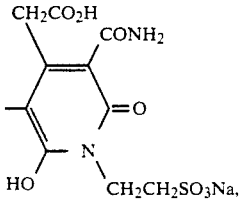
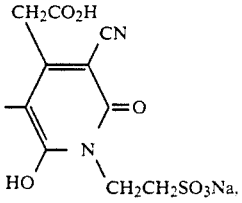
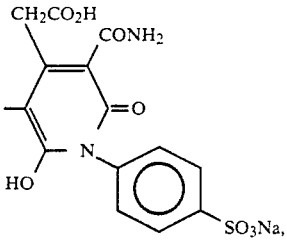
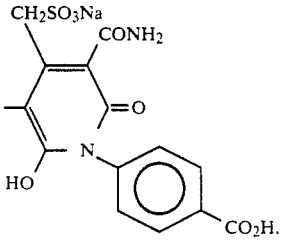

-continued
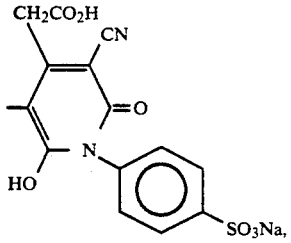
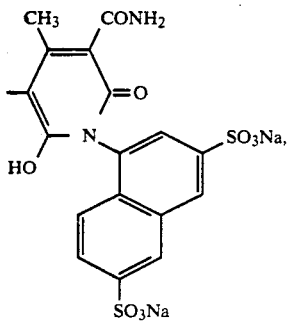
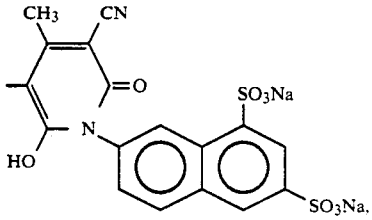
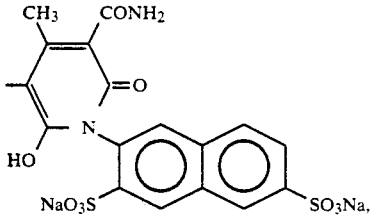
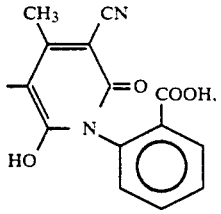
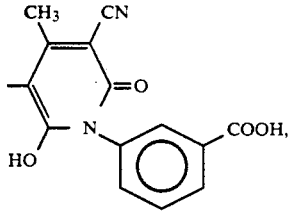
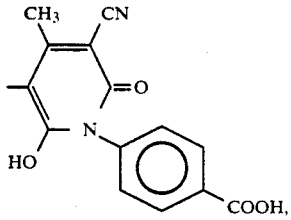
-continued
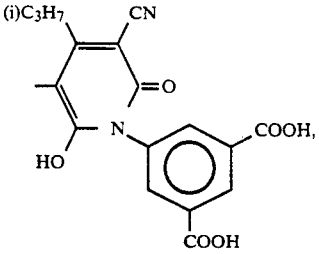
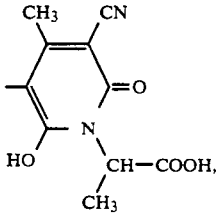
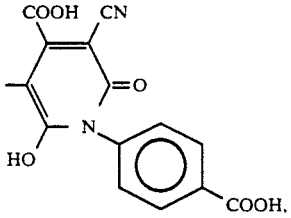
Examples of
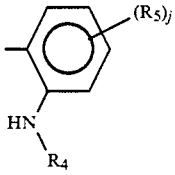
are:
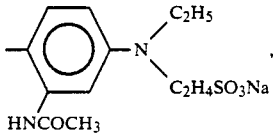
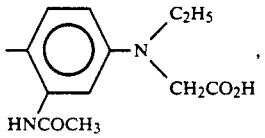
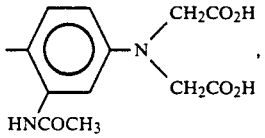
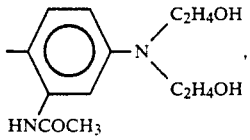

-continued
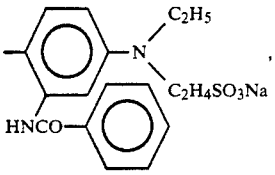
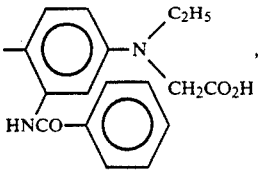
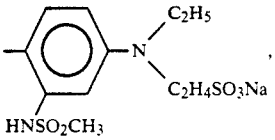
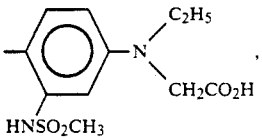
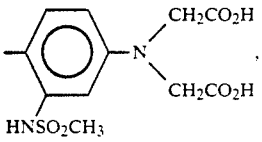
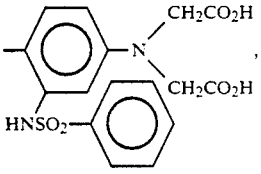
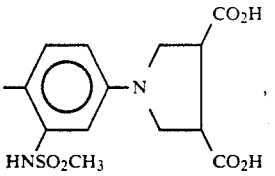
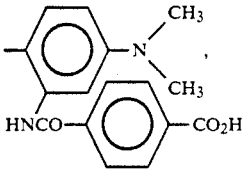
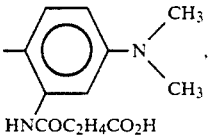
-continued
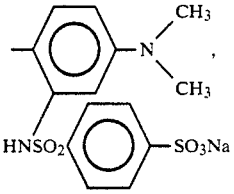
Examples of
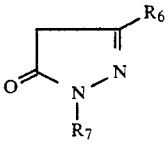
are:
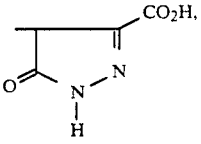
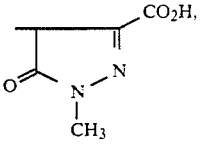
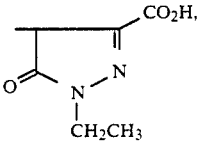
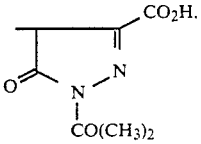
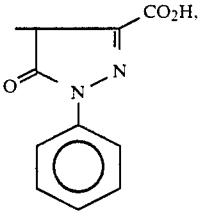
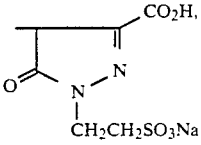
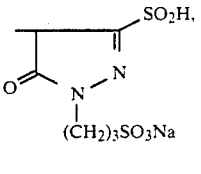
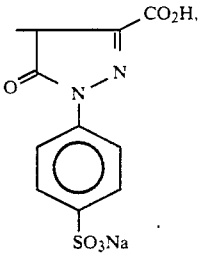
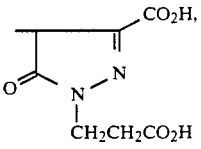
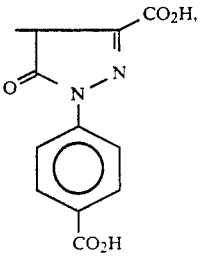

-continued
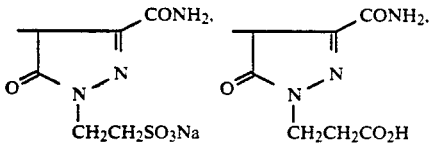
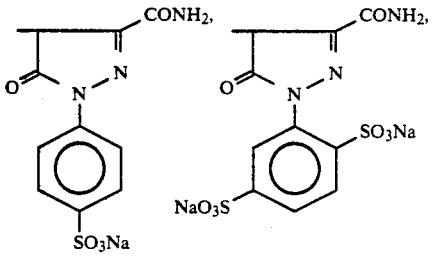
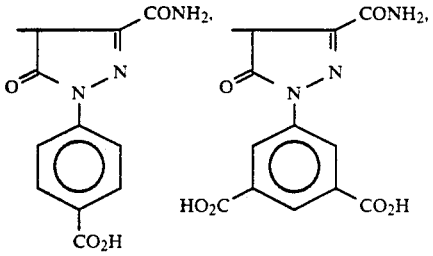
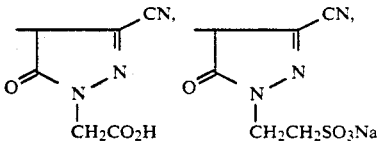
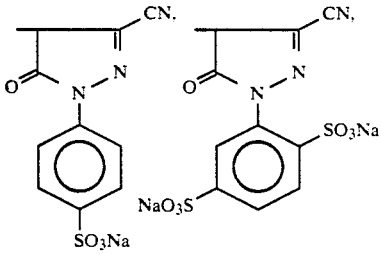
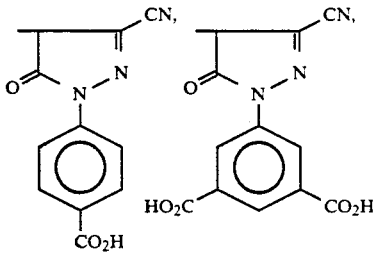
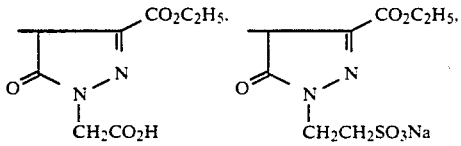
-continued
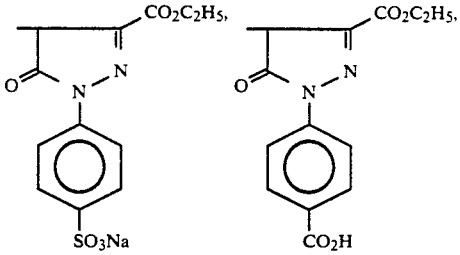
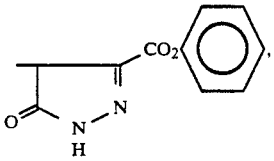
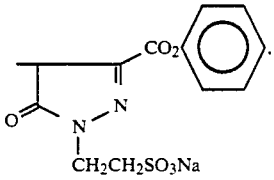
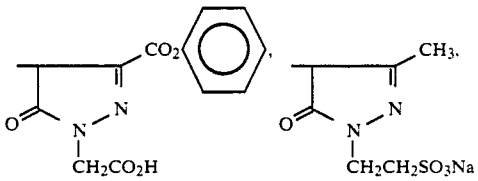
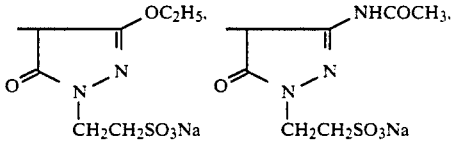
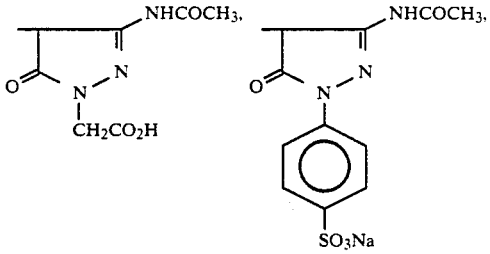
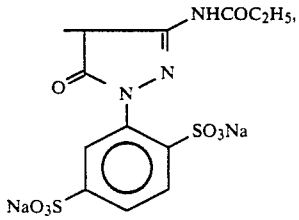

-continued
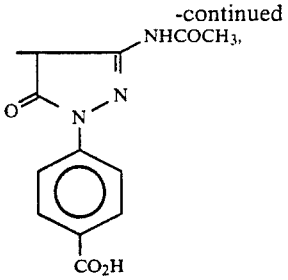
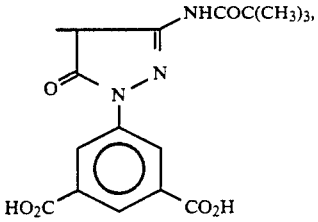
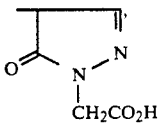
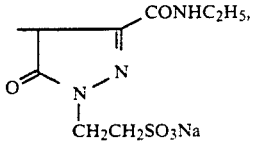
Examples of
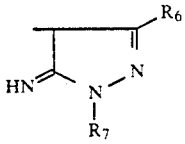
are:
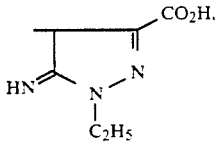
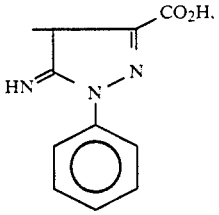
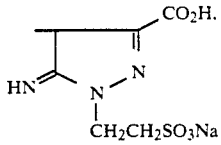
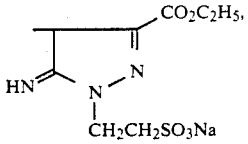
-continued
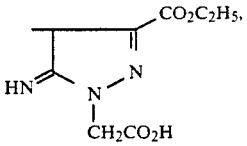
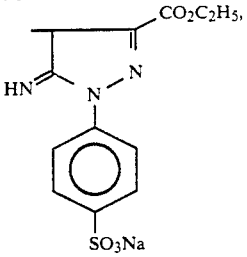
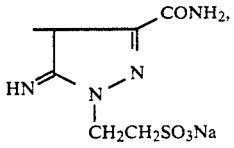
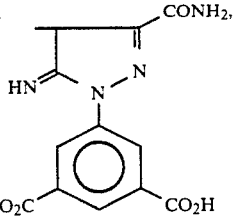
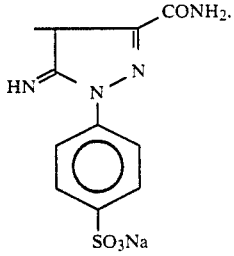
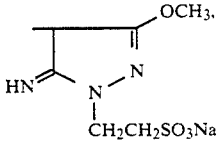
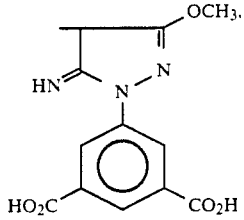
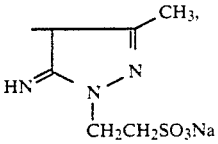
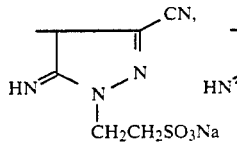
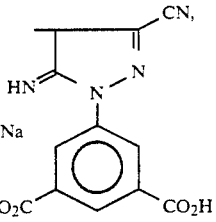
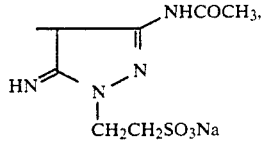
Examples of yellow colored cyan couplers are:
(YC-1)
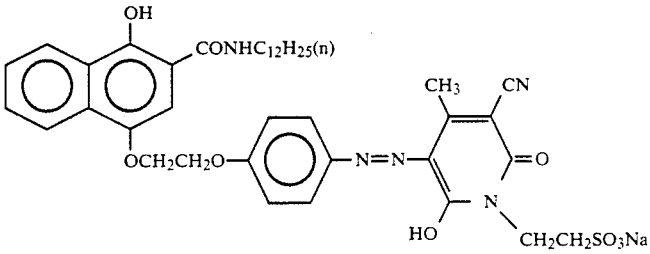

-continued
(YC-2)
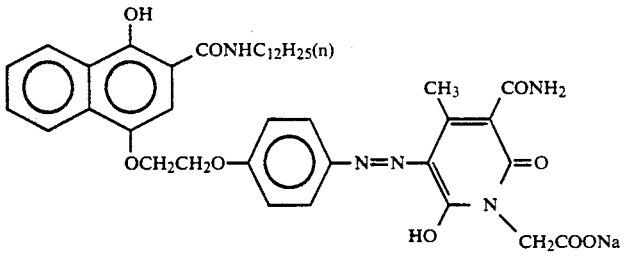
(YC-3)
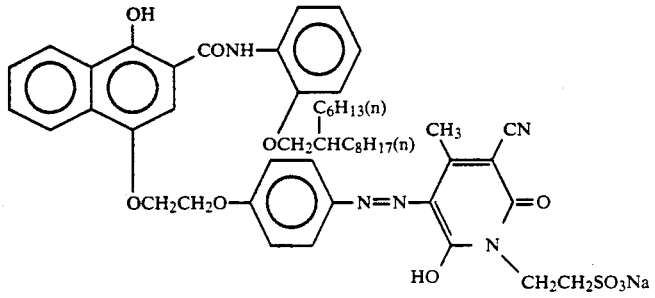
(YC-4)
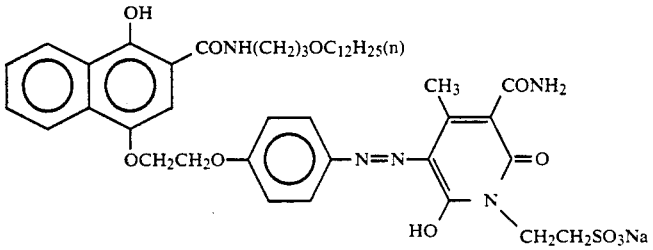
(YC-5)
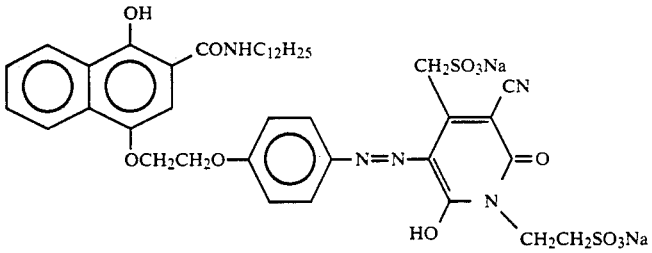
(YC-6)
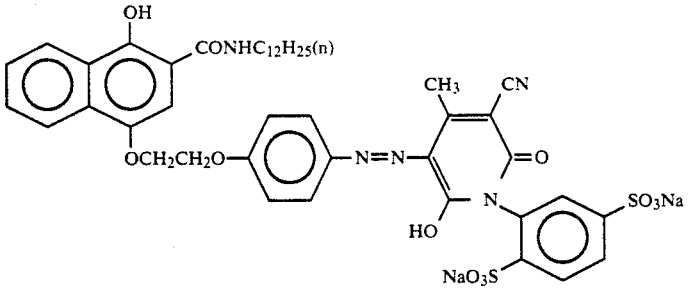
(YC-7)
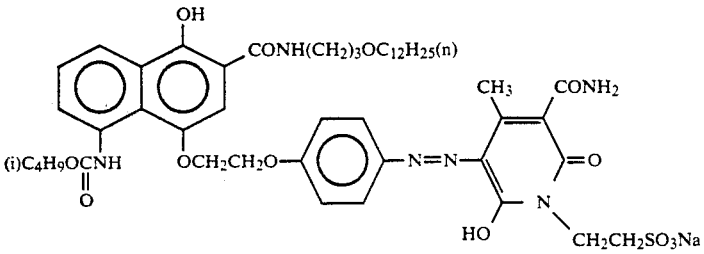

-continued
(YC-8)
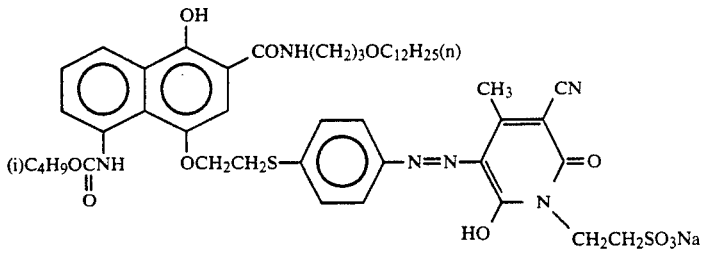
(YC-9)
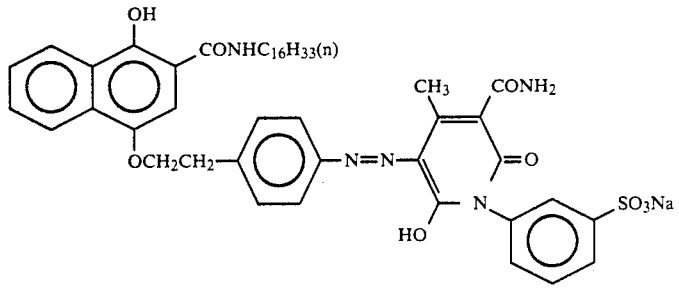
(YC-10)
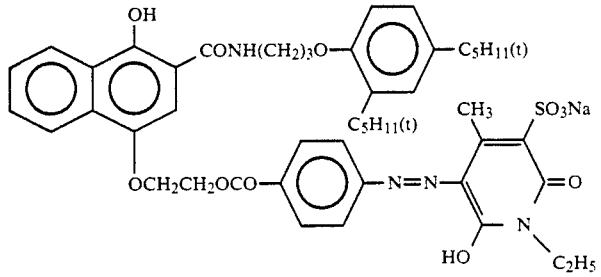
(YC-11)
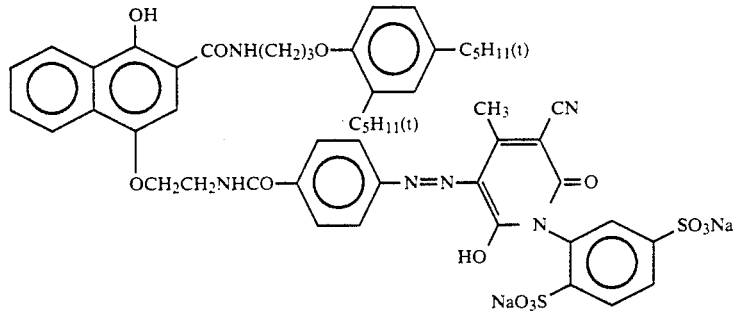
(YC-12)
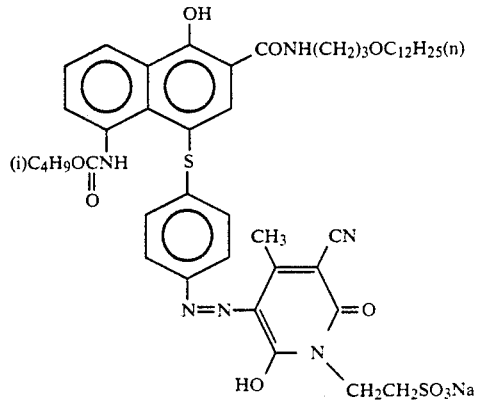

-continued
(YC-13)
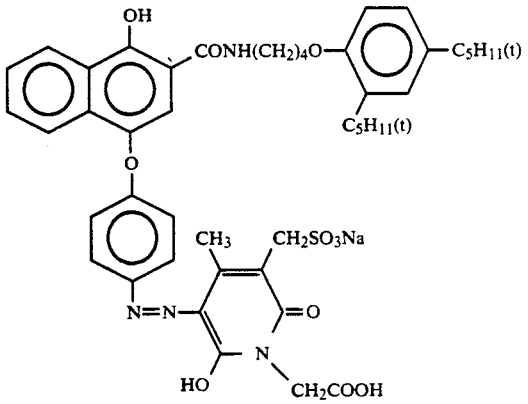
(YC-14)
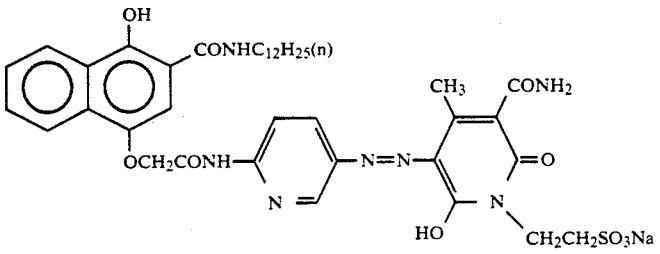
(YC-15)
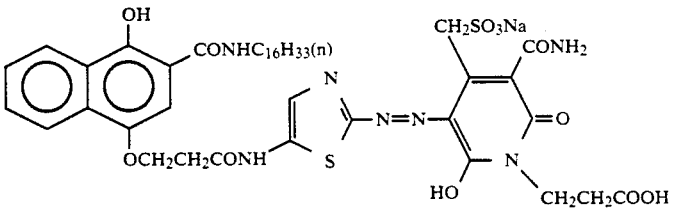
(YC-16)
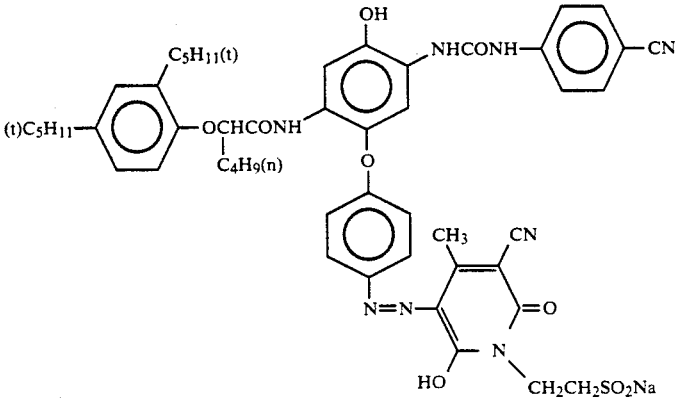

-continued
(YC-17)
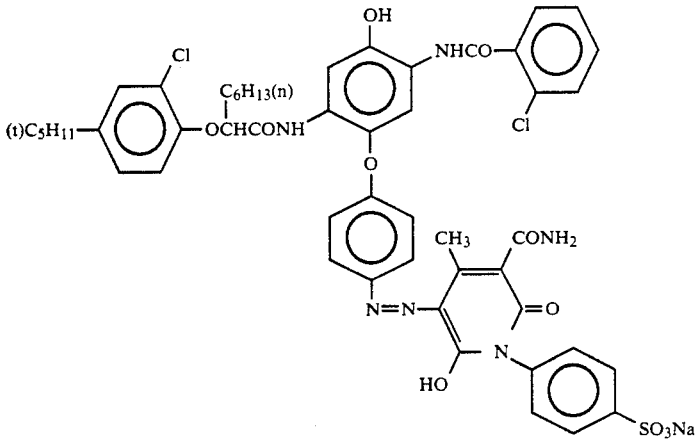
(YC-18)
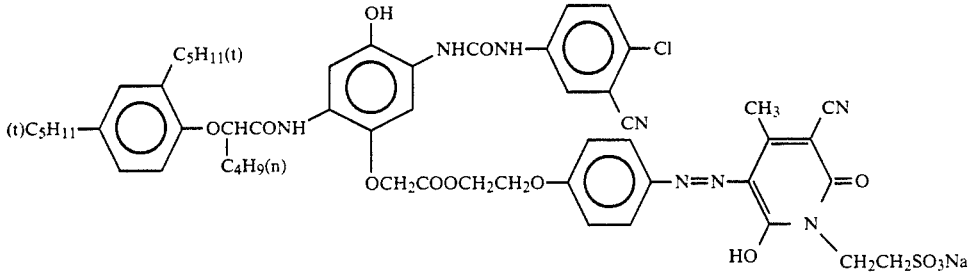
(YC-19)
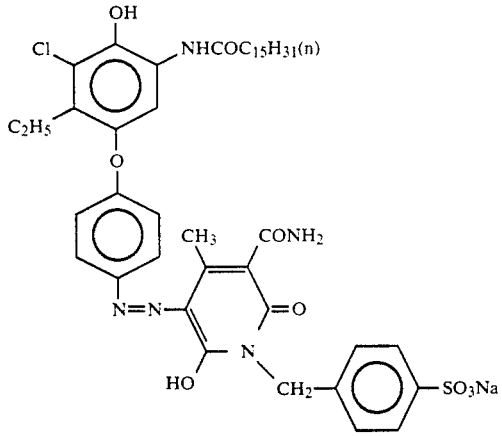
(YC-20)
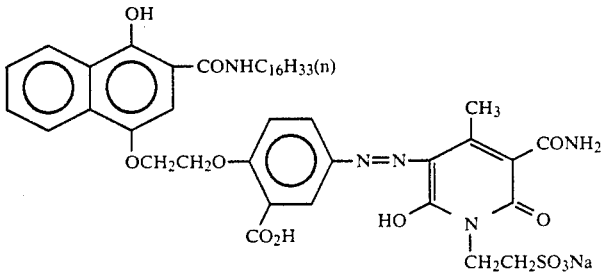

-continued
(YC-21)
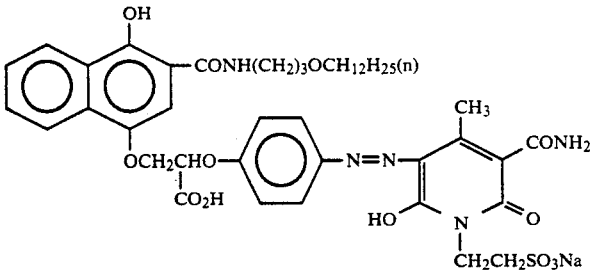
(YC-22)
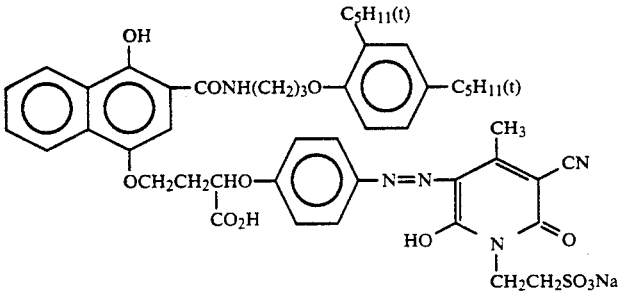
(YC-23)
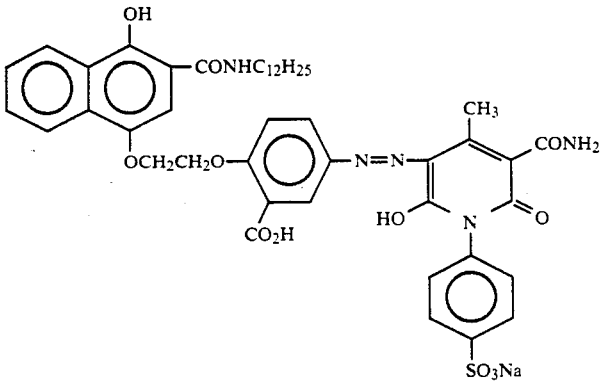
(YC-24)
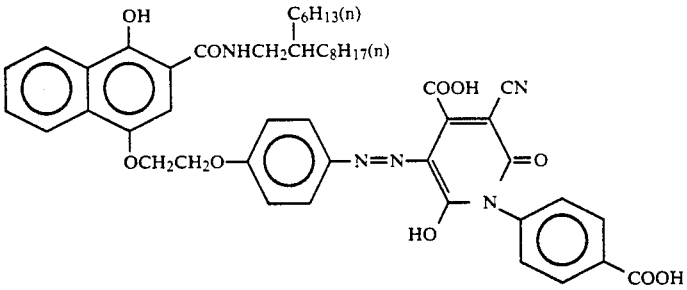
(YC-25)
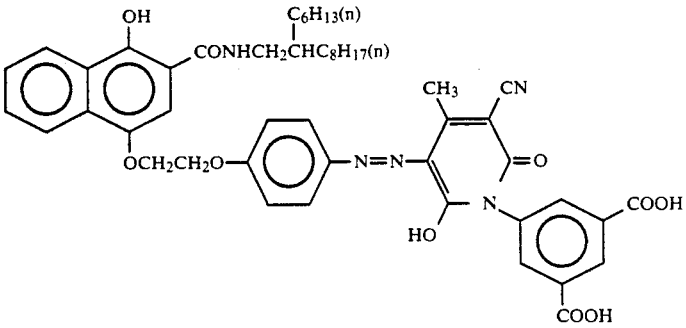

-continued
(YC-26)
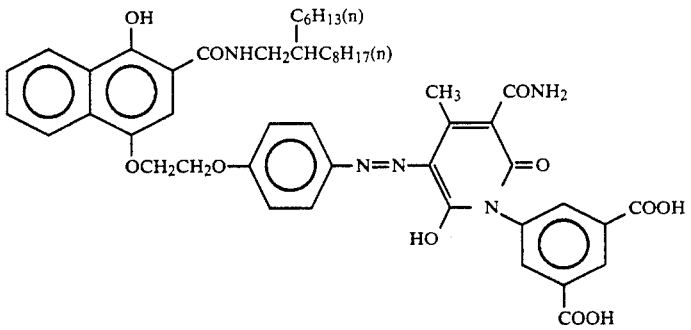
(YC-27)
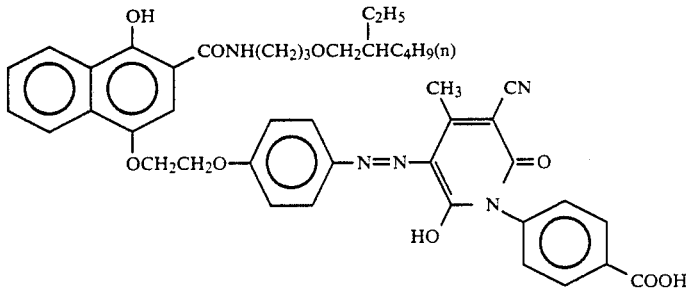
(YC-28)
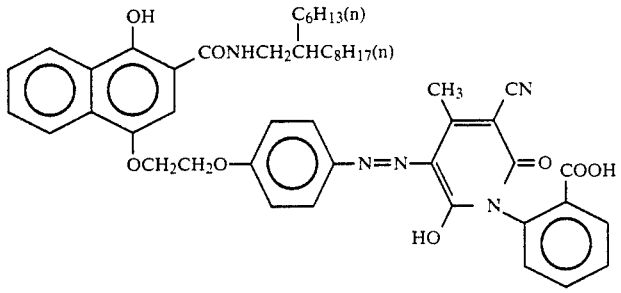
(YC-29)
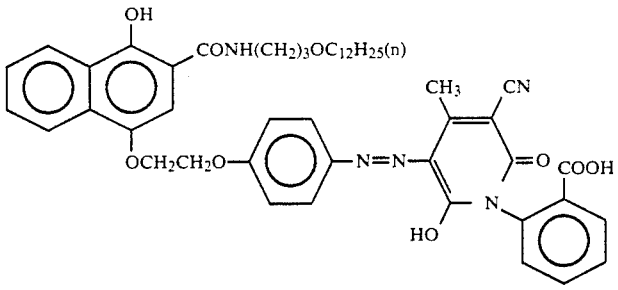
(YC-30)
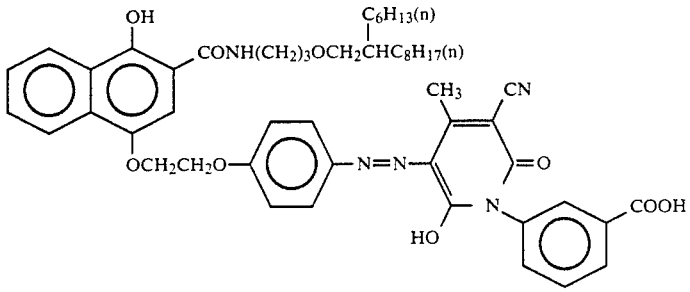

-continued
(YC-31)
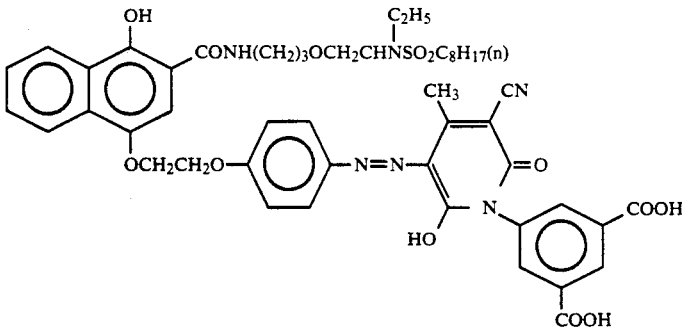
(YC-32)
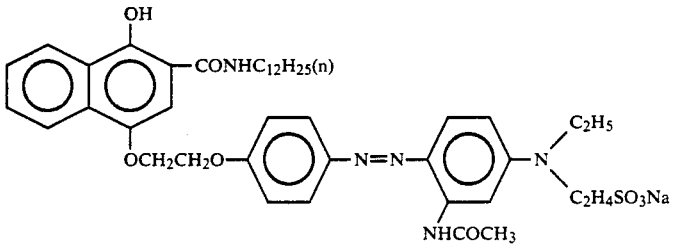
(YC-33)
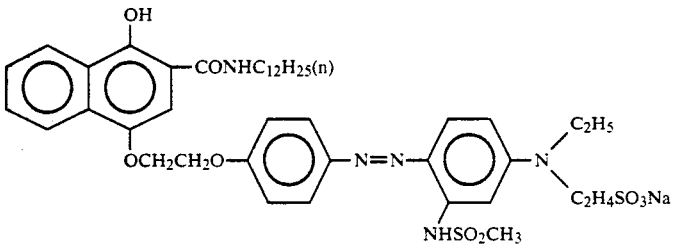
(YC-34)
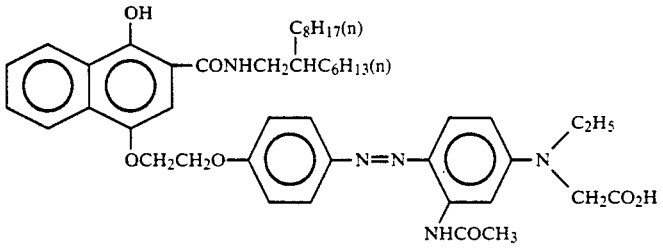
(YC-35)
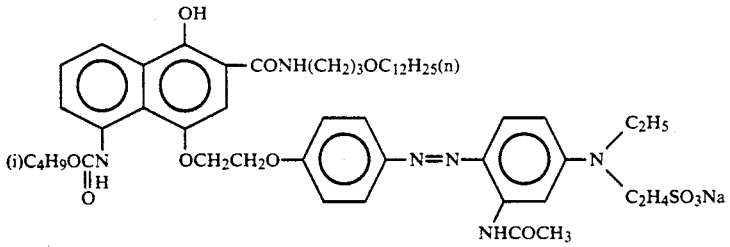
(YC-36)
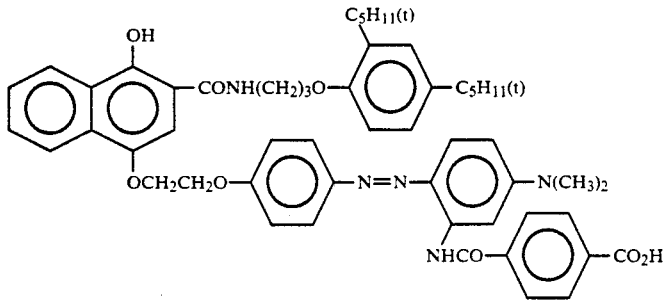

-continued
(YC-37)
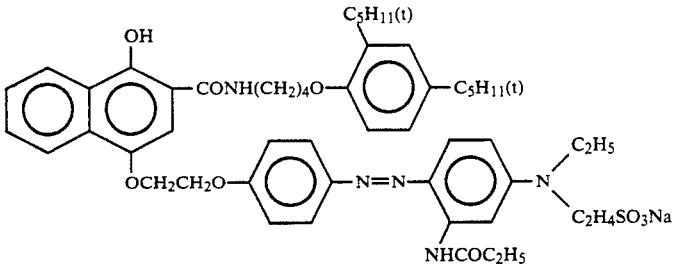
(YC-38)
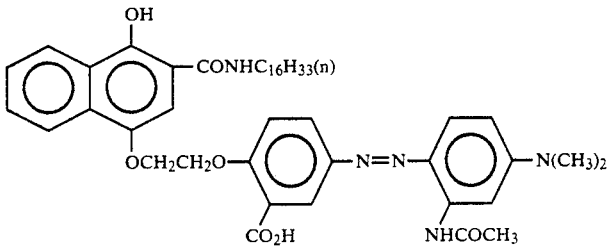
(YC-39)
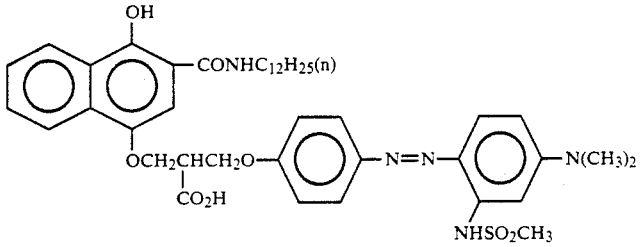
(YC-40)
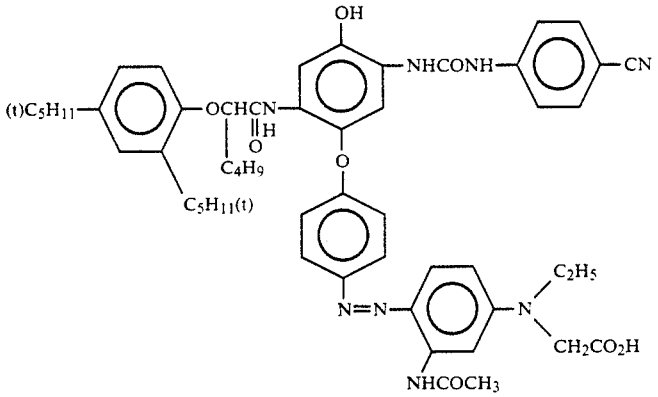
(YC-41)
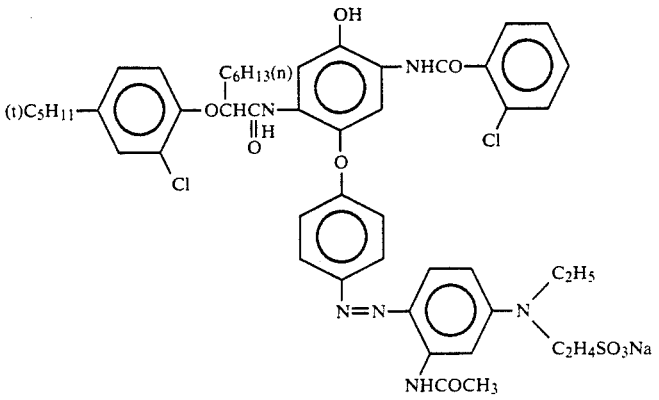

-continued
(YC-42)
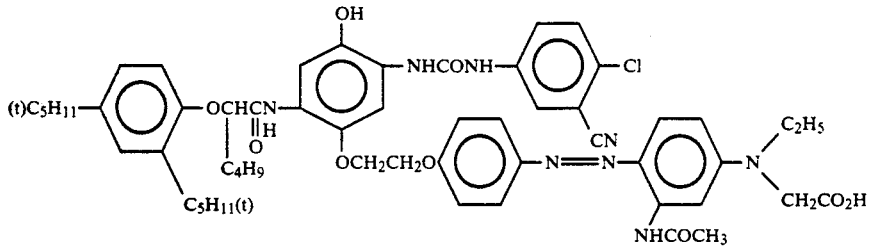
(YC-43)
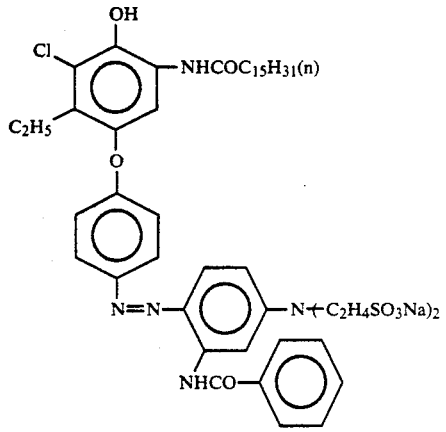
(YC-44)
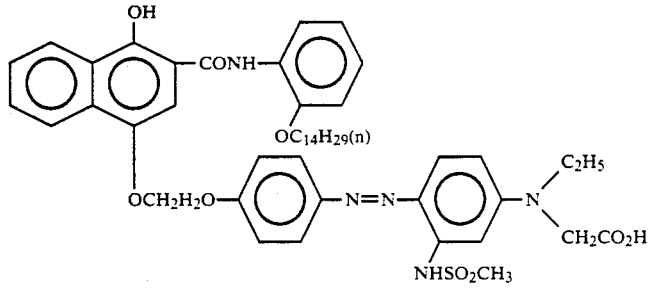
(YC-45)
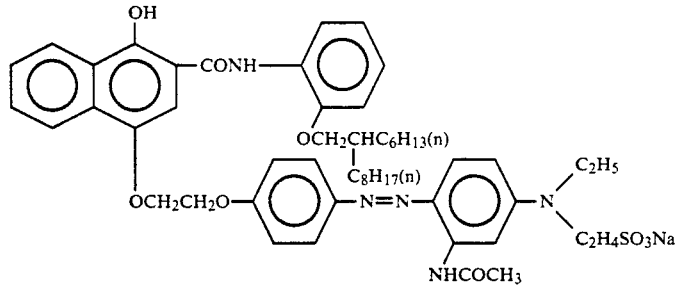
(YC-46)
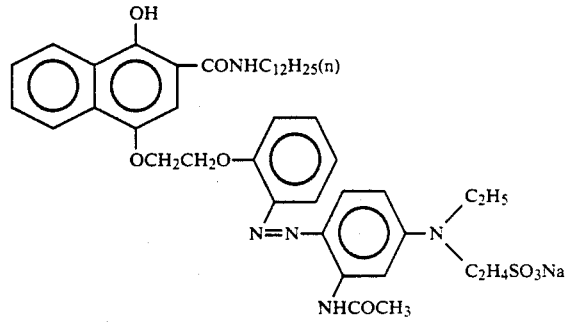

-continued
(YC-47)
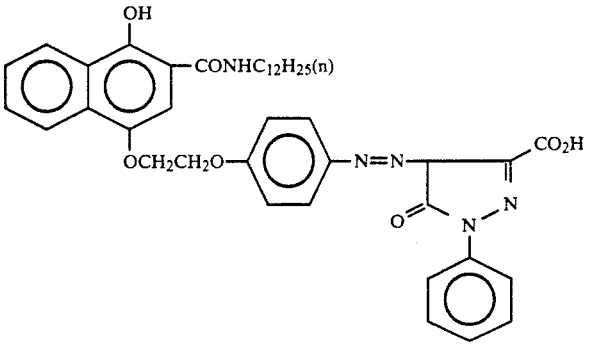
(YC-48)
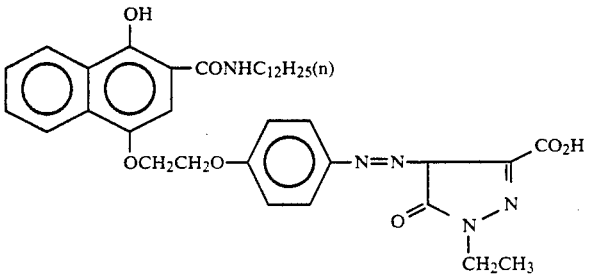
(YC-49)
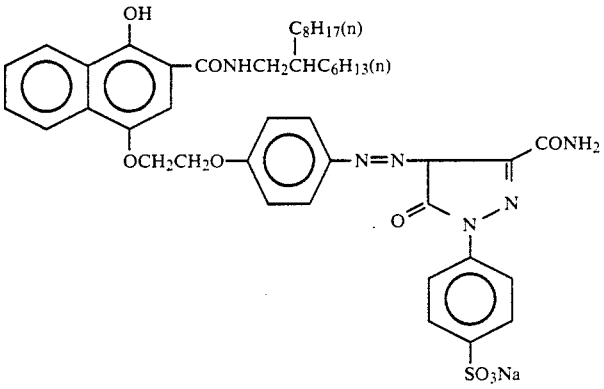
(YC-50)
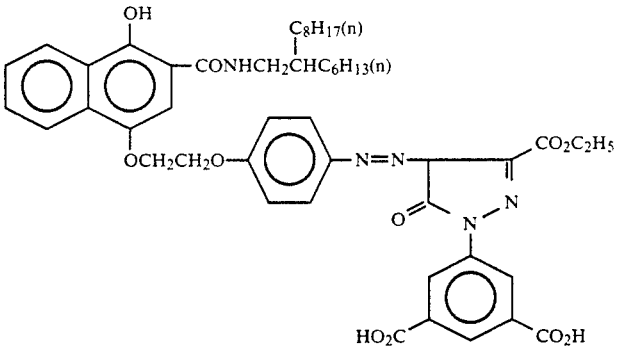
(YC-51)
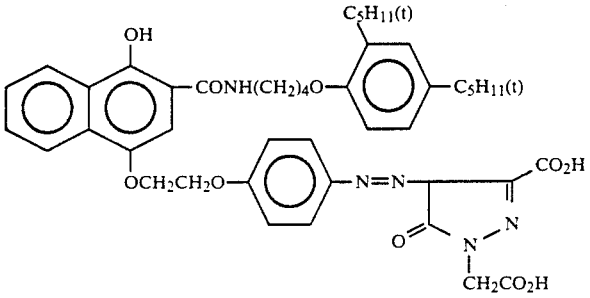

-continued (YC-52)

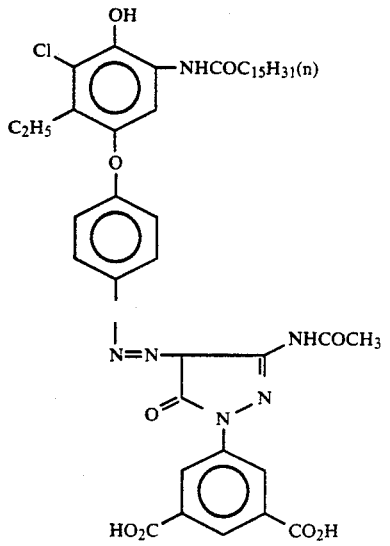

(YC-53)

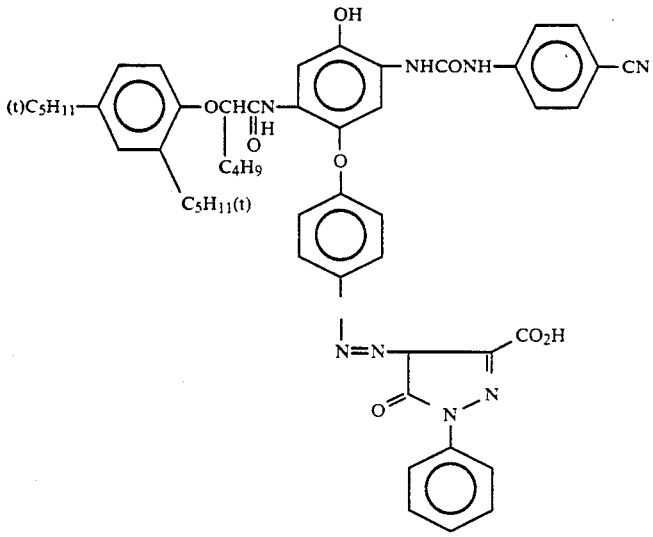

(YC-54)

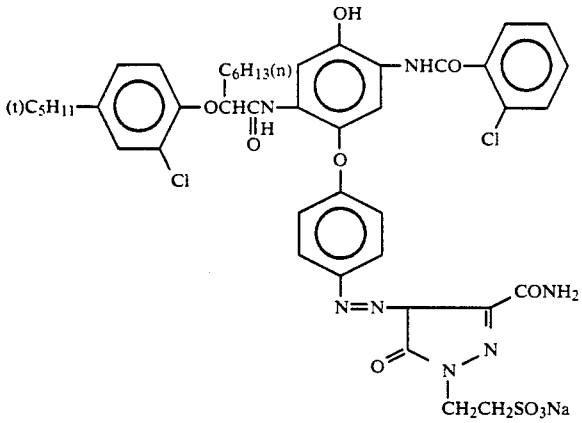

The synthesis of the yellow colored coupler represented by general formula (CI) of the present invention can normally be accomplished by a diazo coupling reaction of a 6-hydroxy-2-pyridone with an aromatic or heterocyclic diazonium salts containing a coupler structure.

The synthesis of such 6-hydroxy-2-pyridones can be accomplished, for example, using the methods disclosed in KLINGSBERG, *Heterocyclic Compounds—Pyridine and Its Derivatives-Part III*, Interscience, 1962; *Journal of The American Chemical Society*, 1943, vol. 65, page 449; *Journal of The Chemical Technology & Biotechnology*, 1986, vol. 36, page 410; *Tetrahedron*, 1966, vol. 22, page 445; JP-B-61-52827; West German Patents 2,162,612, 2,349,709, and 2,902,486; and U.S. Pat. No. 3,763,170.

The synthesis of the diazonium salts can be accomplished, for example using the methods disclosed in U.S. Pat. Nos. 4,004,929, and 4,138,258; JP-A-61-72244; and JP-A61-273543. The diazo coupling reaction of a 6-hydroxy-2-pyridone with a diazonium salts can be effected in a solvent such as methanol, ethanol, methylcellusolve, acetic acid, N,N-dimethylformamide, N,N-dimethylacetamide, tetrahydrofuran, dioxane, and water or a mixture thereof; in the presence of a base such as sodium acetate, potassium acetate, sodium carbonate, potassium carbonate, sodium hydrogencarbonate, sodium hydroxide, potassium hydroxide, pyridine, triethylamine, tetramethylurea and tetramethylguanidine; at a temperature of −78° to 60° C., preferably −20° to 30° C.

Examples of the synthesis of yellow colored couplers of the present invention will be set forth below.

SYNTHESIS EXAMPLE 1

Synthesis of Exemplary Coupler (YC-1)

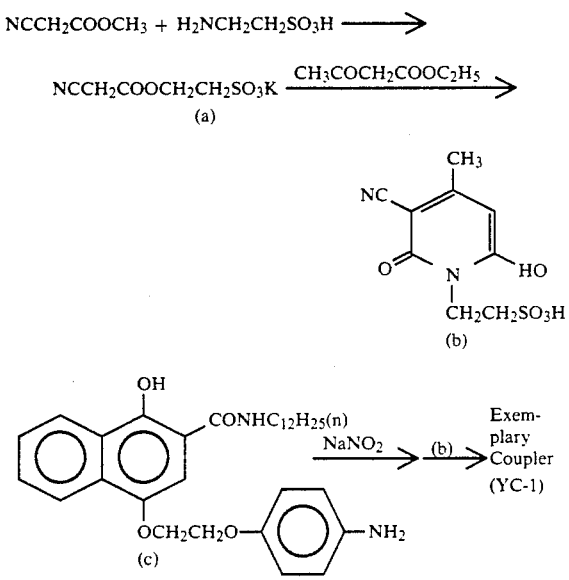

Synthesis of Compound (a)

500 ml of methanol was added to 125.2 g of taurine and 66 g of potassium hydroxide. 110 g of methyl cyanoacetate was added dropwise to the mixture with stirring at an elevated temperature over about 1 hour. The reaction system was then heated under reflux for 5 hours. The reaction system was allowed to stand overnight. The resulting crystal was filtered off, washed with ethanol, and then dried to obtain 202.6 g of Compound (a) in the crystal form.

Synthesis of Compound (b)

11.5 ml of water was added to 11.5 g of Compound (a) and 3.5 g of potassium carbonate. 7.8 g of ethyl acetoacetate was added dropwise to the mixture with stirring at an elevated temperature over a steam bath. The reaction system was further stirred for 7 hours. The reaction system was allowed to cool. 9.2 ml of concentrated hydrochloric acid was added to the reaction system with stirring. The resulting crystal was filtered off, washed with methanol, and then dried to obtain 10.4 g of Compound (b) in the crystal form.

Synthesis of Exemplary Coupler (YC-1)

10.1 g of Compound (c) prepared by the synthesis method disclosed in U.S. Pat. No. 4,138,258 were dissolved in 60 ml of N,N-dimethylformamide and 60 ml of methyl cellosolve. 4.3 ml of concentrated hydrochloric acid was then added to the reaction system while the reaction system was cooled with ice. A solution of 1.84 g of sodium sulfite in 5 ml of water was added dropwise to the reaction system to prepare a diazonium solution. 60 ml of methyl cellosolve and 20 ml of water were added to 7.8 g of Compound (b) and 8.2 g of sodium acetate. The diazonium solution previously prepared was then added dropwise to the mixture with stirring while the reaction system was cooled with ice. After the dropwise addition was completed, the reaction system was further stirred for 1 hour, and then for 2 hours at room temperature. The resulting crystal was filtered off, washed with water, and then dried to obtain a crystal which was then dispersed in 500 ml of methanol. The dispersion was then heated under reflux for 1 hour, and allowed to cool. The resulting crystal was filtered off, washed with methanol, and then dried to obtain 13.6 g of Exemplary Coupler (YC-1) in the form of a red crystal. The compound thus obtained had a melting point of 269° C. to 272° C. (decomposition). The structure of the compound was confirmed by $^1$HNMR spectroscopy, mass spectroscopy and elementary analysis. The compound exhibited a maximum absorption wavelength of 457.7 nm and a molar extinction coefficient of 41,300 as determined in methanol and thus exhibited excellent spectral absorption characteristics for a yellow colored coupler.

SYNTHESIS EXAMPLE 2

Synthesis of Exemplary Coupler (YC-3)

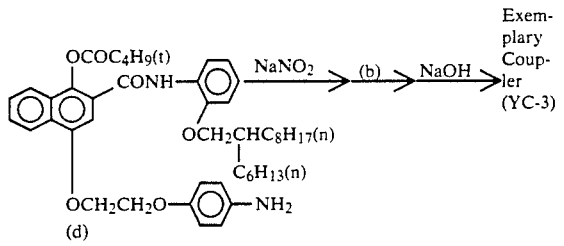

19.2 g of Compound (d) prepared by the synthesis method disclosed in JP-A-62-85242 were dissolved in 75 ml of N,N-dimethylformamide and 75 ml of methyl cellosolve. 5.6 ml of concentrated hydrochloric acid was then added to the solution with stirring while the reaction system was cooled with ice. A solution of 2.5 g of sodium nitrite in 5 ml of water was then added dropwise to the reaction system. When 1 hour passed after the completion of the dropwise addition, the reaction system was stirred at room temperature for 1 hour to prepare a diazonium solution.

75 ml of methyl cellosolve and 26 ml of water were added to 10.1 g of Compound (b) and 10.7 g of sodium acetate. The diazonium solution previously prepared was then added dropwise to the solution with stirring while the reaction system was cooled with ice. When 1 hour passed after the completion of the dropwise addition, the reaction system was further stirred at room temperature for 2 hours. The resulting crystal was filtered off. The crystal was then dispersed in 200 ml of methanol. A solution of 2.2 g of sodium hydroxide in 10 ml of water was added dropwise to the dispersion. The reaction system was then stirred for 3 hours. The reaction system was neutralized with concentrated hydrochloric acid. The resulting crystal was washed with water and then with methanol, and then dried. The resulting crude crystal was purified with methanol in the same manner as in Synthesis Example 1 to obtain 14.8 g of Exemplary Coupler (YC-3). The compound thus obtained had a melting point of 246° C. to 251° C. (decomposition). The structure of the compound was confirmed by $^1$HNMR spectroscopy, mass spectroscopy and elementary analysis. The compound exhibited a maximum absorption wavelength of 457.6 nm and a molar extinction coefficient of 42,700 as determined in methanol and thus exhibited excellent spectral absorption characteristics for a yellow colored coupler.

SYNTHESIS EXAMPLE 3

Synthesis of Exemplary Coupler (YC-28)

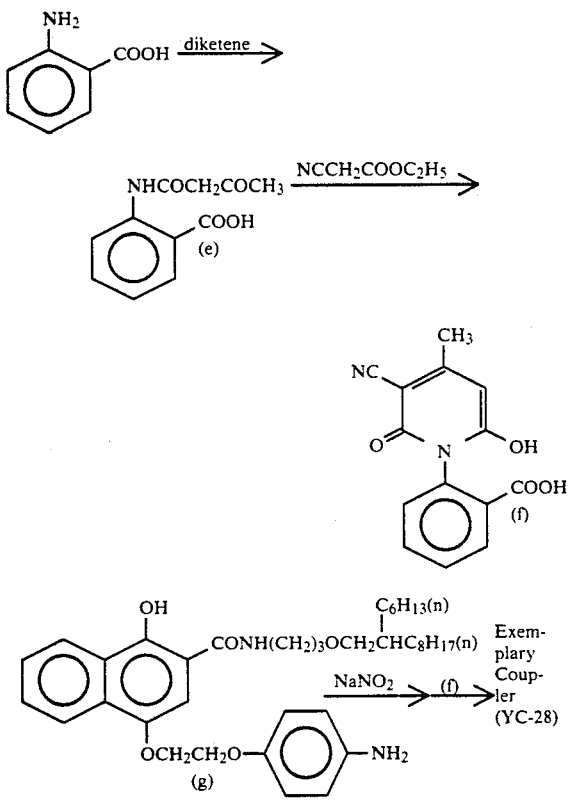

Synthesis of Compound (e)

137.1 g of anthranilic acid was added to 600 ml of acetonitrile. 92.5 g of diketene was added dropwise to the solution at an elevated temperature with stirring over about 1 hour. The reaction system was heated under reflux for 1 hour, and then allowed to cool to room temperature. The resulting crystal was filtered off, washed with acetonitrile, and then dried to obtain 200.5 g of Compound (e) in crystal form.

Synthesis of Compound (f)

199.1 g of Compound (e), 89.2 g of ethyl cyanoacetate, and 344 g of 28% sodium methoxide were added to 0.9 liter of methanol. The reaction system was allowed to undergo reaction at a temperature of 120° C. in an autoclave for 8 hours. The reaction system was allowed to stand overnight. The reaction mixture was concentrated under reduced pressure. 700 ml of water was added to the reaction system. The reaction system was acidified with 230 ml of concentrated hydrochloric acid. The resulting crystal was filtered off. The crude crystal thus obtained was then washed with a mixture of ethyl acetate and acetonitrile at an elevated temperature to obtain 152 g of Compound (f).

Synthesis of Exemplary Coupler (YC-28)

13.0 g of Compound (g) prepared in accordance with the synthesis method as disclosed in U.S. Pat. No. 4,138,258 was dissolved in 40 ml of N,N-dimethylformamide. 4.5 ml of concentrated hydrochloric acid was added to the solution while the reaction system was cooled with ice. A solution of 1.48 g of sodium nitrite in 5 ml of water was added dropwise to the reaction system to prepare a diazonium solution. 20 ml of N,N-dimethylformamide and 15 ml of water were added to 6.0 g of Compound (f) and 8 g of sodium acetate. The diazonium solution previously prepared was then added dropwise to the mixture with stirring while the reaction system was cooled with ice. The reaction system was further stirred at room temperature for 30 minutes. The reaction system was acidified with hydrochloric acid. The reaction system was then extracted with ethyl acetate, washed with water, and then concentrated under reduced pressure. The concentrate was recrystallized with a mixture of ethyl acetate and methanol to obtain 13 g of Exemplary Coupler (YC-28) in a yellow crystal form. The compound thus obtained exhibited a melting point of 154° C. to 156° C. The structure of the compound was confirmed by $^1$HNMR spectroscopy, mass spectroscopy and elementary analysis. The compound exhibited a maximum absorption wavelength of 458.2 nm and a molar extinction coefficient of 42,800 as determined in methanol and thus exhibited excellent spectral absorption characteristics for a yellow colored coupler.

The synthesis of yellow colored cyan couplers represented by general formulae (CII) to (CIV) can be accomplished using the coupler synthesis methods as disclosed in JP-B-6939 and JP-A-1-197563 and the methods for the synthesis of couplers of general formula (CI) as disclosed in the above-cited related patents.

In the present invention, yellow colored cyan couplers represented by general formulae (CI) and (CII) are more preferably used. Particularly preferred among these couplers are those represented by general formula (CI).

The yellow colored cyan coupler of the present invention is preferably incorporated in a light-sensitive silver halide emulsion layer or its adjacent layers in the light-sensitive material; particularly a red-sensitive emulsion layer. The total amount of the yellow colored cyan coupler to be incorporated in the light-sensitive material is in the range of 0.005 to 0.30 g/m$^2$; preferably 0.02 to 0.20 g/m$^2$; more preferably 0.03 to 0.15 g/m$^2$.

The yellow colored cyan coupler of the present invention can be incorporated in the light-sensitive material in the same manner as ordinary couplers as described later.

The present color photographic light-sensitive material can comprise at least one blue-sensitive silver halide emulsion layer, at least one green-sensitive silver halide emulsion layer, and at least one red-sensitive silver halide emulsion layer on a support. The number of silver halide emulsion layers and light-insensitive layers and the order of arrangement of these layers are not specifically limited. In a typical embodiment, the present silver halide photographic material comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light, or red light. In a multi-layer silver halide color photographic material, these-unit light-sensitive layers are normally arranged in the following order: a red-sensitive layer, a green-sensitive layer, and a blue-sensitive layer as viewed from the support. However, the order of arrangement can be optionally reversed depending on the purpose of the application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as disclosed in JP-A-61-43748, JP-A-59- 113438, JP-A-59-113440, JP-A-61-20037, and JP-A-61-20038. These interlayers can further comprise a color stain inhibitor, an ultraviolet absorbent, or a stain inhibitor, for example.

The plurality of silver halide emulsion layers constituting each unit light-sensitive layer are preferably in a two-layer structure, i.e., a high sensitivity emulsion layer and low sensitivity emulsion layer, as described in West German Patent 1,121,470 and British Patent 923,045. In general, these layers are preferably arranged in such an order that the light sensitivity decreases towards the support. Furthermore, a light-insensitive layer can be provided between these silver halide emulsion layers. As described in JP-A-57-112751, JP-A-62-200350, JP-A-62-206541, - and JP-A-62-206543, a low sensitivity emulsion layer can be provided remote from the support while a support emulsion layer can be provided nearer to the support.

In an embodiment of such an arrangement the following arrangements are possible: a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) (where RL is positioned closest to the support); BH, BL, GL, GH, RH, and RL (where RL is positioned closest to the support); and BH, BL, GH, GL, RL, and RH (where RH is positioned closest to the support).

Additionally, as . described in JP-B-55-34932, a blue-sensitive layer, GH, RH, GL, and RL can be so arranged remote from the support. Alternatively, as described in JP-A-56-25738 and JP-A-62-63936, a blue-sensitive layer, GL, RL, GH, and RH can be so arranged remote from the support.

As described in JP-B-49-15495, a layer arrangement can be used such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangement, the light sensitivity decreases towards the support. Even if the layer structure comprises three layers having different light sensitivities, a middle, sensitivity emulsion layer, a high sensitivity emulsion layer and a low sensitivity emulsion layer can be arranged in this order remote from the support in a color-sensitive layer as described in JP-A-59-202464.

As described above, various layer structures and arrangements can be selected depending on the purpose of light-sensitive material.

Any of these layer arrangements can be applied to the color light-sensitive material of the present invention. In the present invention, the dried thickness of all the constituting layers of the color light- sensitive material except for the support, its subbing layer, and the backing layer is preferably in the range of 20.0 μm or less, more preferably 18.0 μm or less, to accomplish the objects of the present invention.

The specification of the dried film thickness is based on the color developing agent to be incorporated into these constituting layers during and after processing. This means that bleach fogging or stain during the storage of images after processing depends greatly on the amount of the remaining color developing agent. In respect to the occurrence of bleach fogging or stain, the increase in magenta color probably due to the green-sensitive layer is greater than that in the cyan and yellow colors.

The lower limit of the specified film thickness is preferably lowered from the above mentioned specification to the extent that the properties of the light-sensitive material do not deteriorate significantly. The lower limit of the total dried thickness of the layers constituting the light-sensitive material except the support and its subbing layer is 12.0 μm. The lower limit of the total dried thickness of the constituting layers provided between the light-sensitive layer nearest to the support and the subbing layer of the support is 1.0 μm. The reduction of the film thickness may be effected in either a light-sensitive layer or a light-insensitive layer.

The film thickness of the multilayer color light-sensitive material of the present invention can be determined in accordance with the following method: A light-sensitive material specimen is stored at a temperature of 25° C. and a relative humidity of 50% for 7 days. The total thickness of the specimen is determined. The coating layers are then removed from the support. The thickness of the support is determined. The difference in the two measurements is the total thickness of the coating layers. The measurement of the film thickness can be accomplished by means of a contact type thickness meter comprising a piezoelectric element (e.g., K-402B Stand, available from Anritsu Electric Co., Ltd.). The removal of the coating layers from the support can be effected by use of an aqueous solution of sodium hypochlorite.

The total thickness of the coating layers on the support can be measured by photographing a section of the specimen under a scanning type electron microscope preferably at 3,000 magnification or more.

The percent swelling of the light-sensitive material of the present invention [determined by {(equilibrium swollen film thickness in water at 25° C.)−(total dried film thickness at 25° C., 55 %RH)}/(total dried film thickness at 25° C., 55 %RH)×100] is preferably in the range of 50 to 200%, more preferably 70 to 150%. If this value deviates from the above specified range, the remaining amount of the color developing agent increases, causing adverse effects on the photographic properties, the desilvering property, and other picture qualities, as well as film physical properties such as film strength.

The swelling rate of the light-sensitive material of the present invention (as determined by $T_{\frac{1}{2}}$, which is defined as the time required to reach half the saturated swollen film thickness (90% of the maximum swollen film thickness in the color developer at a temperature of 38° C., 195 seconds) is preferably in the range of 15 seconds or less, more preferably 9 seconds or less.

The silver halide to be contained in the color light-sensitive material to be used in the present invention may be silver iodobromide, silver iodochlorobromide, silver chlorobromide, silver bromide, and silver chloride. A suitable silver halide to be incorporated in the present color light-sensitive material is silver iodobromide, silver iodochloride, or silver iodochlorobromide containing silver iodide in an amount of about 0.1 to 30 mol %. Particularly suitable is silver iodobromide containing silver iodide in an amount of about 2 mol % to about 25 mol %.

Silver halide grains in the photographic emulsions may be so-called regular grains having a regular crystal form, such as a cube, an octahedron and a tetradecahedron, or those having an irregular crystal form such as a sphere and a tabular form, those having a crystal defect such as a twinning plane, or those having a combination of these crystal forms.

The silver halide grains may be either fine grains of about 0.2 μm or smaller in diameter or larger grains having a projected area diameter of up to about 10 μm. The emulsion may be either a monodisperse emulsion or a polydisperse emulsion.

The preparation of the silver halide photographic emulsion which can be used in the present invention can be accomplished by any suitable method, such as described in *Research Disclosure,* No. 17643 (December, 1978); pp. 22–23, "I. Emulsion Preparation and Types", and No. 18716 (November, 1979); page 648, Glafkides, *Chimie et Physique Photographique,* Paul Montel (1967); G. F. Duffin, *Photographic Emulsion Chemistry,* Focal Press, 1966; and V. L. Zelikman et al., *Making and Coating Photographic Emulsions,* Focal Press, 1964.

Furthermore, monodisperse emulsions as described in U.S. Pat. Nos. 3,574,628 and 3,655,394; and British Patent 1,413,748 are preferably used in the present invention.

Tabular grains having an aspect ratio of about 5 or more can be used in the present invention. The preparation of such tabular grains can be accomplished by any suitable method, such as described in Gutoff, *Photographic Science and Engineering,* vol. 14, pp. 248–257, 1970; U.S. Pat. Nos. 4,434,226, 4,414,310, 4,433,048, and 4,439,520; and British Patent 2,112,157.

The individual silver halide crystals may have either a homogeneous structure or a heterogeneous structure composed of a core and an outer shell differing in halogen composition; or they may have a layered structure. Furthermore, the grains may have fused thereto a silver halide having a different halogen composition or a compound other than silver halide, e.g., silver thiocyanate and lead oxide by an epitaxial junction.

Mixtures of grains having various crystal forms may also be used.

The silver halide emulsion to be used in the present invention is normally subjected to physical ripening, chemical ripening, and spectral sensitization. Additives to be used in these steps are described in *Research Disclosure,* Nos. 17643 (December, 1978), 18716 (November, 1979), and 307105 (November, 1989) as tabulated below.

Known photographic additives which can be used in the present invention are also described in the above cited three references as shown in the following table.

| Kind of additive | RD17643 | RD18716 | RD307105 |
|---|---|---|---|
| 1. Chemical sensitizer | p. 23 right column (RC) | p. 648 | p. 866 |
| 2. Sensitivity increasing agent | | " | |
| 3. Spectral sensitizer and supersensitizer | pp. 23–24 p. 649 RC | p.648 RC- | pp. 866–868 |
| 4. Brightening agent | p. 24 | p. 647 RC | p. 868 |
| 5. Antifoggant and stabilizer | pp. 24–25 | p. 649 RC | pp. 868–870 |
| 6. Light absorbent, filter dye, and ultraviolet absorbent | pp. 25–26 | p. 649 RC–p. 650 left column (LC) | p. 873 |
| 7. Stain inhibitor | p. 25 RC | p. 650 LC-RC | p. 872 |
| 8. Dye image stabilizer | p. 25 | p. 650 LC | " |
| 9. Hardening agent | p. 26 | p. 651 LC | pp. 874–875 |
| 10. Binder | p. 26 | p. 651 LC | pp. 873–874 |
| 11. Plasticizer and lubricant | p. 27 | p. 650 RC | p. 876 |
| 12. Coating aid and surface active agent | pp. 26–27 | " | pp. 875–876 |
| 13. Antistatic agent | p. 27 | " | pp. 876–877 |
| 14. Matting agent | | pp. 878–879 | |

Various color couplers can be used in the present invention. Specific examples of the color couplers are described in the patents described in the above cited *Research Disclosure,* No. 17643, VII-C to G and No. 307105, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649; JP-B-58-10739; British Patents 1,425,020 and 1,476,760; and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630; European Patent 73,636; JP-A-60-33552, JP-A-60- 43659, JP-A61-72238, JP-A-60-35730, JP-A-55-118034, and JP-A-60-185951; RD Nos. 24220 (June, 1984) and 24230 (June, 1984); and WO(PCT)88/04795.

Cyan couplers include naphtholic and phenolic couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,753,871, 4,451,559, 4,427,767, 4,690,889, 4,254,212, and 4,296,199; West German Patent Application (OLS) No. 3,329,729; European Patents 121,365A and 249,453A; and JP-A-61-42658.

Colored couplers for correction of unnecessary absorptions of the developed color preferably include those described in *Research Disclosure,* No. 17643, VII- G; U.S. Pat. Nos. 4,163,670, 4,004,929, and 4,138,258; JP-B-57-39413; and British Patent 1,146,368. Furthermore, couplers for correction of unnecessary absorption of the developed color by a fluorescent dye released upon coupling as described in U.S. Pat. No. 4,774,181 and couplers containing as a coupling off group a dye precursor group capable of reacting with a developing agent to form a dye as described in U.S. Pat. No. 4,777,120, are preferably used.

Couplers which form a dye having moderate diffusibility preferably include those described in U.S. Pat. No. 4,366,237, British Patent 2,125,570, European Patent 96,570, and West German Patent Application (OLS) No. 3,234,533.

Typical examples of polymerized dye-forming couplers are described in U.S. Pat. Nos. 3,451,820, 4,080,211, 4,367,282, 4,409,320, and 4,576,910; and British Patent 2,102,173.

Couplers capable of releasing a photographically useful residue upon coupling can also be used in the present invention. Preferred examples of DIR couplers which release a developing inhibitor are described in the patents cited in RD 17643, VII-F; JP-A-57-151944, JP-A-57-154234, JP-A-60-184248, and JP-A-63-37346; and U.S. Pat. Nos. 4,248,962, and 4,782,012.

Couplers capable of imagewise releasing a nucleating agent or a developing accelerator at the time of development preferably include those described in British Patents 2,097,140 and 2,131,188; and JP-A-59-157638 and JP-A-59-170840.

In addition to the foregoing couplers, the photographic material according to the present invention can further comprise competing couplers as described in U.S. Pat. No. 4,130,427; polyequivalent couplers as described in U.S. Pat. Nos. 4,283,472, 4,338,393, and 4,310,618; DIR redox compounds, DIR couplers, or DIR coupler-releasing couplers as described in JP-A-60-185950 and JP-A-62-24252; couplers capable of releasing a dye which returns to its original color after release as described in European Patent 173,302A; couplers capable of releasing a bleach accelerator as described in RD Nos. 11449 and 24241, and JP-A-61-201247; couplers capable of releasing a ligand as described in U.S. Pat. No. 4,553,477; couplers capable of releasing a leuco dye as-described in JP-A-63-75747; and couplers capable of releasing a fluorescent dye as described in U.S. Pat. No. 4,774,181.

The incorporation of these couplers in the light-sensitive material can be accomplished by any suitable known dispersion method.

Examples of high boiling solvents to be used in the oil-in-water dispersion process are described in U.S. Pat. No. 2,322,027. Specific examples of high boiling organic solvents having a boiling point of 175° C. or higher at normal pressure which can be used in the oil-in-water dispersion process include phthalic esters (e.g., dibutyl phthalate, dicylcohexyl phthalate, di-2-ethylhexyl phthalate, decyl phthalate, bis(2,4-di-t-amylphenyl)phthalate, bis(2,4-di-t-amylphenyl)isophthalate, and bis(1,1-diethylpropyl)phthalate); phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxy ethyl phosphate, trichloropropyl phosphate, and di-2-ethylhexyl phenyl phosphonate); benzoic esters (e.g., 2-ethylhexyl benzoate, dodecyl benzoate, and 2-ethylhexyl-p-hydroxy benzoate); amides (e.g., N,N-diethyldodecanamide, N,N-diethylaurylamide, and N-tetradecylpyrrolidone); alcohols or phenols (e.g., isostearyl alcohol, and 2,4-di-tert-amylphenol); aliphatic carboxylic esters (e.g., bis(2-ethylhexyl)sebacate, dioctyl azerate, glycerol tributylate, isostearyl lactate, trioctyl citrate); aniline derivatives (N,N-dibutyl-2-butoxy-5-tert-octylaniline); and hydrocarbons (e.g., paraffin, dodecylbenzene, and diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of the latex dispersion method and specific examples of latexes to be used in dipping are described in U.S. Pat. No. 4,199,363; and West German Patent Application (OLS) 2,541,274, and 2,541,230.

These couplers can be incorporated in a loadable latex (as disclosed in U.S. Pat. No. 4,203,716) in the presence or absence of the above mentioned high boiling point organic solvent or dissolved in a water-insoluble and organic solvent-soluble polymer before being emulsion-dispersed in an aqueous solution of hydrophilic colloid.

Preferably, single or copolymers as disclosed in International Patent Disclosure WO88/00723, pp. 12–30 are used. In particular, acrylamide polymers can be preferably used with regard to the stabilization of dye images.

The present invention is applicable for various types of color light-sensitive materials, most preferably color negative films for common -use or motion pictures; color reversal films for slides or television; and color papers.

Suitable supports which can be used in the present invention are described in the above cited RD 17643 (page 28) and 18716 (right column on page 647 to left column on page 648).

The process for the processing of the present silver halide color photographic material (hereinafter referred to as "light-sensitive material" as necessary) comprises color development of a light-sensitive material which has been imagewise exposed to light, and then processing of the material with a processing solution having a bleaching ability.

The color developer to be used in the present invention comprises a known aromatic primary amine color developing agent. A preferred example of such a developing agent is a p-phenylenediamine derivative. Typical examples of such a p-phenylenediamine derivative will be set forth below, but the present invention should not be construed as being limited thereto.

D-1: N,N-diethyl-p-phenylenediamine
D-2: 2-Amino-5-diethylaminotoluene
D-3: 2-Amino-5-(N-ethyl-N-laurylamino)toluene
D-4: 4-[N-ethyl-N-(β-hydroxyethyl)amino]aniline
D-5: 2-Methyl-4-[N-ethyl-N-(β-hydroxyethyl-)amino]aniline
D-6: 4-Amino-3-methyl-N-ethyl-N-[β-(methanesulfonamide) ethyl]aniline
D-7: N-(2-amino-5-diethylaminophenylethyl)methane sulfonamide
D-8: N,N-dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline D-11: 4-Amino-3-methyl-N-ethyl-N-β-butoxyethylaniline Particularly preferred among these p- phenylenediamine derivatives is D-5.

These p-phenylenediamine derivatives may be in the form of a salt such as sulfate, hydrochloride, sulfite, and p-toluenesulfonate. The amount of the aromatic primary amine color developing agent to be used is preferably in the range of 0.001 to 0.1 mol, more preferably 0.01 to 0.06 mol, per liter of color developer.

The color developer may comprise as preservatives sulfites such as sodium sulfite, potassium sulfite, sodium bisulfite, potassium bisulfite, sodium metasulfite, and potassium metasulfite; or carbonyl- sulfurous acid adducts as necessary.

The amount of such a preservative to be incorporated is preferably in the range of 0.5 to 10 g, more preferably 1 to 5 g, per liter of color developer.

Examples of compounds which can be preferably used to directly preserve the above mentioned aromatic primary amine color developing agent include various hydroxylamines (e.g., compounds as disclosed in JP-A-63-5341 and JP-A-63-106655, particularly compounds containing a sulfo group or a carboxyl group), hydroxamic acids (as disclosed in JP-A-63-43138), hydrazines and hydrazides (as disclosed in JP-A-63-146041), phenols (as disclosed in JP-A-63-44657 and JP-A-63-58443), α-hydroxyketones and α-aminoketones (as disclosed in JP-A-63-44656), and various saccharides (as disclosed in JP-A-63-36244). Examples of compounds which can be preferably used in combination with these compounds include monoamines as disclosed in JP-A-63-4235, JP-A-63-24254, JP-A-63-21647, JP-A-63-146040, JP-A-63-27841, and JP-A-63-25654; dimaines as disclosed in JP-A-30845, JP-A-63-14640, and JP-A-63-43139; polyamines as disclosed in JP-A-63-21647, JP-A-63-26655, and JP-A-63-44655; nitroxy radicals as disclosed in JP-A-63-53551; alcohols as disclosed in JP-A-63-43140 and JP-A-63-53549; oxims as disclosed in JP-A-63-56654; and tertiary amines as disclosed in JP-A-63-239447.

Other examples of compounds which can be used as preservatives include various metals as disclosed in JP-A-57-44148 and 57-53749; salicylic acids as disclosed in JP-A-59-180588; alkanolamines as disclosed in JP-A-54-3582; polyethylenimines as disclosed in JP-A-56-94349; and aromatic polyhydroxy compounds as disclosed in U.S. Pat. No. 3,746,544. Particularly preferred among these compounds are aromatic polyhydroxy compounds.

The color developer to be used in the present invention preferably exhibits a pH value of 9 to 12, more preferably 9 to 11.0. The present color developer may further comprise known developer components.

In order to maintain the pH range, various buffers may be preferably used.

Specific examples of such buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5- sulfosalicylate). However, the present invention is not limited to these compounds.

The amount of the buffer to be incorporated in the color developer is preferably in the range of 0.1 mol/l or more, particularly 0.1 to 0.4 mol/l.

The color developer may further comprise various chelating agents as precipitation inhibiting agents or to improve the stability thereof.

As such chelating agents there can be preferably used organic acid compounds such as aminopolycarboxylic acid, organic phosphonic acid, and phosphonocarboxylic acid. Typical examples of these organic acid compounds include nitrilotriacetic acid; diethylenetriaminepentaacetic acid; ethylenedimainetetraacetic acid; N,N,N-trimethylenephosphonic acid; ethylenediamine-N,N,N',N'-tetramethylenephosphonicacid; transcyclohexanediaminetetraacetic acid; 1,2-diaminopropanetetraacetic acid; hydroxyethyliminodiacetic acid; glycoletherdiaminetetraacetic acid; ethylenediamineorthohydroxyphenylacetic acid; 2-phosphonobutane-1,2,4-tricarboxylicacid;1-hydroxyethylidene-1,1-diphosphonic acid; and N,N'-bis(2- hydroxybenzyl)ethylenediamine-N,N'-diacetic acid. Two or more of these chelating agents can be used in combination as necessary. The amount of the chelating agent incoporated in the color developer is sufficient if it is enough to block metallic ions in the color developer, e.g., 0.1 to 10 g/l.

The color developer may comprise any development accelerator, as necessary. However, the color developer to be used in the present invention is preferably substantially free of benzyl alcohol in view of environmental protection, easiness of preparation thereof, and inhibition of color stain. Specifically, this means that the color developer contains benzyl alcohol in an amount of 2 ml or less per liter, and preferably none.

Other examples of development accelerators which can be used as necessary include thioether compounds (as disclosed in JP-B-37-16088, JP-B-37-5987, JP-B-38-7826, JP-B-44-12380, and JP-B-45-9019; and U.S. Pat. No. 3,818,247), p-phenylenediamine compounds (as disclosed in JP-A-52-49829 and JP-A-50-15554), quaternary ammonium salts (as disclosed in JP-A-50-137726, JP-A-56-156826, and JP-A-52-43429; and JP-B-44-30074), amine compounds (as disclosed in U.S. Pat. Nos. 2,494,903, 3,128,182, 4,230,796, 3,253,919, 2,482,546, 2,596,926, and 3,582,346; and JP-B-41-11431), polyalkylene oxides as disclosed in JP-B-37-16088, JP-B-42-25201, JP-B-41-11431, and JP-B-42-23883, and U.S. Pat. Nos. 3,128,183, and 3,532,501), 1-phenyl-3-pyrazolidones, and imidazoles.

In the present invention, any fog inhibitors can be used as necessary. As such fog inhibitors there can be used halides of alkaline metal such as sodium chloride, potassium bromide and potassium iodide, and organic fog inhibitors. Typical examples of such fog inhibitors include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolidine, and adenine.

The color developer to be used in the present invention may comprise fluorescent brightening agents. Preferred examples of such fluorescent brightening agents include 4,4'-diamino-2,2'-disulfostilbene compounds. The amount of such a fluorescent brightening agent to be incorporated in the color developer is in the range of 0 to 5 g/l, preferably 0.1 to 4 g/l.

The color developer to be used in the present invention may further comprise various surface active agents such as alkylsulfonic acid, arylsulfonic acid, aliphatic carboxylic acid, and aromatic carboxylic acid, as necessary.

The temperature at which the processing is effected with the present color developer is in the range of 20 to 50° C., preferably 30° to 45° C. The processing time is in the range of 20 seconds to 5 minutes, preferably 30 seconds to 200 seconds, more preferably 60 seconds to 150 seconds.

The color developing bath may be divided into two or more baths wherein a color developer replenisher is supplied from the foremost bath or last bath to reduce the developing time or the replenishment rate.

The processing method of the present invention can be used for color reversal processing. As a black-and-white developer to be used in this process there can be used a well known first black-and-white developer used for reversal processing of color light-sensitive materials. Such a black-and-white developer may comprise various well known additives to be incorporated in black-and-white developers for use in the processing of black-and-white silver halide light-sensitive materials.

Typical examples of such additives include developing agents such as 1-phenyl-3-pyrazolidone, Metol (p-methylaminophenol sulfate) and hydroquinone; preservatives such as sulfite; acclerators comprising an alkali such as sodium hydroxide, sodium carbonate, and potassium carbonate; inorganic or organic inhibitors such as potassium bromide, 2-methylbenzimidazole and methylbenzthiazole, hard water softeners such as polyphosphoric acid, and development inhibitors comprising a slight amount of iodide or a mercapto compound.

When the processing is effected with the above mentioned developer by means of an automatic developing machine, the area of the developer in contact with air (opening area) is preferably as small as possible. Assuming that the percent opening ($cm^{-1}$) is obtained by dividing the opening area ($cm^2$) by the volume of the developer ($cm^3$), the percent opening is preferably in the range of 0.01 to 0.001, more preferably 0.05 or less.

In order to make up for the concentration of the developer caused by evaporation, water is preferably added to the developer in an amount corresponding to the amount lost by evaporation.

The present invention is also effective for the regeneration of the developer.

In the regeneration of the developer, the developer used is subjected to anionic exchange or electrodialysis or activation with a processing chemical called a regenerant so that it can be used again as a processing solution.

In this case, the percent regeneration (proportion of overflow solution in the replenisher) is preferably 50% or more, more preferably 70% or more.

An anion exchange resin is preferably used to effect the regeneration of the developer. Particularly preferred examples of formulation and regeneration using an anion exchange resin include those disclosed in "DIAION Manual (I)", vol. 14, Mitsubishi Chemical Industries Ltd.

As anion exchange resins there can be preferably used resins having formulations as disclosed in JP-A-2-952 (corresponding to U.S. Pat. No. 4,948,711) and JP-A-1-281152.

In the regeneration of the developer, the overflow solution from the developer may be regenerated as replenisher. Alternatively, a continuous regenerating process may be employed to continuously keep the processing solution in the developing tank in contact with ion exchange resins or the like.

In the present invention, the light-sensitive material which has been color-developed is then processed with a processing solution having a bleaching ability. The term "processing solution having a bleaching ability" as used herein means a bleaching solution or blix solution.

Typical examples of a desilvering process comprising a processing with such a processing solution include:

i. Bleach→fixing
ii. Bleach→blix
iii. Bleach→rinse→fixing
iv. Rinse→bleach→fixing
v. Bleach→blix→fixing
vi. Rinse→blix
vii. Blix
viii. Fixing→blix Particularly preferred among these processes are processes i, ii and v. The process ii is disclosed, for example, in, JP-A-61-75352.

A processing bath such as a bleaching bath and a fixing bath which can be used in these processes may consist of one tank or two or more tanks (e.g., 2 to 4 tanks). In a processing bath consisting of two or more tanks, a countercurrent process is preferably used.

In the present method processing, the color development process is preferably immediately followed by a desilvering process with a processing solution having a bleaching ability. Such a processing solution having a bleaching ability is preferably a bleaching solution. The effects of the present invention can be remarkably accomplished using such a method.

Examples of oxidizers incorporated as main components in the processing solution having a bleaching ability include inorganic compounds such as red prussiate, ferric chloride, dichromate, persulfate and bromate, and partially organic compounds of ferric complexs of aminopolycarboxylic acid.

In the present invention, ferric complexes of aminopolycarboxylic acid are preferably used in view of environmental protection, safety in handling, inhibition of metal corrosion, for example.

Specific examples of ferric complexes of aminopolycarboxylic acid will be set forth below with their redox potential, but the present invention should not be construed as being limited thereto.

| No. | Compound | Redox potential (mV vs. N.H.E., pH = 6) |
|---|---|---|
| 1. | Ferric complex of N-(2-acetamide) iminodiacetate | 180 |
| 2. | Ferric complex of methyliminodiacetate | 200 |
| 3. | Ferric complex of iminodiacetate | 210 |
| 4. | Ferric complex of 1,4-butylenediaminetetraacetate | 230 |
| 5. | Ferric complex of diethylenethioetherdiaminetetraacetate | 230 |
| 6. | Ferric complex of glycoletherdiaminetetraacetate | 240 |
| 7. | Ferric complex of 1,3-propylenediaminettraacetate | 250 |
| 8. | Ferric complex of ethylenediaminetetraacetate | 110 |
| 9. | Ferric complex of diethylenetriaminepentaacetate | 80 |
| 10. | Ferric complex of trans-1,2- | 80 |

-continued

| No. | Compound | Redox potential (mV vs. N.H.E., pH = 6) |
|---|---|---|
| | cyclohexanediaminetetraacetate | |

In the present invention, there may be preferably used oxidizers having a redox potential of 150 mV or higher, more preferably 180 mV or higher, most preferably 200 mV or higher (hereinafter referred to as a "high potential oxidizer") to expedite the processing and effectively accomplish the effects of the present invention.

The redox potential of an oxidizer as used herein is defined as the redox potential measured by the method disclosed in *Transactions of the Faraday Society,* vol. 55, 1959, pp. 1312–1313.

The measurement of the redox potential is effected at a pH value of 6.0. The pH value of around 6 provides an easy measure of the generation of bleach fogging. Specifically, when the light-sensitive material which has been color-developed is dipped in the solution having a bleaching ability, the pH value of the film in the light-sensitive material is lowered. If the reduction rate in the pH value is high, little bleach fogging occurs. If the reduction rate in the pH value is low and the processing solution having a bleaching ability exhibits a high pH value, bleach fogging occurs vigorously.

Particularly preferred among these oxidizers is Compound No. 7 (ferric complex of 1,3-propylenediaminetetraacetate, hereinafter referred to as "1,3-PDTA.Fe(III)")(same compound as ferric complex of 1,3-diaminopropanetetraacetate disclosed in JP-A-62-222252 and JP-A-64-24253).

The ferric complex of aminopolycarboxylic acid is used in the form of a sodium, potassium or ammonium salt, most preferably an ammonium salt in view of bleaching speed.

The amount of the oxider to be incorporated in the processing solution having a bleaching ability is preferably in the range of 0.17 mol/l or more, more preferably 0.25 mol/l or more, particularly 0.30 mol/l or more in view of expeditious processing or elimination of bleach fogging or stain. However, since the use of excessive amounts of oxidizer rather inhibits the bleaching reaction, the upper limit of the amount of oxidizer is preferably about 0.7 mol/l.

In the present invention, a single oxidizer may be used or two or more oxidizers may be used in combination.

If two or more oxidizers are used in combination, the total amount of these oxidizers should be controlled in the above specified concentration range.

If the processing solution having a bleaching ability comprises a ferric complex of aminopolycarboxylic acid, the complex may be incorporated in the form of the above mentioned complex. Alternatively, the complexing compounds, i.e., an aminopolycarboxylic acid and a ferric salt (e.g., ferric sulfate, ferric chloride, ferric nitrate, ferric ammonium sulfate, ferric phosphate) may be allowed to be present in the processing solution so that they form a complex.

In the latter case, the aminopolycarboxylic acid may be used in an amount slightly exceeding that required to form a complex with ferric ion. If the aminopolycarboxylic acid is used excessively, the amount of excess is preferably in the range of 0.01 to 10%.

The above mentioned processing solution having a bleaching ability is normally used at a pH value of 2 to 8. In order to expedite the processing, the pH value is in the range of 2.5 to 4.2, preferably 2.5 to 4.0, most preferably 2.5 to 3.5. The replenisher of the processing solution is used at a pH value of 1.0 to 4.0.

In the present invention, the adjustment of the pH value to the above specified range can be accomplished with known acids.

As such acids there can be used acids with a pKa value of 2 to 5.5. In the present invention, pKa represents the logarithm of the reciprocal of the acid dissociation constant as determined at an ionic strength of 0.1 and a temperature of 25° C.

In the present invention, the processing solution having a bleaching ability preferably comprises an acid having a pKa of 2 to 5.5 in an amount of 0.2 mol/liter or more, particularly 0.5 mol/liter or more and 5 mol/liter or less.

In the present invention, a processing solution with a bleaching ability containing 1.2 mol/l or more of an acid having a pKa value of 2.0 to 5.5 can be used in the desilvering process to eliminate bleach fogging and increase of stain on noncolored portions after processing.

Examples of acids with a pKa value of 2.0 to 5.5 are inorganic acids such as phosphoric acid or organic acids such as acetic acid, malonic acid, and citric acid. An organic acid with a pKa value of 2.0 to 5.5 can effectively be used to bring about the above mentioned improvements. In particular, an organic acid containing a carboxyl group is preferably used.

An organic acid with a pKa value of 2.0 to 5.5 may be either a monobasic acid or a polybasic acid. In the case of a polybasic acid, if its pKa value is in the above specified range, i.e., 2.0 to 5.5, it can be used in the form of a metallic salt (e.g., sodium salt, potassium salt) or an ammonium salt. Two or more organic acids with a pKa value of 2.0 to 5.5 can be used in admixture. However, examples of such an acid exclude aminopolycarboxylic acid and its ferric complex salt.

Specific examples of an organic acid with a pKa value of 2.0 to 5.5 which can be used in the present invention include aliphatic monobasic acids (such as formic acid, acetic acid, monochloroacetic acid, monobromoacetic acid, glycolic acid, propionic acid, monochloropropionic acid, lactic acid, pyruvic acid, acrylic acid, butyric acid, isobutyric acid, pivalic acid, aminobutyric acid, valeric acid, and isovaleric acid), amino acid compounds (such as asparagine, alanine, arginine, ethionine, glycine, glutamine, cystein, serine, methionine, and leucine), benzoic acid, mono-substituted benzoic acids (such as chlorobenzoic acid and hydroxybenzoic acid), aromatic monobasic acids (such as nicotinic acid), aliphatic dibasic acids (such as oxalic acid, malonic acid, succinic acid, tartaric acid, malic acid, maleic acid, fumaric acid, oxalacetic acid, glutaric acid, and adipic acid), dibasic amino acids (such as asparatic acid, glutamic acid, glutaric acid, cystine, and ascorbic acid), aromatic dibasic acids (such as phthalic acid, and terephthalic acid), and polybasic acids (such as citric acid).

Preferred among these organic acids are monobasic acids containing carboxyl groups. In particular, acetic acid and glycolic acid are preferably used in the present invention.

When the pH value of the processing solution having a bleaching ability is adjusted to the above specified range, these acids may be used in combination with an alkaline agent (e.g., aqueous ammonia, KOH, NaOH, imidazole, monoethanolamine, and diethanolamine). Particularly preferred among these alkaline agents is aqueous ammonia. As an alkaline agent to be used as a bleach starter in the adjustment of the running solution of the processing solution having a bleaching ability from its replenisher there are preferably used imidazole, monoethanolamine, or diethanolamine.

In the present invention, the processing solution having a bleaching ability or its prebath may contain various bleach accelerators. Examples of such bleach accelerators include compounds containing a mercapto group or a disulfide group (as disclosed in U.S. Pat. No. 3,893,858, German Patent 1,290,821, British Patent 1,138,842, JP-A-53-95630, and *Research Disclosure*, No. 17129 (July, 1978)), thiazolidine derivatives (as disclosed in JP-A-50-140129), thiourea derivatives (as disclosed in U.S. Pat. No. 3,706,561), iodides (as disclosed in JP-A-58-16235), polyethylene oxides (as disclosed in German Patent 2,748,430), and polyamines (as disclosed in JP-B-45-8836). In particular, mercapto compounds (as disclosed in British Patent 1,138,842 and JP-A-2-190856) are preferably used.

The solution having a bleaching ability to be used in the present invention can comprise, besides oxidizers (bleaching agent) and the above mentioned compounds, a rehalogenating agent such as bromide (e.g., potassium bromide, sodium bromide, and ammonium bromide) and chloride (e.g., potassium chloride, sodium chloride, and ammonium chloride). The concentration of the rehalogenating agent in the processing solution is in the range of 0.1 to 5 mol/l, preferably 0.5 to 3 mol/l.

As a metal corrosion inhibitor there is preferably used ammonium nitrate.

In the present invention, a replenishment process is preferably employed. The replenishment rate of the bleaching solution is in the range of 200 ml or less, preferably 10 to 140 ml per $m^2$ of light-sensitive material.

The bleaching time is in the range of 120 seconds or less, preferably 50 seconds or less, more preferably 40 seconds or less. When the processing time is thus reduced, the present invention can be effective.

In the processing, the processing solution comprising a ferric complex of aminopolycarboxylic acid and having a bleaching ability is preferably subjected to aeration so that the ferrous complex of aminopolycarboxylic acid thus produced is oxidized. Thus, the oxidizer can be regenerated, enabling the maintenance of extremely stable photographic properties.

In the processing step using the processing solution having a bleaching ability, water is preferably supplied in an amount corresponding to the evaporation loss of the processing solution. That is, a so-called correction for evaporation is preferably effected, particularly when using a processing solution containing a high potential oxidizer.

Specific methods for the replenishment of water are not specifically limited and include the following methods (1) to (4):

(1) A method which comprises determining the evaporation loss in a water monitoring tank provided separately from the bleaching bath, calculating the evaporation loss in the bleaching bath from the value thus determined, and then supplying water into the bleaching bath in proportion to the value thus calculated (see JP-A-1-254959 and JP-A-1-254960). The replenishment of water is preferably effected using a predetermined amount.

(2) A method which comprises replenishing water in a predetermined amount whenever the specific gravity of the bleaching solution as controlled in the bleaching bath exceeds a predetermined value.

(3) A method which comprises replenishing water whenever the liquid level of the bleaching solution in the bleaching bath falls below a predetermined value due to evaporation.

(4) A method which comprises replenishing water in an amount corresponding to an estimate of the evaporation loss obtained from the conditions of the processing machine and environmental conditions.

These methods may be effected one or several times a day.

Preferred among methods (1) to (4) are methods (3) and (4), which enable an effective prevention of the change in the formulation of the processing solution by means of a simple arrangement.

In the case of method (3), the liquid level of the processing solution is preferably sensed by a level sensor, by which water is returned to the processing solution tank whenever the liquid level is lowered to a predetermined value.

In the present invention, the bath having a bleaching ability, preferably has a potassium ion concentration of 0.13 to 0.8 gram ion/l, more preferably 0.18 gram ion/l or more, particularly 0.22 gram ion/l or more.

The value of the concentration of potassium ions in the bath for the processing solution having a bleaching ability is determined by summing the potassium ions from the color developer carried over by the light-sensitive material, the potassium ions contained in the replenisher for the processing solution having a bleaching ability, and the potassium ions eluted from the light-sensitive material.

In normal processing, the light-sensitive material brings color developer from the color developing bath at a rate of 1.5 to 5.0 ml/35 mm width-1.1 m length. The light-sensitive material which has been subjected to color development is immediately introduced into a bath having a bleaching ability where it is processed. Accordingly, substantially all of the color developer brought over from the color developing bath is carried over to the bath having a bleaching ability. Therefore, as the continuous processing in an automatic developing machine proceeds, the color developer components are accumulated. If the replenishment rate is low, the amount of the color developer components thus accumulated increases. The overflow solution from the bath for the processing solution having bleaching ability may be regenerated and recycled as replenisher. However, even such a regeneration process can only be accomplished by oxidation and regeneration of the bleaching agent and replenishment of the above mentioned various additives required for the maintenance of bleaching ability without substantial removal of the carried over color developer components. Therefore, the accumulated amount of the color developer components is determined by the amount of the concentrated replenisher to the bleaching bath.

Preferably, the supply of potassium ions into the processing bath for the processing solution having a bleaching ability is mainly from the color developer brought over by the light-sensitive material in view of effectiveness.

The color developer component concentration in the processing bath for the processing solution having a bleaching ability is preferably in the range of 30 to 150%, more preferably 40 to 100%, particularly 50 to 100%.

The light-sensitive material which has been subjected to bleach with the solution having a bleaching ability of the invention is then processed with a processing solution having a fixing ability. If the processing with the solution having a bleaching ability is effected with a blix solution, it may or may not be followed by processing with a fixing ability.

The term "processing solution having a fixing ability" as used herein means a "fixing solution" or "blix solution".

The processing solution having a fixing ability contains a fixing agent.

Examples of fixing agents which can be used in the present invention include thiosulfates such as sodium thiosulfate, ammonium thiosulfate, ammonium sodium thiosulfate, and potassium thiosulfate; thiocyanates (rhodanates) such as sodium thiocyanate, ammonium thiocyanate, and potassium thiocyanate; thioureas; and thioethers. Particularly preferred among these fixing agents is ammonium thiosulfate. The amount of the fixing agent to be incorporated in the fixing solution or blix solution is in the range of 0.3 to 3 mol/l, preferably 0.5 to 2 mol/l.

The processing solution having a bleaching ability may preferably further comprise the above mentioned ammonium thiocyanate, imidazole, thiourea, or thioether (e.g., 3,6-dithia-1,8-octanediol) in view of accelerating the bleaching. In particular, imidazole compounds as disclosed in JP-A-49-40943 are preferably used. The amount of such compounds used is in the range of 0.01 to 1.0 mol, preferably 0.1 to 0.5 mol, per liter of fixing solution or blix solution. If the amount of such compounds used is in the range of 1 to 3 mol/l, the effect of accelerating fixing is drastically enhanced.

As fixing agents incorporated in the fixing solution or blix solution there are preferably used thiosulfate and thiocyanate in combination to expedite processing. In this case, the amount of thiosulfate used is in the above specified range, i.e., 0.3 to 3 mol/l, and the amount of thiocyanate used is in the range of 1 to 3 mol/l, preferably 1 to 2.5 mol/l.

In particular, ammonium thiosulfate and ammonium thiocyanate are preferably used in combination.

Examples of compounds other than thiocyanate which can be used in combination with thiosulfate (particularly ammonium thiosulfate) include thiourea, and thioether (e.g., 3,6-dithia-1,8-octanediol). The amount of such a compound used is normally in the range of 0.01 to 0.1 mol, optionally 1 to 3, mol per liter of fixing solution or blix solution.

The fixing solution or blix solution may comprise sulfites (e.g., sodium sulfite, potassium sulfite, and ammonium sulfite) and bisulfite adducts of hydroxylamine, hydrazine and aldehyde compounds (e.g., sodium acetaldehydebisulfite, and most preferably sodium benzaldehyde-o-sulfonic acid and sodium benzaldehyde-p-carboxylic acid) as preservatives. The fixing solution or blix solution may further comprise various fluorescent brightening agents; anti-foaming agents or surface active agents; or organic solvents such as polyvinyl pyrrolidone and methanol. Particularly preferred preservatives are sulfinic acid compounds such as disclosed in EP 294769.

The blix solution may comprise compounds which can be incorporated in the above mentioned bleaching solution.

The present processing solution having a fixing ability can be subjected to a known silver recovery method to produce a regenerated processing solution which can be used later. Examples of effective silver recovery methods include electrolysis methods (as disclosed in French Patent 2,299,667), sedimentation methods (as disclosed in JP-A-52-73037 and German Patent 2,331,220), ion exchange methods (as disclosed in JP-A-51-17114 and German Patent 2,548,237), and metal substitution methods (as disclosed in British Patent 1,353,805). These silver recovery methods may be advantageously effected in line with the tank solution to improve its adaptability for rapid processing.

As in the above mentioned bleach process, the blix solution is preferably replenished with water at a rate corresponding to the evaporation loss.

The amount of bleaching agent incorporated in the blix solution is in the range of 0.01 to 0.5 mol/l, preferably 0.015 to 0.3 mol/l, and most preferably 0.02 to 0.2 mol/l.

In the present invention, the preparation of a blix solution which is ready for processing (running solution) can be accomplished by dissolving the above mentioned compounds to be incorporated in the blix solution in water. Alternatively, a bleaching solution and a fixing solution which have been separately prepared may be mixed in proper proportions to prepare the desired blix solution. The pH value of the fixing solution is preferably in the range of 5 to 9, more preferably 7 to 8. The pH value of the blix solution is preferably in the range of 6 to 8.5, more preferably 6.5 to 8.0.

If the replenishment process is employed, the replenishment rate of the fixing solution or blix solution is preferably in the range of 300 to 3,000 ml, more preferably 300 to 1,000 ml per $m^2$ of light-sensitive material.

The fixing solution and blix solution may further comprise various aminopolycarboxylic acids or organic phosphonic acids for the purpose of stabilizing the processing solution. Preferred examples of such compounds include 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethylenetriaminepentaacetic acid, cyclohexanediaminetetraacetic acid, and 1,2- propylenediaminetetraacetic acid. Particularly preferred among these compounds are 1-hydroxyethylidene-1,1-diphosphonic acid, and ethylenediaminetetraacetic acid.

In the present invention, the total time of processing using steps with solutions having a fixing ability is preferably in the range of 0.5 to 2 minutes, particularly 0.5 to 1 minute.

The shorter the total time of desilvering steps is, the more remarkable are the effects of the present invention. The total time of desilvering steps is preferably in the range of 1 to 4 minutes, more preferably 90 seconds to 3 minutes. The processing temperature is in the range of 25° to 50° C., preferably 35° to 45° C. In this preferred processing temperature range, the desilvering rate can be enhanced, and the occurrence of stain after processing can be effectively inhibited.

The present invention can be applied to a desilvering process preceded by, e.g., stop bath and rinse bath, after color development.

In the present desilvering steps such as the bleaching, blixing and, the fixing steps, the agitation is preferably intensified as much as possible to accomplish the effects of the present invention more effectively.

In particular, the agitation can be intensified by various methods. For example, the processing solution may be jetted to the surface of the emulsion layer in the light-sensitive material as described in JP-A-62-183460 and JP-A-62-183461. The agitating effect can be improved by a rotary means as described in JP-A-62-183461. Furthermore, the agitating effect can be improved by moving the light- sensitive material with the emulsion surface in contact with a wiper blade provided in the bath so that a turbulence occurs on the emulsion surface. Moreover, the agitation can be intensified by increasing the total circulated amount of processing solution.

The above mentioned agitation improving method is more effective when a bleach accelerator is used. In this case, the agitation improving method can remarkably enhance the bleach accelerating effect or eliminate the effect of fixation inhibition caused by the bleach accelerator.

The above mentioned intensified agitation can be employed in the color developer, washing solution, or stabilizing solution.

In the present invention, an automatic developing machine is normally used to effect continuous processing. The automatic developing machine used with the present invention is preferably equipped with a light-sensitive material conveying means as described in JP-A-60-191257, JP-A-60-191258, and JP-A- 60-191259. As described in JP-A-60-191257, such a conveying means can remarkably reduce the amount of processing solution carried over from one bath to the succeeding bath, and thus significantly reduce the deterioration of the properties of the processing solution. Such an effect is particularly effective for the reduction of processing time at each step or the replenishment rate of the processing solution.

In the present processing method, the processing step using a processing solution having a fixing ability is normally followed by a washing step and a stabilizing step. However, a simple processing method may be used wherein the processing step with a solution having fixing ability is followed by processing with a stabilizing solution without substantially subjecting the photographic material to a washing step.

The washing water used in the washing step may comprise various surface active agents to inhibit nonuniformity caused by water drips during drying of the light-sensitive material after processing. Examples of these surface active agents include polyethylene glycol nonionic surface active agents, polyvalent alcohol nonionic surface active agents, alkylbenzenesulfonate anionic surface active agents, higher alcohol sulfuric ester anionic surface active agents, alkylnaphthalenesulfonate anionic surface active agents, quaternary ammonium salt cationic surface active agents, amine salt cationic surface active agents, amino acid amphoteric surface active agents, and betaine amphoteric surface active agents. Since ionic surface active agents may be bonded to various ions which have entered the system during processing to produce insoluble matters, nonionic surface active agents are preferably used. In particular, alkylphenol-ethylene oxide adducts are used. The most preferably alkylphenols are octyl, nonyl, dodecyl, and dinonylphenol. The molar amount of the ethylene oxide to be added is most preferably in the range of 8 to 14. Furthermore, silicone surface active agents which exhibit a high anti-foaming effect are preferably used.

The washing solution may contain various antibacterial agents or antifungal agents to inhibit the occurrence of fur and mold on the light-sensitive material after processing. Examples of such antibacterial agents and antifungal agents include thiazolylbenzimidazole compounds as disclosed in JP-A-57-157244 and JP-A-58-105145), isothiazolone compounds (as disclosed in JP-A-54-27424 and JP-A-57-8542), chlorophenol compounds (such as trichlorophenol, bromopenol compounds), organic tin or zinc compounds, thiocyanic or isothiocyanic compounds, acid amide compounds, diazine or triazine compounds, thiourea compounds, benzotriazole alkyl guanidine compounds, quaternary ammonium salts (such as benzalkonium chloride), antibiotics (such as penicillin), and general purpose antifungal agents (as described in the *Journal Antibacteria And Antifungas Agents,* vol. 1, No. 5, pp. 207–223, 1983). These compounds may be used singly or in combination.

Alternatively, various germicides such as those disclosed in JP-A-48-83820 may be used.

The washing solution preferably contains various chelating agents.

Preferred examples of such a chelating agent include aminopolycarboxylic acids (such as ethylenediaminetetraacetic acid and diethylenetriaminepentaacetic acid), organic phosphonic acids (such as 1-hydroxyethylidene-1,1-diphosphonic acid and ethylenediamine-N,N,N',N'-tetramethylenephosphonic acid), and hydrolyzates of anhydrous maleic polymer (as disclosed in European Patent 345172A).

Furthermore, the washing solution preferably contains preservatives which can be incorporated in the above mentioned fixing solution or blix solution.

A stabilizing solution that can be used in the stabilizing step is a processing solution for stabilizing dye images. For example, organic acids; solutions capable of buffering at a pH value of 3 to 6; solutions containing an aldehyde (e.g., formalin, glutaraldehyde); can be used. The stabilizing solution may contain all the compounds which can be incorporated in the washing solution. The stabilizing solution may further contain ammonium compounds (such as ammonium chloride and ammonium sulfite), metal compounds (such as Bi and Al), fluorescent brightening agents, various dye stabilizers (such as N-methylol compounds as disclosed in JP-A-2-153350 and JP-A-2-153348, and U.S. Pat. No. 4,859,574), film hardeners, and alkanolamines (as disclosed in U.S. Pat. No. 4,786,583). Known stabilizing methods can be used with these dye stabilizers.

The present washing step or stabilizing step may be effected in a multi-stage countercurrent process. The number of stages is preferably 2 to 4. The replenishment rate is in the range of 1 to 50 times, preferably 2 to 30 times, more preferably 2 to 15 times the amount carried over from the prebath per unit area.

Water preferable for use in the washing step or stabilizing step, besides tap water, is deionized water obtained by deionizing water with an ion exchange resin or the like so that the concentration of Ca and Mg is 5 mg/l or less, or sterilized water sterilized by a halogen or ultraviolet germicidal lamp.

Water for replenishment of the evaporation loss is tap water, and preferably is deionized water as described above for use in the washing step or stabilizing step.

In the present invention, a proper amount of water, correcting liquid, or processing replenisher is preferably supplied not only to the bleaching solution or blix solution but also to other processing solutions to make up for evaporative loss.

The overflow solution from the washing step or stabilizing step is advantageously introduced into its prebath having a fixing ability to reduce the amount of waste liquid.

The effects of the present invention are particularly remarkable when the total processing time (except drying time) is short. Specifically, when the total processing time is 8 minutes or less, the effects of the present invention can be accomplished definitely. When the total processing time is 7 minutes or less, the present processing process differs from the prior art processing process more definitely. Therefore, the total processing time is preferably 8 minutes or less, particularly 7 minutes or less in the present invention.

The present invention will be further described in the following examples, but the present invention should not be construed as being limited thereto.

EXAMPLE 1

A multilayer color light-sensitive material was prepared as Specimen 101 by coating on a undercoated cellulose triacetate film support various layers having the following compositions.

Composition of Light-Sensitive Layer

The coated amount of silver halide and colloidal silver is represented in g/m$^2$ as calculated in terms of the amount of silver. The coated amount of coupler, additive, and gelatin is represented in g/m$^2$. The coated amount of sensitizing dye is represented in mol per mol of silver halide contained in the same layer.

| | |
|---|---|
| 1st Layer (anti-halation layer) | |
| Black colloidal silver | 0.15 |
| Gelatin | 1.50 |
| ExM-8 | 0.02 |
| 2nd Layer (interlayer) | |
| Gelatin | 1.50 |
| UV-1 | 0.03 |
| UV-2 | 0.06 |
| UV-3 | 0.07 |
| ExF-1 | 0.004 |
| Solv-2 | 0.07 |
| 3rd layer (low sensitivity red-sensitive emulsion layer) | |
| Silver iodobromide emulsion (AgI content: 2 mol %; internal high AgI type; diameter: 0.3 μm as calculatd in terms of a sphere; coefficient of variation in grain diameter: 29% as calculated in terms of a sphere; mixture of regular crystals and twin crystals; diameter/thickness ratio: 2.5) | 0.50 |
| Gelatin | 1.00 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.22 |
| ExC-4 | 0.035 |
| Solv-1 | 0.007 |
| 4th Layer (middle sensitivity red-sensitive emulsion layer) | |
| Silver iodobromide emulsion (AgI content: 4 mol %; internal high AgI type; diameter: 0.55 μm as calculated in terms of a sphere; coefficient of variation in grain diameter: 20% as calculated in terms of a sphere; mixture of regular crystals and twin crystals; diameter/thickness ratio: 1) | 0.85 |

-continued

| | |
|---|---|
| Gelatin | 1.26 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.33 |
| ExY-14 | 0.01 |
| ExY-13 | 0.02 |
| ExC-2 | 0.08 |
| Cpd-10 | $1.0 \times 10^{-4}$ |
| Solv-1 | 0.10 |
| 5th Layer (high sensitivity red-sensitive emulsion layer) | |
| Silver iodobromide emulsion (AgI content: 10 mol %; internal high AgI type; diameter: 0.7 μm as calculated in terms of a sphere; coefficient of variation in grain diameter: 30% as calculated in terms of a sphere; mixture of regular crystals and twin crystals; diameter/thickness ratio: 2) | 0.70 |
| Gelatin | 1.00 |
| ExS-1 | $1.0 \times 10^{-4}$ |
| ExS-2 | $3.0 \times 10^{-4}$ |
| ExS-3 | $1.0 \times 10^{-5}$ |
| ExC-5 | 0.07 |
| ExC-6 | 0.08 |
| Solv-1 | 0.15 |
| Solv-2 | 0.08 |
| 6th Layer (interlayer) | |
| Gelatin | 1.00 |
| P-2 | 0.17 |
| Cpd-1 | 0.10 |
| Cpd-4 | 0.17 |
| Solv-1 | 0.05 |
| 7th Layer (low sensitivity green-sensitive emulsion layer) | |
| Silver iodobromide emulsion (AgI content: 2 mol %; internal high AgI type; diameter: 0.3 μm as calculated in terms of a sphere; coefficient of variation in grain diameter: 28% as calculated in terms of a sphere; mixture of regular crystals and twin crystals; diameter/thickness ratio: 2.5) | 0.30 |
| Gelatin | 0.40 |
| ExS-4 | $5.0 \times 10^{-4}$ |
| ExS-6 | $0.3 \times 10^{-4}$ |
| ExS-5 | $2.0 \times 10^{-4}$ |
| ExM-9 | 0.2 |
| ExY-13 | 0.03 |
| ExM-8 | 0.03 |
| Solv-1 | 0.20 |
| 8th Layer (middle sensitivity green-sensitive emulsion layer) | |
| Silver iodobromide emulsion (AgI content: 4 mol %; internal high AgI type; diameter: 0.55 μm as calculated in terms of a sphere; coefficient of variation in grain diameter: 20% as calculated in terms of a sphere; mixture of regular crystals and twin crystals; diameter/thickness ratio: 4) | 0.70 |
| Gelatin | 1.00 |
| ExS-4 | $5.0 \times 10^{-4}$ |
| ExS-5 | $2.0 \times 10^{-4}$ |
| ExS-6 | $0.3 \times 10^{-4}$ |
| ExM-9 | 0.25 |
| ExM-8 | 0.03 |
| ExY-10 | 0.015 |
| ExY-13 | 0.04 |
| Solv-1 | 0.20 |
| 9th Layer (high sensitivity green-sensitive emulsion layer) | |
| Silver iodobromide emulsion (AgI content: 10 mol %; internal high AgI type; diameter: 0.7 μm as calculated in terms of a sphere; coefficient of variation in grain diameter: 30% as calculated in terms of a sphere; mixture of regular crystals and twin crystals; diameter/thickness ratio: 2.0) | 0.50 |
| Gelatin | 0.80 |
| ExS-4 | $2.0 \times 10^{-4}$ |
| ExS-5 | $2.0 \times 10^{-4}$ |
| ExS-6 | $0.2 \times 10^{-4}$ |

-continued

| | |
|---|---|
| ExS-7 | $3.0 \times 10^{-4}$ |
| ExM-11 | 0.06 |
| ExM-12 | 0.02 |
| ExM-8 | 0.02 |
| Cpd-2 | 0.01 |
| Cpd-9 | $2.0 \times 10^{-4}$ |
| Cpd-10 | $2.0 \times 10^{-4}$ |
| Solv-1 | 0.20 |
| Solv-2 | 0.05 |
| 10th Layer (yellow filter layer) | |
| Gelatin | 0.60 |
| Yellow colloidal silver | 0.05 |
| Cpd-1 | 0.20 |
| Solv-1 | 0.15 |
| 11th Layer (low sensitivity blue-sensitive emulsion layer) | |
| Silver iodobromide emulsion (AgI content: 4 mol %; internal high AgI type; diameter: 0.5 μm as calculated in terms of a sphere; coefficient of variation in grain diameter: 15% as calculated in terms of a sphere; octahedron) | 0.40 |
| Gelatin | 1.00 |
| ExS-8 | $2.0 \times 10^{-4}$ |
| ExY-15 | 0.90 |
| ExY-13 | 0.09 |
| Cpd-2 | 0.01 |
| Solv-1 | 0.30 |
| 12th Layer (high sensitivity blue-sensitive emulsion layer) | |
| Silver iodobromide emulsion (AgI content: 10 mol %; internal high AgI type; diameter: 1.3 μm as calculated in terms of a sphere; coefficient of variation in grain diameter: 25% as calculated in terms of a sphere; mixture of regular crystals and twin crystals; diameter/thickness ratio: 4.5) | 0.50 |
| Gelatin | 0.60 |
| ExS-8 | $1.0 \times 10^{-4}$ |
| ExY-15 | 0.12 |
| Cpd-2 | 0.001 |
| Cpd-5 | $2.0 \times 10^{-4}$ |
| Solv-1 | 0.04 |
| 13th Layer (1st protective layer) | |
| Finely divided silver iodobromide grains (average grain diameter: 0.07 μm; AgI content: 1 mol %) | 0.20 |
| Gelatin | 0.80 |
| UV-2 | 0.10 |
| UV-3 | 0.10 |
| UV-4 | 0.20 |
| Solv-3 | 0.04 |
| 14th Layer (2nd protective layer) | |
| Gelatin | 0.90 |
| Polymethyl methacrylate particles (diameter: 1.5 μm) | 0.20 |
| H-1 | 0.40 |

In order to improve preservability, processability, pressure resistance, corrosion resistance, antibacterial properties, antistatic properties, and coating properties, Cpd-3, Cpd-5, Cpd-6, Cpd-7, Cpd-8, P-1, P-2, W-1, W-2 an W-3 were further incorporated in each of these layers.

The chemical structure and names of the compounds used in the present invention are set forth below.

UV-1

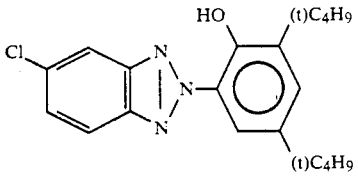

UV-2

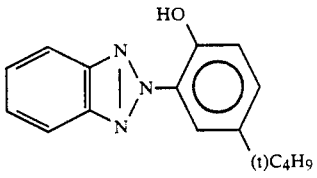

UV-3

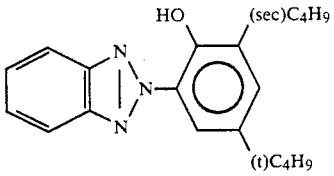

UV-4:

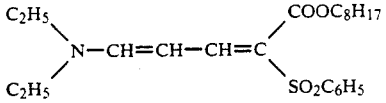

Solv-1:
Tricresyl phosphate

Solv-2:
Dibutyl phthalate

Solv-3:
Tri(2-ethylhexyl) phosphate

ExF-1:

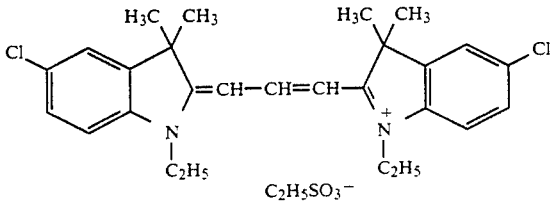

ExC-2:

-continued
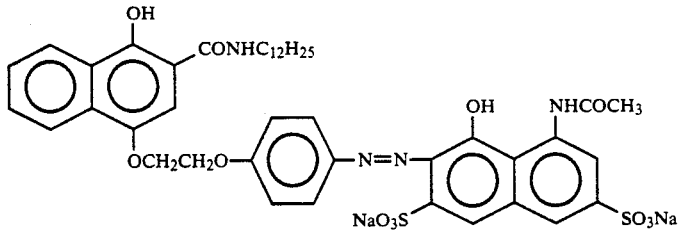
ExC-3:
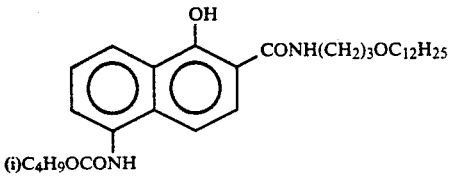
ExC-4:
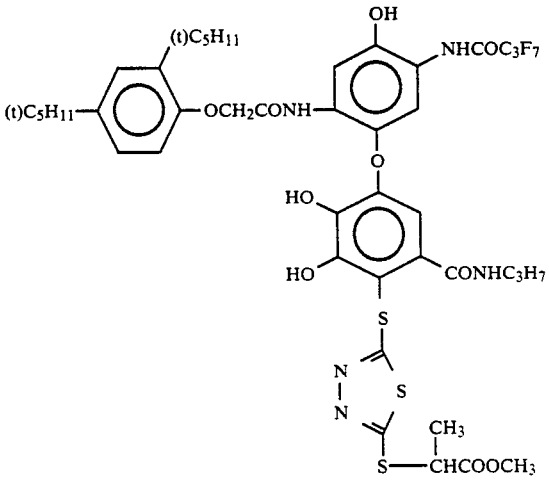
ExC-5:
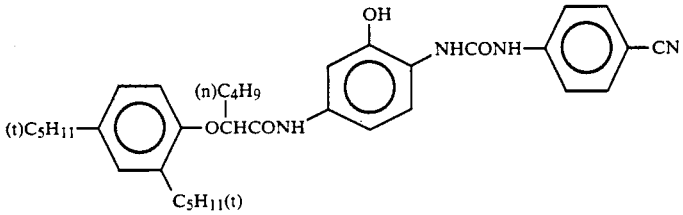
ExC-6:
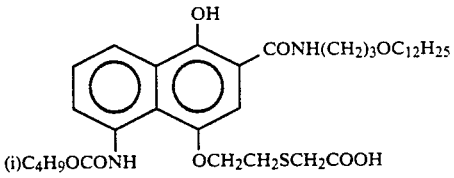
ExM-8:
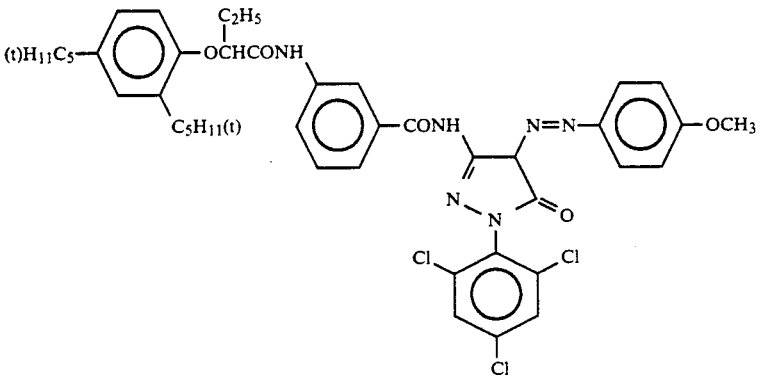
ExM-9:

-continued
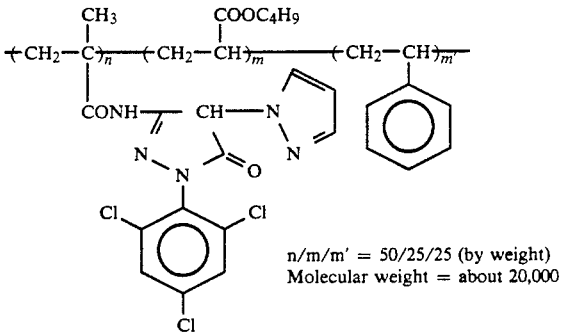
n/m/m' = 50/25/25 (by weight)
Molecular weight = about 20,000
ExM-10:
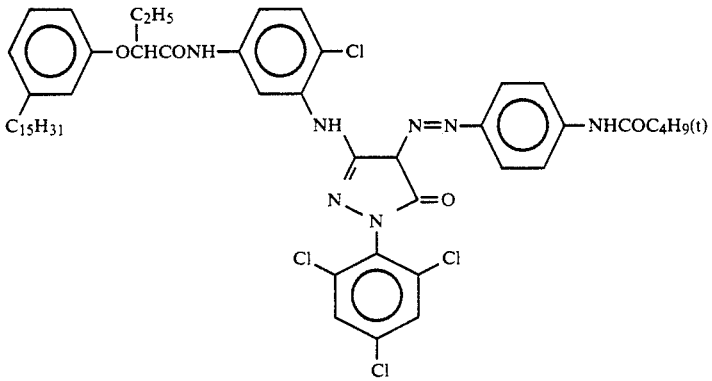
ExM-11:
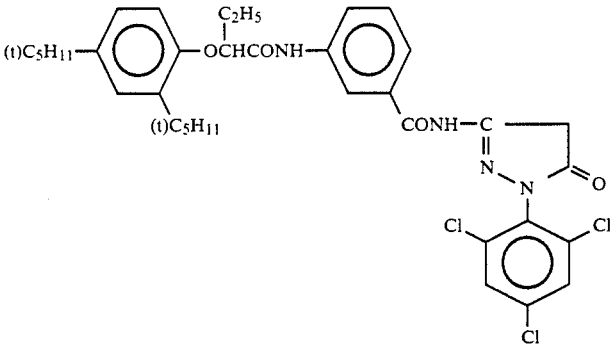
ExM-12:
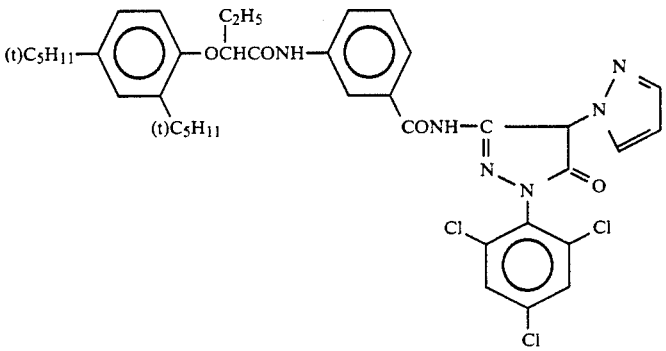
ExY-13:

-continued
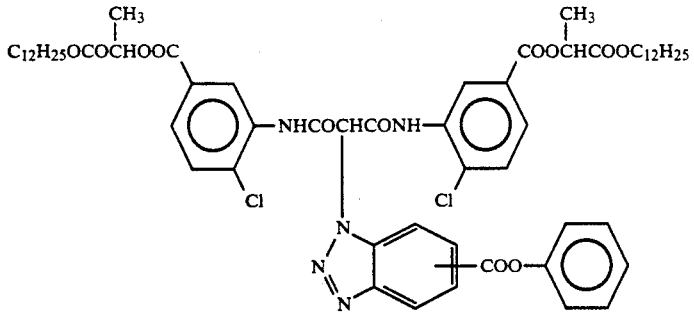
ExY-14:
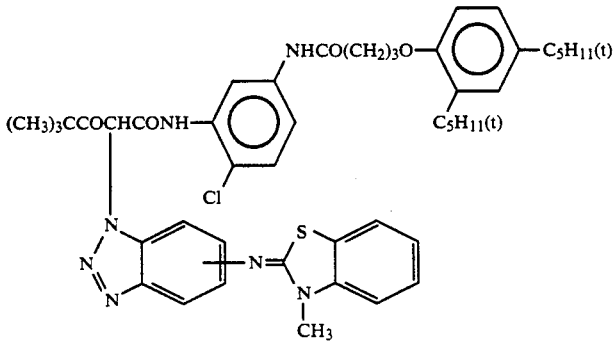
ExY-15:
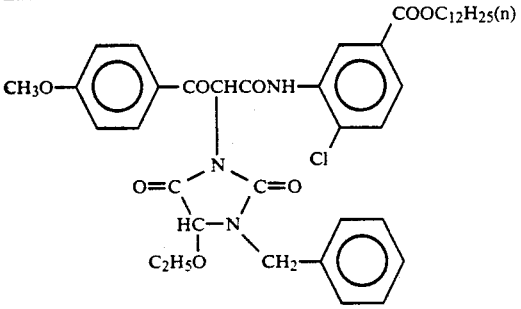
Cpd-1
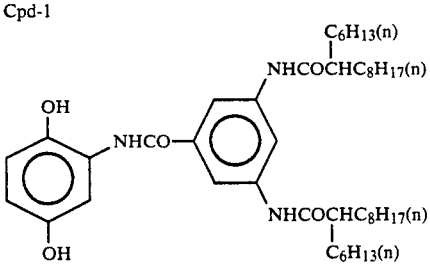
Cpd-2:
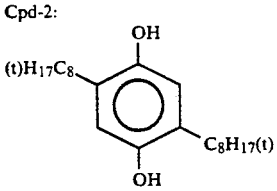
ExS-1:
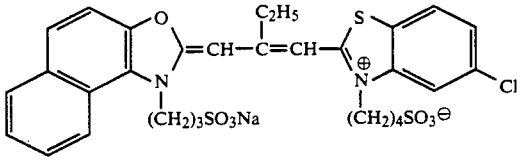
ExS-2:
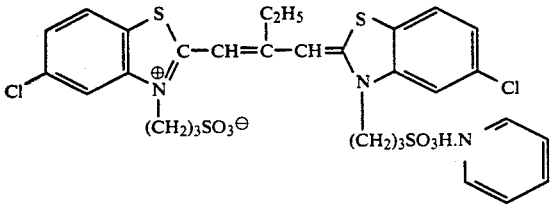
ExS-3:
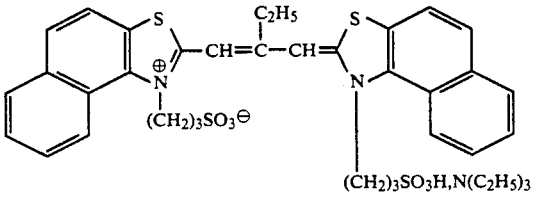
ExS-4:
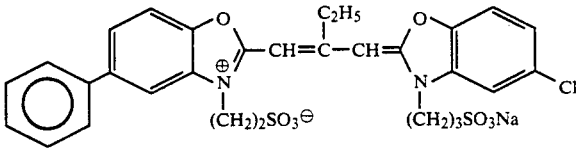

-continued
ExS-5:
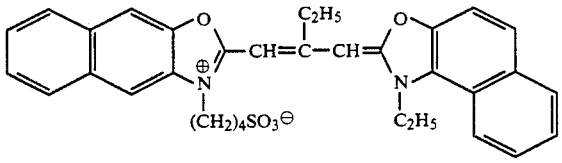
ExS-6:
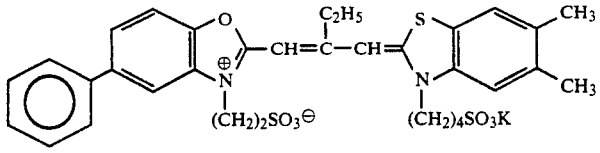
ExS-7:
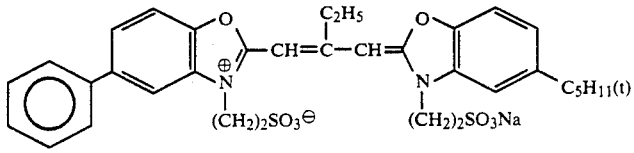
ExS-8:
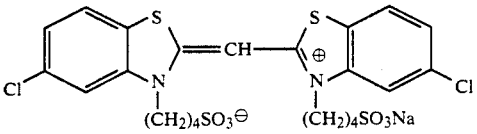
H-1:
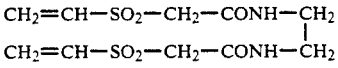
Cpd-3:
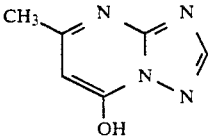
Cpd-4:
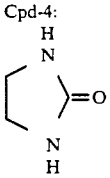
Cpd-5:
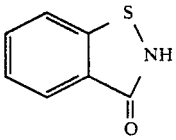
Cpd-6:
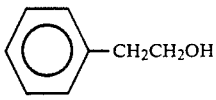
Cpd-7:
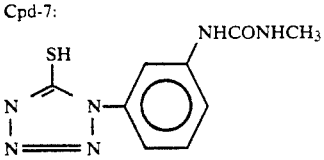
Cpd-8:
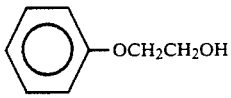
Cpd-9:
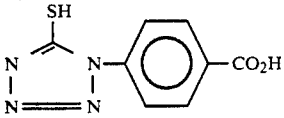
Cpd-10:
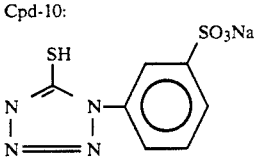
W-1
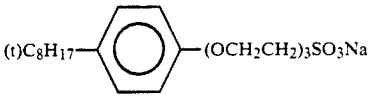
W-2
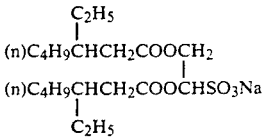
W-3
P-1

$C_8F_{17}SO_2N(C_3H_7)CH_2COOK$

-continued

Coploymer of vinylpyrrolidone and vinyl alcohol (copolymerization ratio = 70:30 [by weight])

P-2
Polyethyl acrylate

Specimen 102

Specimen 102 was prepared in the same manner as in Specimen 101 except that the present yellow colored cyan coupler YC-30 was incorporated in the 3rd, 4th and 5th layers in amounts of 0.050, 0.070, and 0.020 g/m$^2$, respectively.

The color photographic light-sensitive material (color negative film) specimens 101 and 102 thus prepared were then cut into 35-mm wide strips. These specimens were exposed to light in a camera. These specimens were then subjected to Experiment Nos. 1 to 7 wherein they were subjected to running processing as described in detail below in a small-sized automatic developing machine using a replenishment rate for the color developer and a color photographic light-sensitive material altered as set forth in Table 2. The amount of developing agents and potassium bromide are set forth with their corresponding replenishment rates of color developer in Table 1.

In each experiment, each light-sensitive material was processed until the replenishment of color developer reached twice the capacity of the color developer tank. Thereafter, each light-sensitive material which had been solid-exposed to light with a color temperature of 4,800° K and 20 CMS was processed. The light-sensitive material to be processed in this processing step was the same as that continuously processed in each experiment. For evaluating the bleaching ability, the amount of silver remaining on the exposed portion of these light-sensitive materials was measured for by the fluorescent X-ray method. The results are set forth in Table 2.

| Step | Time | Temp. (°C.) | Replenishment rate (ml) | Tank capacity (liter) |
|---|---|---|---|---|
| Color development | 3 min. 15 sec. | 38.0 | set forth in Table 2 | 1 |
| Bleach | 30 sec. | 38.0 | 130 | 1 |
| Fixing | 2 min. 00 sec. | 38.0 | 800 | 1 |
| Washing (1) | 20 sec. | 38.0 | * | 0.5 |
| Washing (2) | 20 sec. | 38.0 | 500 | 0.5 |
| Stabilization | 20 sec. | 38.0 | 500 | 0.5 |
| Drying | 1 min. 00 sec. | 55.0 | | |

*The washing step is effected in a counter-current process wherein the washing water flows backward.

In the table, the replenishment rate was determined per m$^2$ of light-sensitive material.

The various processing solutions had the following compositions:

| | Running solution (g) | Replenisher (g) |
|---|---|---|
| (Color developer) | | |
| Diethylenetriamine-pentaacetic acid | 1.0 | 1.0 |
| 1-Hydroxyethylidene-1,1-diphosphonic acid | 3.0 | 3.2 |
| Sodium sulfite | 4.0 | 4.9 |
| Potassium carbonate | 30.0 | 30.0 |
| Potassium bromide | 1.4 | Set forth in Table 1 |

-continued

| | Running solution (g) | Replenisher (g) |
|---|---|---|
| Potassium iodide | 1.5 mg | — |
| Hydroxylamine sulfate | 2.4 | 3.6 |
| 4-(N-ethyl-N-β-hydroxyethyl amino)-2-methylaniline sulfate | 4.5 | Set forth in Table 1 |
| Water to make | 1.0 l | 1.0 l |
| pH | 10.05 | 10.10 |
| (Bleaching solution) | | |
| Ferric complex of 1,3-diaminopropanetetraacetate | 0.25 mol/l | 0.45 mol/l |
| Ammonium bromide | 140.0 | 180.0 |
| Ammonium nitrate | 30.0 | 40.0 |
| 98% Acetic acid | 25.0 ml | 30.0 ml |
| Glycolic acid | 70.0 | 100.0 |
| Water to make | 1.0 l | 1.0 l |
| pH | 3.3 | 2.8 |
| (Fixing solution) | | |
| 1-Hydroxyethylidene-1,1-diphosphonic acid | 1.0 | 1.5 |
| Ammonium sulfite | 12.0 | 20.0 |
| Ammonium thiosulfate | 1.5 mol/l | 1.7 mol/l |
| Water to make | 1.0 l | 1.0 l |
| pH | 6.7 | 6.4 |
| (Washing solution) (The running solution was used also as replenisher) | | |

Tap water was passed through a mixed bed column packed with an H-type strongly acidic cation exchange resin (Amberlite IR-120B available from Rohm & Haas) was an OH-type strongly basic anion exchange resin (Amberlite IRA-400 available from the same company) so that the calcium and magnesium ion concentrations were each reduced to 3 mg/l or less. Dichlorinated sodium isocyanurate and sodium sulfate were then added to the solution in amounts of 20 mg/l and 150 mg/l, respectively. The washing solution thus obtained had a pH value of 6.5 to 7.5.

| (Stabilizing solution) | Running solution (g) | Replenisher (g) |
|---|---|---|
| Triethanolamine | 2.0 | 3.0 |
| 37% Formalin | 2.0 ml | 3.0 ml |
| Polyoxyethylene-p-monononylphenylether (mean polymerization degree: 10%) | 0.3 | 0.45 |
| Disodium ethylenediamine-tetraacetate | 0.05 | 0.08 |
| Water to make | 1.0 l | 1.0 l |
| pH | 5.0–8.0 | 5.0–8.0 |

TABLE 1

| Replenishment rate of color developer (per m$^2$ of light-sensitive material) | Concentration of color developer replenisher | |
|---|---|---|
| | Developing agent | Potassium bromide |
| 1,200 ml | 5.3 g/l | 0.7 g/l |
| 600 ml | 6.3 g/l | 0.3 g/l |
| 400 ml | 7.1 g/l | 0.1 g/l |

TABLE 1-continued

| Replenishment rate of color developer (per $m^2$ of light-sensitive material) | Concentration of color developer replenisher | |
|---|---|---|
| | Developing agent | Potassium bromide |
| 300 ml | 7.8 g/l | 0.0 g/l |

TABLE 2

| Experiment No. | Replenishment rate of color developer (per $m^2$ of light-sensitive material) | Specimen No. | Remaining amount of silver on exposed portion ($\mu g/cm^2$) |
|---|---|---|---|
| Comparative Example 1 | 1,200 | 101 | 5.5 |
| Comparative Example 2 | 600 | " | 7.2 |
| Comparative Example 3 | 300 | " | 13.4 |
| Comparative Example 4 | 1,200 | 102 | 6.1 |
| Present Invention 5 | 600 | " | 4.0 |
| Present Invention 6 | 400 | " | 3.2 |
| Present Invention 7 | 300 | " | 2.6 |

The results set forth in Table 2 show that when the light-sensitive materials free of yellow colored cyan coupler as disclosed herein are processed with the replenishment rate of the color developer reduced from 1,200 ml/$m^2$ to 500 ml/$m^2$ and further to 400 ml/$m^2$, they exhibit a remarkable deterioration in these properties. On the other hand, when light-sensitive materials comprising yellow colored cyan couplers as disclosed herein were processed with the replenishment rate reduced to 600 ml/$m^2$ or less, a better bleaching ability was obtained than at a replenishment rate of 1,200 ml/$m^2$. When the replenishment rate was further reduced to 400 ml/$m^2$ or less, the so processed light-sensitive material specimens rather exhibited improvements in these properties.

EXAMPLE 2

Specimens 103 to 108 were prepared in the same manner as Specimen 102 of Example 1 except that the yellow colored cyan coupler YC-30 was replaced by the yellow colored cyan couplers set forth in Table 3 in equimolecular amounts, respectively. These specimens were then exposed to light in the same manner as in Example 1, and processed at a color developer replenishment rate of 300 ml/$m^2$ in the same manner as in Example 1. These specimens were then measured to determine the amount of silver remaining on them after processing by the fluorescent X-ray method. The results are set forth in Table 3.

TABLE 3

| Specimen No. | Yellow colored cyan coupler | Remaining amount ($\mu g/cm^2$) | Remarks |
|---|---|---|---|
| 102 | YC-30 | 2.5 | Present Invention |
| 103 | YC-1 | 2.6 | " |
| 104 | YC-28 | 2.5 | " |
| 105 | YC-32 | 3.0 | " |
| 106 | YC-46 | 3.1 | " |
| 107 | YC-47 | 3.4 | " |
| 108 | YC-48 | 3.3 | " |

Table 3 shows that even yellow colored cyan couplers other than YC-30 provide excellent results when the present invention is employed.

EXAMPLE 3

Specimens 101 and 102 were prepared, cut and exposed to light in the same manner as in Example 1. These specimens were then subjected to the following processing by means of a remodelled version of Color Negative Film Processor FP-350 available from Fuji Photo Film Co., Ltd. The formulation of the color developer was the same as that used in Example 1. The formulation of the processing solutions or subsequent processing solutions were the same as that used in Example 2 in JP-A-1-102559.

| Step | Processing time | Processing temperature (°C.) | Replenishment rate* |
|---|---|---|---|
| Color development | 2 min. 35 sec. | 40.5 | Shown in Table 2 |
| Bleach | 45 sec. | 38.0 | 500 ml |
| Blix | 2 min. 30 sec. | 38.0 | 1,500 ml |
| Washing (1) | 30 sec. | 38.0 | Countercurrent piping system in which water flows backward |
| Washing (2) | 30 sec. | 38.0 | 1,000 ml |
| Stabilization | 30 sec. | 38.0 | 1,000 ml |
| Drying | 1 min. 00 sec. | 55 | |

*Determined per $m^2$ of light-sensitive material

For the evaluation of bleaching ability, these specimens were measured to determine the amount of silver remaining on the exposed portion by the fluorescent X-ray method. The results were similar to that of Example 1.

EXAMPLE 4

A multilayer color light-sensitive material was prepared as Specimen 201 by coating various layers having the following compositions on an undercoated cellulose triacetate film support.

Composition of Light-Sensitive Layer

The coated amount of silver halide and colloidal silver is represented in g/$m^2$ as calculated in terms of the amount of silver. The coated amount of coupler, additive, and gelatin is represented in g/$m^2$. The coated amount of sensitizing dye is represented in the molar amount per mol of silver halide contained in the same layer. The marks indicating the additive are as defined below, provided that if there are a plurality of effects, one of them is set forth below as representative.

UV: ultraviolet absorbent; Solv: high boiling organic solvent; ExF: dye; ExS: sensitizing dye; ExC: cyan coupler; ExM: magenta coupler; ExY: yellow coupler; Cpd: additive

| 1st Layer: (anti-halation layer) | |
|---|---|
| Black colloidal silver | 0.15 |
| Gelatin | 2.0 |
| ExM-6 | 0.2 |
| UV-1 | 0.03 |
| UV-2 | 0.06 |
| UV-3 | 0.07 |
| Solv-1 | 0.3 |
| Solv-2 | 0.08 |
| ExF-1 | 0.01 |
| ExF-2 | 0.01 |

-continued

| | |
|---|---|
| ExF-3 | 0.005 |
| Cpd-6 | 0.001 |
| 2nd Layer: (low sensitivity red-sensitive emulsion layer) | |
| Silver iodobromide emulsion (AgI content: 4 mol %; uniform AgI type; diameter: 0.4 μm as calculated in terms of a sphere; variation coefficient: 30% as calculated in terms of a sphere; tabular grain; diameter/thickness ratio: 3.0) | 0.37 |
| Silver iodobromide emulsion (AgI content: 6 mol %; high internal AgI type (core/shell ratio: 2:1); grain diameter: 0.45 μm (as calculated in terms of a sphere); variation coefficient: 23% (as calculated in terms of a sphere); tabular grain; diameter/thickness: 2.0) | 0.19 |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $4.2 \times 10^{-6}$ |
| ExC-1 | 0.17 |
| ExC-2 | 0.03 |
| ExC-3 | 0.009 |
| Compound of the present invention (YC-25) | 0.03 |
| 3rd layer: (middle sensitivity red-sensitive emulsion layer) | |
| Silver iodobromide emulsion (AgI content: 6 mol %; high internal AgI type (core/shell ratio: 2:1); grain diameter: 0.65 μm as calculated in terms of a sphere); variation coefficient: 23% (as calculated in terms of a sphere); tabular grain; diameter/thickness: 2.0) | 0.65 |
| Gelatin | 1.0 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $4.2 \times 10^{-6}$ |
| ExC-1 | 0.31 |
| ExC-2 | 0.01 |
| ExC-3 | 0.10 |
| Compound of the present invention (YC-25) | 0.07 |
| 4th Layer: (high sensitivity red-sensitive emulsion layer) | |
| Silver iodobromide emulsion (AgI content: 9.3 mol %; multistrutural grain (core/shell ratio: 3:4:2); AgI content: 24, 0, 6 mol % toward the surface; grain diameter: 0.75 μm (as calculated in terms of a sphere); variation coefficient: 23% (as calculated in terms of a sphere); tabular grain; diameter/thickness: 2.5) | 1.5 |
| Gelatin | 1.4 |
| ExS-1 | $1.9 \times 10^{-4}$ |
| ExS-2 | $1.2 \times 10^{-4}$ |
| ExS-5 | $1.9 \times 10^{-4}$ |
| ExS-7 | $8.0 \times 10^{-6}$ |
| ExC-1 | 0.08 |
| ExC-4 | 0.09 |
| Compound of the present invention (YC-25) | 0.03 |
| Solv-1 | 0.08 |
| Solv-2 | 0.20 |
| Cpd-7 | $4.6 \times 10^{-4}$ |
| 5th Layer: (interlayer) | |
| Gelatin | 0.6 |
| Cpd-1 | 0.1 |
| Polyethyl acrylate latex | 0.08 |
| Solv-1 | 0.08 |
| 6th Layer: (low sensitivity green-sensitive emulsion layer) | |
| Silver iodobromide emulsion (AgI content: 4 mol %; uniform AgI type; grain diameter: 0.33 μm (as calculated in terms of a sphere); variation coefficient: 37% (as calculated in terms of a sphere); tabular grain; diameter/thickness: 2.0) | 0.18 |
| Gelatin | 0.4 |
| ExS-3 | $1.6 \times 10^{-4}$ |
| ExS-4 | $4.8 \times 10^{-4}$ |
| ExS-5 | $1 \times 10^{-4}$ |
| ExM-5 | 0.08 |
| ExM-13 | 0.08 |
| ExM-7 | 0.03 |
| ExY-8 | 0.01 |
| Solv-1 | 0.06 |
| Solv-4 | 0.01 |
| 7th layer: (middle sensitivity green-sensitive emulsion layer) | |
| Silver iodobromide emulsion (AgI content: 4 mol %; uniform AgI type; grain diameter: 0.55 μm (as calculated in terms of a sphere); variation coefficient: 15% (as calculated in terms of a sphere); tabular grain; diameter/thickness: 4.0) | 0.27 |
| Gelatin | 0.6 |
| ExS-3 | $2 \times 10^{-4}$ |
| ExS-4 | $7 \times 10^{-4}$ |
| ExS-5 | $1.4 \times 10^{-4}$ |
| ExM-5 | 0.08 |
| ExM-14 | 0.13 |
| ExM-7 | 0.04 |
| ExY-8 | 0.04 |
| Solv-1 | 0.14 |
| Solv-4 | 0.01 |
| 8th layer: (high sensitivity green-sensitive emulsion layer) | |
| Silver iodobromide emulsion (AgI content: 8.8 mol %; multistrutural grain (core/shell ratio: 3:4:2); AgI content: 24, 0, 3 mol % toward the surface; grain diameter: 0.75 μm (as calculated in terms of a sphere); variation coefficient: 23% (as calculated in terms of a sphere); tabular grain; diameter/thickness: 1.6) | 0.5 |
| Gelatin | 0.6 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.08 |
| ExM-6 | 0.03 |
| ExY-8 | 0.02 |
| ExC-1 | 0.01 |
| ExC-4 | 0.01 |
| Solv-1 | 0.23 |
| Solv-2 | 0.05 |
| Solv-4 | 0.01 |
| Cpd-7 | $1 \times 10^{-4}$ |
| Cpd-8 | 0.01 |
| 9th layer: (interlayer) | |
| Gelatin | 0.6 |
| Cpd-1 | 0.04 |
| Polyethylene acrylate latex | 0.05 |
| Solv-1 | 0.02 |
| UV-4 | 0.03 |
| UV-5 | 0.04 |
| 10th Layer: donor layer having interimage effect on red-sensitive layer) | |
| Silver iodobromide emulsion (AgI content: 8 mol %; high internal AgI type (core/shell ratio: 2:1); grain diameter: 0.65 μm (as calculated in terms of a sphere); variation coefficient: 25% (as calculated in terms of a sphere); tabular grain; diameter/thickness: 2.0) | 0.72 |
| Silver iodobromide emulsion (AgI content: 4 mol %; uniform AgI type; grain diameter: 0.4 μm (as calculated in terms of a sphere); variation coefficient: 30% (as calculated in terms of a sphere); tabular grain; diameter/thickness: 3.0) | 0.21 |
| Gelatin | 1.0 |

-continued

| | |
|---|---|
| ExS-3 | $6 \times 10^{-4}$ |
| ExM-10 | 0.19 |
| Solv-1 | 0.30 |
| Solv-6 | 0.03 |
| 11th Layer: (yellow filter layer) | |
| Yellow colloidal silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |
| 12th Layer: (low sensitivity blue-sensitive emulsion layer) | |
| Silver iodobromide emulsion (AgI content: 4.5 mol %; uniform AgI type; grain diameter: 0.7 μm (as calculated in terms of a sphere); variation coefficient: 15% (as calculated in terms of a sphere); tabular grain; diameter/thickness: 7.0) | 0.45 |
| Silver iodobromide emulsion (AgI content: 3 mol %; uniform AgI type; grain diameter: 0.3 μm (as calculated in terms of a sphere); variation coefficient: 30% (as calculated in terms of a sphere); tabular grain; diameter/thickness: 7.0) | 0.25 |
| Gelatin | 2.1 |
| ExS-6 | $9 \times 10^{-4}$ |
| ExC-1 | 0.13 |
| ExC-4 | 0.03 |
| ExY-9 | 0.14 |
| ExY-11 | 0.70 |
| ExY-16 | 0.40 |
| Solv-1 | 0.51 |
| 13th Layer: (interlayer) | |
| Gelatin | 0.4 |
| ExY-12 | 0.20 |
| Solv-1 | 0.19 |
| 14th Layer: (high sensitivity blue-sensitive emulsion layer) | |
| Silver iodobromide emulsion (AgI content: 10 mol %; high internal AgI type; grain diameter: 1.0 μm (as calculated in terms of a sphere); variation coefficient: 25% (as calculated in terms of a sphere); multitwin tabular grain; diameter/thickness: 2.0) | 0.4 |
| Gelatin | 0.5 |
| ExS-6 | $1 \times 10^{-4}$ |
| ExY-9 | 0.01 |
| ExY-11 | 0.12 |
| ExY-15 | 0.09 |
| ExC-1 | 0.01 |
| Solv-1 | 0.10 |
| 15th Layer: (1st protective layer) | |
| Fine grain silver iodobromide emulsion (AgI content: 2 mol %; uniform AgI type; grain diameter: 0.07 μm (as calculated in terms of a sphere) | 0.12 |
| Gelatin | 0.7 |
| UV-4 | 0.11 |
| UV-5 | 0.16 |
| Solv-5 | 0.02 |
| H-1 | 0.13 |
| Cpd-5 | 0.10 |
| Polyethyl acrylate latex | 0.09 |
| 16th layer: (2nd protective layer) | |
| Fine grain silver iodobromide emulsion (AgI content: 2 mol %; uniform AgI type; grain diameter: 0.07 μm (as calculated in terms of a sphere) | 0.36 |
| Gelatin | 0.85 |
| Polymethyl methacrylate particles (diameter: 1.5 μm) | 0.2 |
| Cpd-4 | 0.04 |
| W-4 | 0.02 |
| H-1 | 0.17 |

In addition to the above mentioned components, an emulsion stabilizer Cpd-3 (0.07 g/m$^2$), and surface active agents W-1 (0.006 g/m$^2$), W-2 (0.18 g/m$^2$), W-3 (0.10 g/m$^2$), and W-5 (0.15 g/m$^2$) were incorporated in each of these layers as a coating aid or an emulsion dispersant.

Furthermore, 1,2-benzisothiazoline-3-one, 2-phenoxyethanol, and phenetyl alcohol were incorporated in these layers in order to improve the bacterial resistance of the light-sensitive material.

UV-1

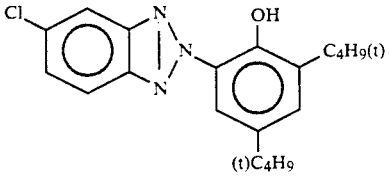

UV-2

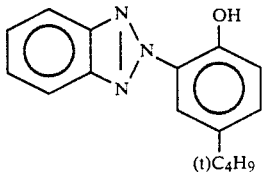

UV-3

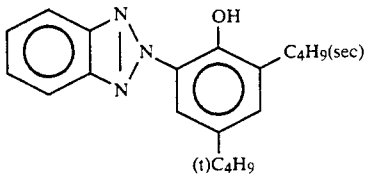

UV-4

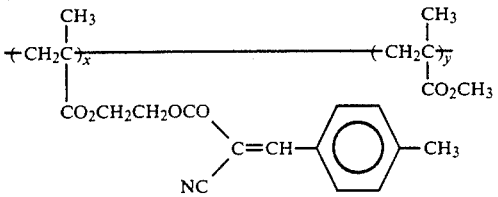

x:y = 70:30 (wt %)

UV-5

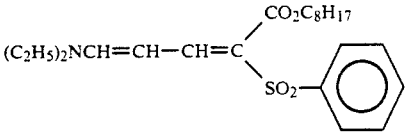

Solv-1:
Tricresyl phosphate

Solv-2:

Solv-4:

Dibutyl phthalate
-continued
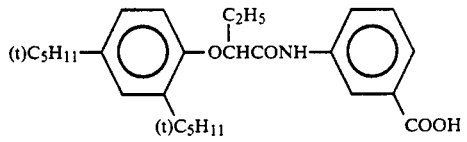
Solv-5:
Trihexyl phosphate
Solv-6
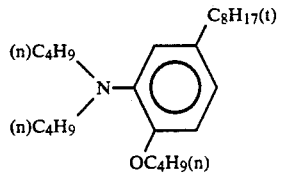
ExF-1
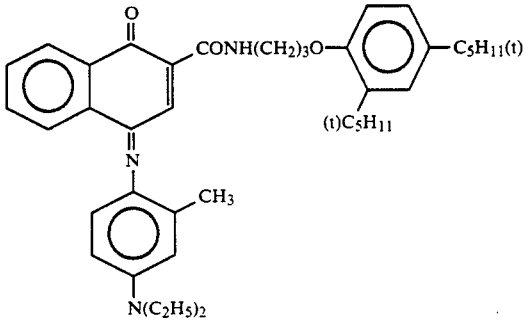
ExF-2
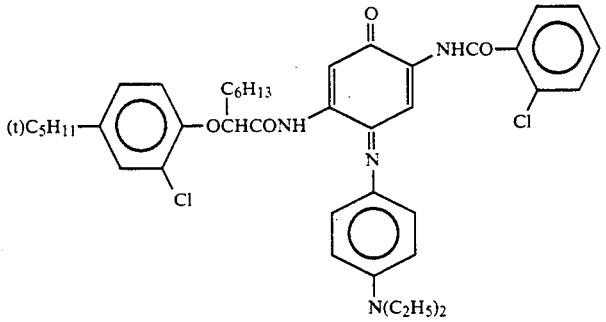
ExF-3
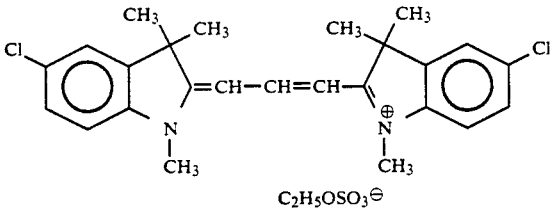
ExS-1
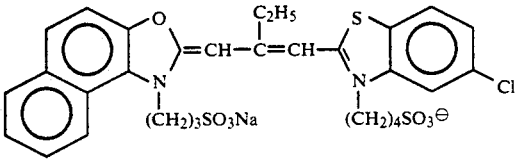
ExS-2
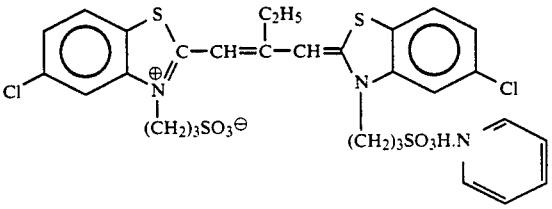
ExS-3

-continued
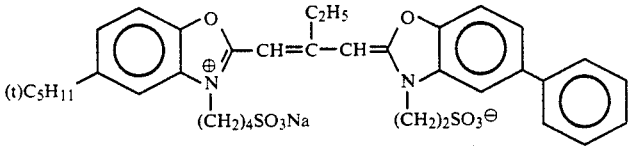
ExS-4
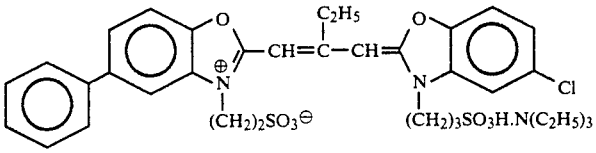
ExS-5
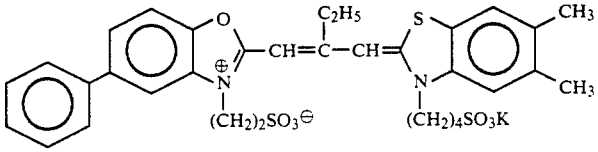
ExS-6
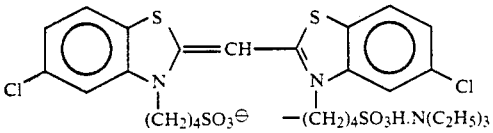
ExS-7
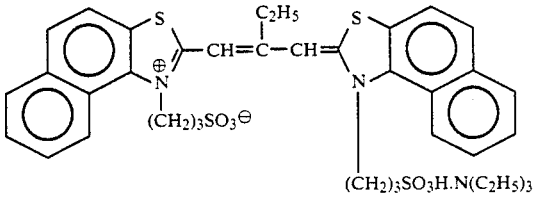
ExS-8
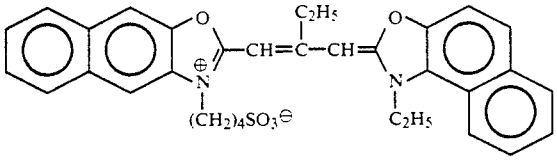
ExC-1
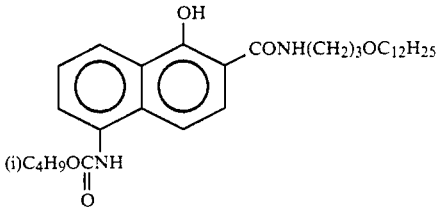
ExC-2
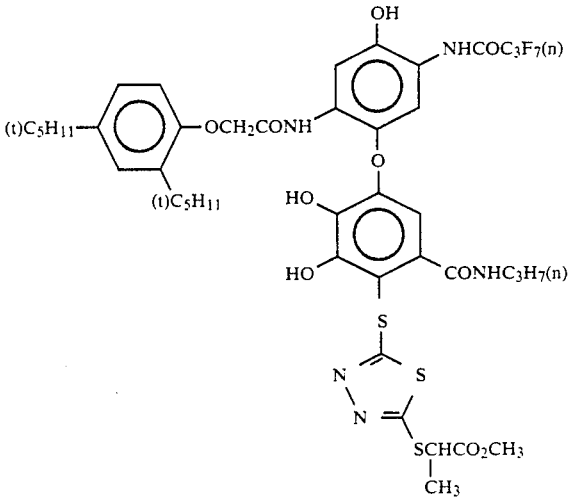
ExC-3
ExC-4

-continued
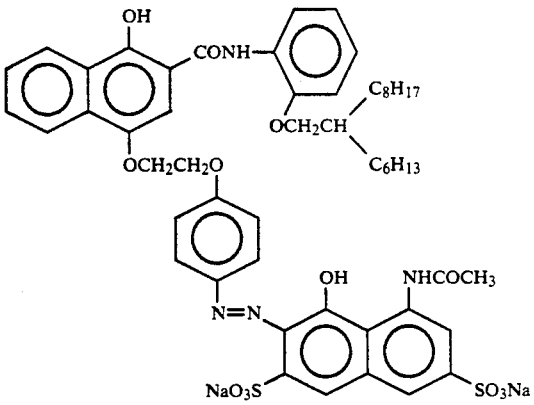
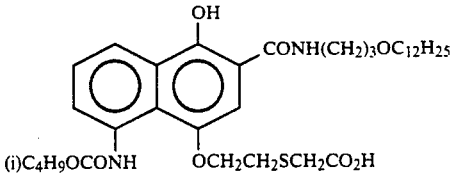
ExM-5
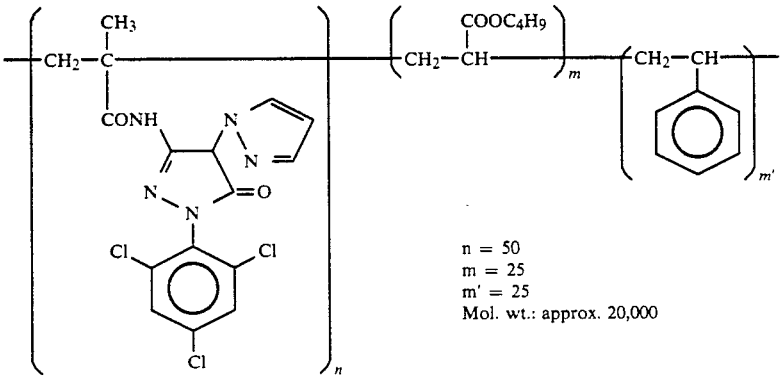
n = 50
m = 25
m' = 25
Mol. wt.: approx. 20,000
ExM-6
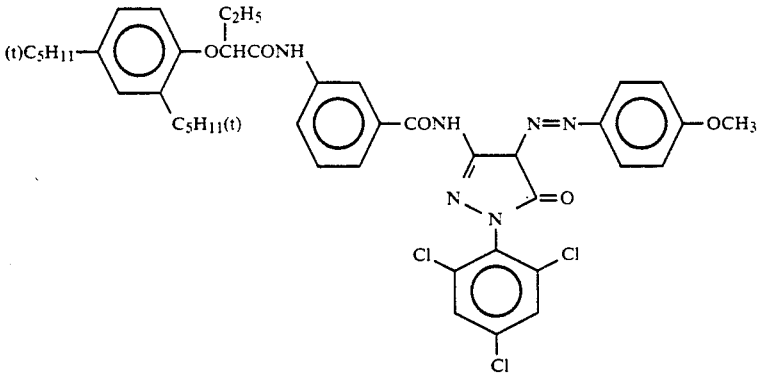
ExM-7
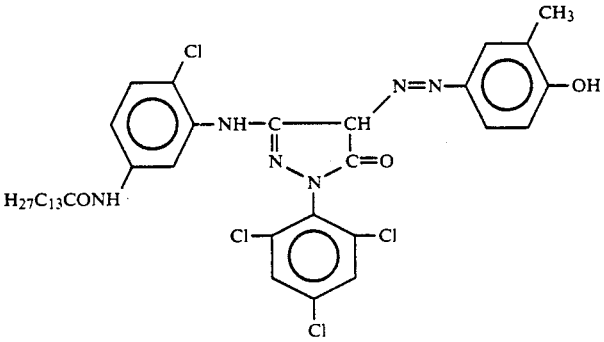
ExM-10

-continued
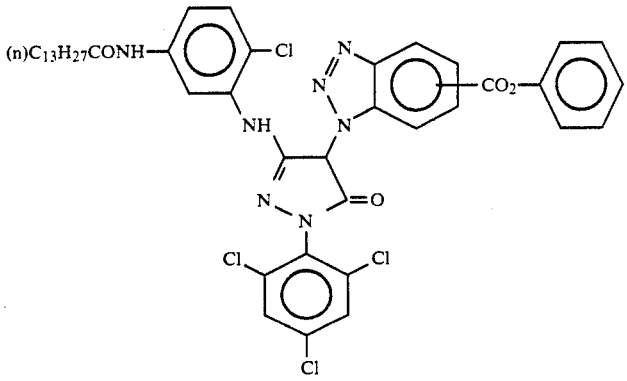
ExY-8
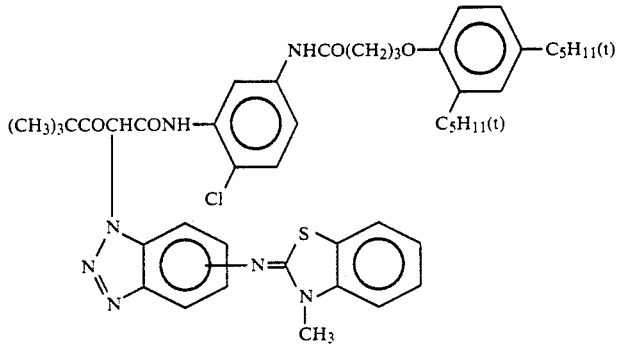
ExY-9
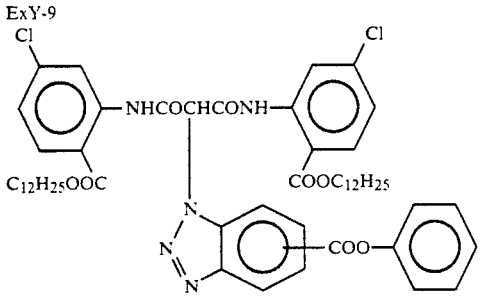
ExY-11
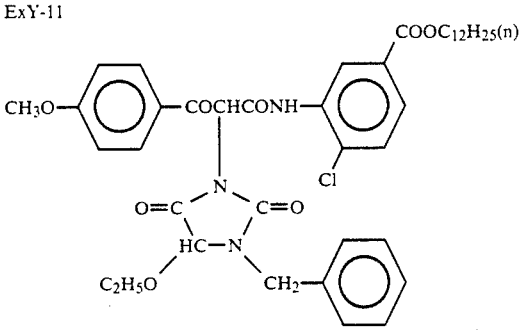
ExY-12
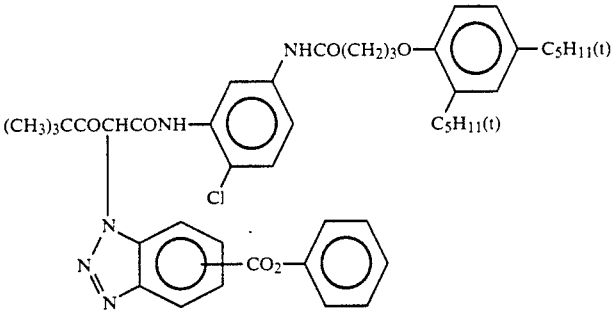
ExM-13
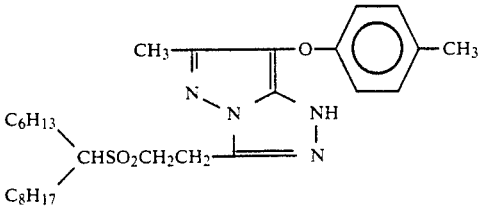

-continued
ExM-14
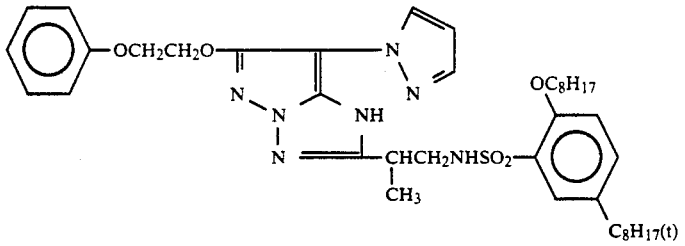
ExY-15
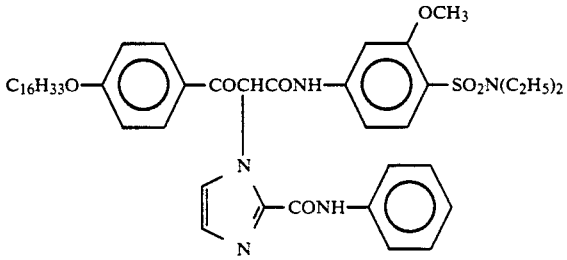
ExY-16
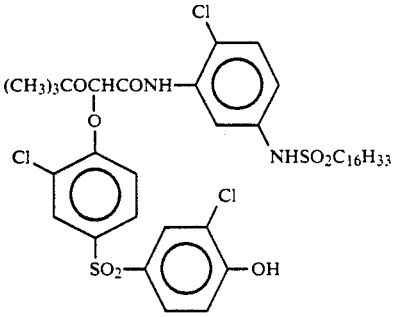
Cpd-1
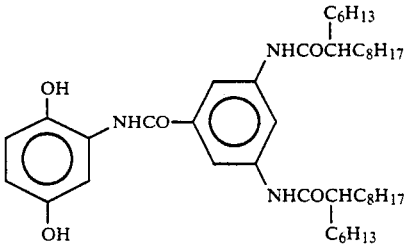
Cpd-2
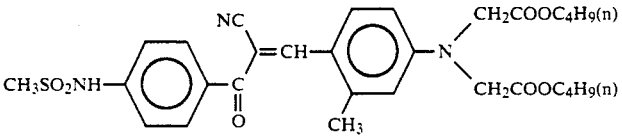
Cpd-3
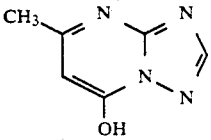
Cpd-4
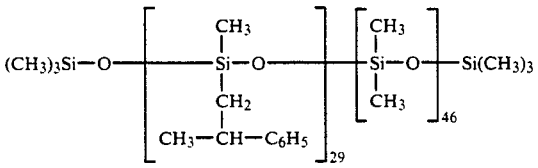
Cpd-5
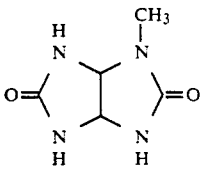
Cpd-6
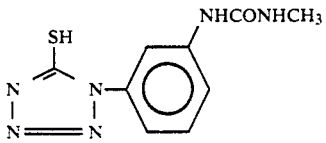
Cpd-7
Cpd-8

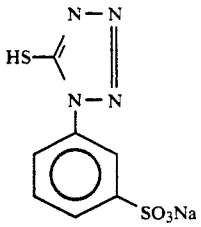

H-1

$CH_2{=}CH{-}SO_2{-}CH_2{-}CONH{-}CH_2$
$CH_2{=}CH{-}SO_2{-}CH_2{-}CONH{-}CH_2$

W-2

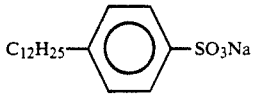

W-4

$C_8F_{17}SO_2N(C_3H_7)CH_2COOK$

-continued

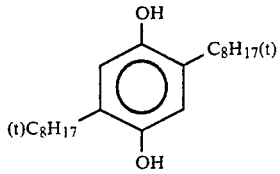

W-1

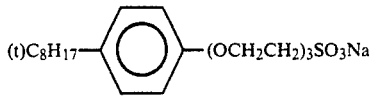

W-3

$(n)C_4H_9CH(C_2H_5)CH_2COOCH_2$
$(n)C_4H_9CH(C_2H_5)CH_2COOCHSO_3Na$

W-5

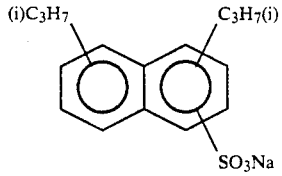

The specimens thus prepared were cut into 35-mm wide strips, imagewise exposed to light, and processed in the following processing steps by means of an automatic developing machine for motion picture film until the accumulated amount of the replenished bleaching solution reached three times the capacity of the running solution tank.

The potassium ion concentration in the bleaching solution used was determined to be 0.34 gram ion/liter by flame analysis. About 53% of these potassium ions were from the color developer components which had been carried over into the bleaching bath.

| Processing step | | | | |
|---|---|---|---|---|
| Step | Time | Temp. (°C.) | Replenishment rate* (ml) | Tank capacity (liter) |
| Color development | 3 min. 00 sec. | 37.5 | 20 | 10 |
| Bleach | 25 sec. | 38.0 | 2.5 | 5 |
| Fixing | 1 min. | 38.0 | 15 | 5 |
| Rinse (1) | 30 sec. | 38.0 | — | 5 |
| Rinse (2) | 30 sec. | 38.0 | 30 | 5 |
| Stabilization | 30 sec. | 38.0 | 20 | 5 |
| Drying | 1 min. | 55.0 | | |

*Determined per 35-mm width and 1-m length

The rinse step was effected in a countercurrent process wherein the washing water flows backward. All the overflow solution was introduced into the fixing bath.

The amount of developer carried over to the bleaching step and the amount of the fixing solution carried over to the rinse step were 2.5 ml and 2.0 ml per m of 35-mm wide light-sensitive material, respectively. In each step, the crossover time was 5 seconds. This crossover time is included in the processing time at the prebath.

The opening value of the bleaching bath and fixing bath were each 0.02.

The agitation in the automatic developing machine was accomplished by means of Iwaki Magnet Pump. The processing solution was jetted through nozzles with a diameter of 1.2 mm from the outside to the inside of the rack to the emulsion surface of the light-sensitive material at a distance of about 10 mm.

The size, flow rate and number of nozzles of the pumps used in these baths are set forth below.

| Step | Pump | Flow rate (l/min.) | Number of nozzles |
|---|---|---|---|
| Color development | MD-20 | 15 | 54 |
| Bleach | MD-20 | 15 | 54 |
| Fixing | MD-20 | 15 | 54 |
| Rinse 1 | MD-10 | 8 | 36 |
| Rinse 2 | MD-10 | 8 | 36 |
| Stabilizing | MD-10 | 8 | 36 |

The replenishment of the processing solutions and water to these processing baths were made as follows:

The evaporative loss from these processing baths was made up for by a daily addition of water.

In the bleaching bath, the bleaching solution was aerated only during the processing of the light-sensitive material (Specimen 201).

The various processing solutions had the following compositions:

| | Running solution (g) | Replenisher (g) |
|---|---|---|
| Developer | | |

-continued

| | Running solution (g) | Replenisher (g) |
|---|---|---|
| Diethylenetriamine-pentaacetic acid | 2.0 | 2.0 |
| 1-Hydroxyethylidene-1,1-diphosphonic acid | 3.0 | 3.2 |
| Sodium sulfite | 4.0 | 5.8 |
| Potassium carbonate | 40.0 | 40.0 |
| Potassium bromide | 1.3 | 0.4 |
| Potassium iodide | 1.5 mg | — |
| Hydroxylamine sulfate | 2.4 | 3.6 |
| 4-[N-ethyl-N-(β-hydroxyethyl) amino]-2-methylaniline sulfate | 4.5 | 6.4 |
| Water to make | 1.0 liter | 1.0 liter |
| pH [adjusted with 50% potassium hydroxide] | 10.05 | 10.15 |
| **Bleaching solution** | | |
| Ferric complex of 1,3-propylenediaminetetraacetate monohydrate | 110 | 220 |
| Ammonium bromide | 70 | 140 |
| Ammonium nitrate | 20 | 40 |
| Water to make | 1,000 ml | 1,000 ml |
| pH [adjusted with 27% aqueous ammonia] | 3.8 | 2.0 |
| **Fixing solution** | | |
| Diammonium ethylenediamine-tetraacetate | 18 | 54 |
| Ammonium sulfite | 20.0 | 60 |
| Aqueous solution of ammonium thiosulfate (700 g/l) | 280.0 ml | 840 ml |
| Imidazole | 25 g | 75 g |
| Water to make | 1.0 liter | 1.0 liter |
| pH | 7.4 | 7.45 |

Washing Solution (The running solution was used also as replenisher)

Tap water was passed through a mixed bed column packed with an H-type strongly acidic cation exchange resin (Amberlite IR-120B available from Rohm & Haas) and an OH-type strongly basic anion exchange resin (Amberlite IRA-400 available from the same company) so that the calcium and magnesium ion concentrations were each reduced to 3 mg/l or less. Dichlorinated sodium isocyanurate and sodium sulfate were then added to the solution in amounts of 20 mg/l and 150 mg/l, respectively. The washing solution thus obtained had a pH value of 6.5 to 7.5.

Stabilizing Solution (The running solution was used also as replenisher)

| | |
|---|---|
| 37% Formalin | 1.2 ml |
| Surface active agent $[C_{10}H_{21}—O—(CH_2CH_2O—)_{10}H]$ | 0.4 g |
| Disodium ethylenediaminetetraacetate dihydrate | 0.05 g |
| Water to make | 1 l |
| pH | 5.0-7.0 |

The processing was effected with the processing solutions described above in the manner described above. The water used for making up for the evaporative loss was the same as the washing solution.

Preparation of Sample 202

Sample 202 was prepared by adding compound C-15 described in JP-A-61-221748 to the red-sensitive emulsion layers of Sample 201, i.e., the third, fourth, and fifth layers in amounts of 0.040 g/m², 0.070 g/m², and 0.030 g/m², respectively.

Compound C-15 described in JP-A-61-221748

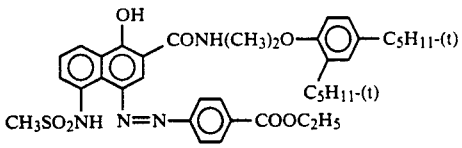

After the processing as described above was completed, acetic acid and glycolic acid were gradually added to the bleaching solution in a molar proportion of 1:1. The pH value of the bleaching solution was adjusted with 28% aqueous ammonia and hydrochloric acid to 3.5. Specimens 101, 102, and 103 were then exposed to light, and evaluated for desilverability in the same manner as in Example 1.

The results are set forth in Table 4.

TABLE 4

| Processing No. | Total amount of acetic acid and glycolic acid (mol/liter) | Residual amount of silver 101 (Comp.) (μg/cm²) | 102 (Inv.) (μg/cm²) | 202 (Inv.) (μg/cm²) |
|---|---|---|---|---|
| 1 | 0 | 50.2 | 10.5 | 11.0 |
| 2 | 0.1 | 50.2 | 10.4 | 10.8 |
| 3 | 0.2 | 50.1 | 6.0 | 6.2 |
| 4 | 0.5 | 50.1 | 3.0 | 3.4 |
| 5 | 1.0 | 50.1 | 2.8 | 3.0 |

Table 4 shows that as the content of organic acid in the bleaching solution increases, so does the desilverability.

When specimens having a large amount of remaining silver were used to print an image on a color photographic paper, a large amount of color stain was observed. Thus, these specimens are not desirable for color reproduction.

EXAMPLE 5

Specimen 201, prepared in Example 4, was processed in the same manner as in Example 4 except that the processing steps were altered as mentioned below. As a result, excellent desilvering properties were observed, even though the potassium ion concentration in the bleaching solution was 0.34 gram ion/liter.

| Processing step | | | | |
|---|---|---|---|---|
| Step | Time | Temp. (° C.) | Replenishment rate* (ml) | Tank capacity (liter) |
| Color development | 3 min. 15 sec. | 38.0 | 570 | 15 |
| Bleach | 30 sec. | 38.0 | 65 | 5 |
| Blix | 30 sec. | 38.0 | — | 5 |
| Fixing | 30 sec. | 38.0 | 420 | 5 |
| Rinse (1) | 30 sec. | 38.0 | — | 3 |
| Rinse (2) | 20 sec. | 38.0 | 980 | 3 |
| Stabilization | 20 sec. | 38.0 | 560 | 3 |
| Drying | 1 min. | 55.0 | | |

*Determined per m² of light-sensitive material

The rinse step was effected in a countercurrent process in which water flows backward and all the overflow solution from the washing bath (1) was introduced into the fixing bath. For the replenishment to the blix bath, the automatic developing machine was configurated such that the upper portion of the bleaching bath and the bottom of the blix bath were connected via a pipe and the upper portion of the fixing bath and the bottom of the blix bath were connected via a pipe so that all the overflow solutions produced by the supply of the replenisher to the bleaching bath and the fixing bath were introduced into the blix bath. The amount of the developer carried over to the bleaching step; the amount of the bleaching solution carried over to the blix step; the amount of the blix solution carried over the fixing step; and the amount of the fixing solution carried over to the rinse step were 65 ml, 50 ml, 50 ml, and 50 ml per m of light-sensitive material, respectively. In each step, the crossover time was 5 seconds. This crossover time is included in the processing time at the prebath.

The various processing solutions had the following compositions:

| | Running solution (g) | Replenisher (g) |
|---|---|---|
| | Color developer | |
| Diethylenetriamine-pentaacetic acid | 2.0 | 2.2 |
| 1-Hydroxyethylidene-1,1-diphosphonic acid | 3.3 | 3.3 |
| Sodium sulfite | 3.9 | 5.2 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)amino] aniline sulfate | 4.5 | 6.4 |
| Water to make | 1.0 liter | 1.0 liter |
| pH | 10.05 | 10.15 |
| | Bleaching solution | |
| Ferric complex of 1,3-propylenediaminetetracetate (monohydrate) | 110.0 | 220.0 |
| Ammonium bromide | 70.0 | 140.0 |
| Ammonium nitrate | 20.0 | 40.0 |
| Hydroxyacetic acid | 60.0 | 120.0 |
| Acetic acid | 30.0 | 60.0 |
| Water to make | 1.0 liter | 1.0 liter |
| pH [adjusted with aqueous ammonia] | 3.40 | 2.00 |

Running Solution of Blix Solution

15:85 Mixture of running solution of the above mentioned bleaching solution and running solution of the fixing solution as set forth below.

Fixing Solution

| | Running solution (g) | Replenisher (g) |
|---|---|---|
| Ammonium sulfite | 19.0 | 57.0 |
| Aqueous solution of ammonium thiosulfate (700 g/l) | 280 ml | 840 ml |
| Imidazole | 28.5 | 85.5 |
| Ethylenediaminetetraacetic acid | 12.5 | 37.5 |
| Water to make | 1.0 liter | 1.0 liter |
| pH [adjusted with aqueous ammonia and acetic acid] | 7.40 | 7.45 |

Washing Solution (The running solution was used also as replenisher)

Tap water was passed through a mixed bed column packed with an H-type strongly acidic cation exchange resin (Amberlite IR-120B available from Rohm & Haas) and an OH-type strongly basic anion exchange resin (Amberlite IRA-400 available from the same company) so that the calcium and magnesium ion concentrations were each reduced to 3 mg/l or less. Dichlorinated sodium isocyanurate and sodium sulfate were then added to the solution in amounts of 20 mg/l and 150 mg/l, respectively. The washing solution thus obtained had a pH value of 6.5 to 7.5.

Stabilizing Solution (The running solution was used also as replenisher)

| | |
|---|---|
| 37% Formalin | 2.0 ml |
| Polyoxyethylene-p-mononononylphenylether (average polymerization degree: 10) | 0.3 g |
| Disodium ethylenediaminetetraacetate | 0.05 g |
| Water to make | 1.0 liter |
| pH | 5.0–8.0 |

EXAMPLE 6

In the running processing of specimen 102 by using an automatic developing machine as in Example 1, the replenishment rate was established to 500 ml per $m^2$ of light-sensitive material, and the amount carried over to the bleaching solution from the color developing solution was controlled by strengthening or loosening liquid cutting squeegee, so that the total replenishing amount of the bleaching solution reached three times the tank capacity. Further, the concentration of potassium ion in the bleach bath after processing was determined by flame analysis.

| Experiment No. | Potassium ion concentration in bleach bath | Color developer component in bleach bath |
|---|---|---|
| 6-1 | 0.078 mol/l | 18.0% |
| 6-2 | 0.133 mol/l | 30.6% |
| 6-3 | 0.204 mol/l | 47.0% |

For evaluating the bleaching ability, the amount of silver remaining on the exposed portion of specimen 102 at the completion of running processing was measured in the same manner as in Example 1.

| Experiment No. | Remaining amount of silver on exposed portion ($\mu g/cm^2$) |
|---|---|
| 6-1 | 4.2 |
| 6-2 | 3.4 |
| 6-3 | 2.8 |

As is apparent from the above results, more excellent effects can be obtained by the preferred embodiment of the present invention.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed silver halide color photographic material comprising a support having thereon at least one red-sensitive silver halide emulsion layer which comprises: color developing the photographic material with a color developer containing an aromatic primary amine color developing agent, followed by processing with a processing solution having a bleaching ability, wherein the replenishment rate of said color developer is in the range of 600 ml or less per $m^2$ of the photographic material processed, and wherein said at least one red-sensitive silver halide emulsion layer contains at least one yellow colored cyan coupler represented by the following general formulae (CI), (CII) and (CIV):

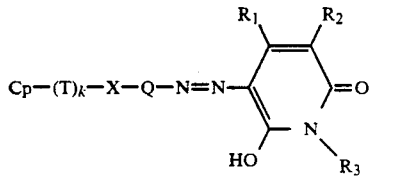
(CI)

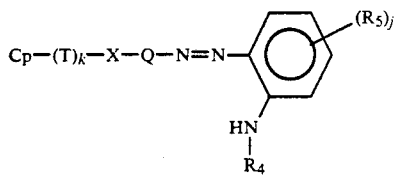
(CII)

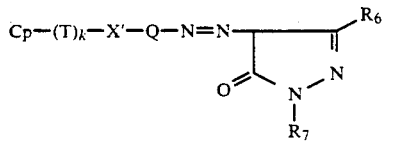
(CIV)

wherein Cp represents a cyan coupler residue (in which T is connected to the coupling position); T represents a timing group; k represents an integer of 0 or 1; X represents a $—OCH_2CH_2O—$ group X' represents a $—OCH_2CH_2O—$ group; O represents an arylene group or a divalent heterocyclic group; $R_1$ and $R_2$ each independently represent a hydrogen atom, a carboxyl group, a sulfo group, a cyano group, an alkyl group, a cycloclakyl group, an aryl group, a heterocyclic group, a carbamoyl group, a sulfamoyl group, a carbonamide group, a sulfonamide group, or an alkylsulfonyl group, an aryl group, or a heterocyclic group, with the proviso that at least one of T, X, X', O, $R_1$, $R_2$ and $R_3$ contains a water-soluble group; $R_4$ represents an acyl group or a sulfonyl group; $R_5$ represents a substitutable group; j represents an integer of 0 to 4 with the proviso that when j is an integer of 2 to 4, the plurality of $R_4$ groups may be the same or different; with the proviso that at least one of T, X, X', O, $R_4$ and $R_5$ contains a water-soluble group; $R_6$ represents a hydrogen atom, a carboxyl group, a sulfo group, a cyano group, an alkyl group, a cycloalkyl group, an aryl group, an alkoxy group, a cycloalkyloxy group, an aryloxy group, a heterocyclic group, a carbamoyl group, a sulfamoyl group, a carbonamide group, a sulfonamide group, or an alkylsulfonyl group; and $R_7$ represents a hydrogen atom, an alkyl group, a cycloalkyl group, an aryl group, or a heterocyclic group; with the proviso that at least one of T, X, X', O, $R_6$ and $R_7$ contains a water-soluble group.

2. A method for processing a silver halide color photographic materials as in claim 1, wherein the replenishment rate of said color developer is in the range of 100 to 500 ml per $m^2$.

3. A method for processing a silver halide color photographic material as in claim 1, wherein the total amount of said yellow colored cyan coupler to be incorporated in the photographic material is in the range of 0.005 to 0.30 $g/m^2$.

4. A method for processing a silver halide color photographic material as in claim 1, wherein Cp is represented by the following general formulae (Cp-6), (Cp-7), or (Cp-8):

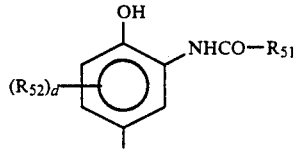
(Cp-6)

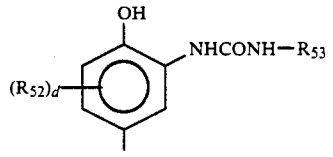
(Cp-7)

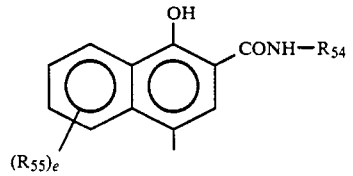
(Cp-8)

wherein, $R_{51}$ represents an aromatic group or a heterocyclic group;

$R_{52}$ represents an aliphatic group, an aromatic group, a heterocyclic group, a $R_{41}CON(R_{43})—$ group, a $R_{41}OCON(R_{43})—$ group, a $R_{41}SO_2N(R_{43})—$ group, a $R_{43}N(R_{44})CON(R_{45})—$ group, a $R_{41}O—$ group, a $R_{41}S—$ group, a halogen atom, or a $R_{41}N(R_{43})—$ group, wherein $R_{41}$ represents an aliphatic group, an aromatic group or a heterocyclic group, $R_{42}$ represents an aromatic group or a heterocyclic group, and $R_{43}$, $R_{44}$, and $R_{45}$ each represent a hydrogen atom, an aliphatic group, an aromatic group, or a heterocyclic group;

$R_{53}$ has the same meaning as $R_{41}$;

$R_{54}$ has the same meaning as $R_{41}$;

$R_{55}$ has the same meaning as $R_{41}$ or represents a $R_{41}OCONH—$ group, a $R_{41}SO_2NH—$ group, a $R_{43}N(R_{44})CON(R_{45})—$ group, a $R_{43}N(R_{44})SO_2N(R_{45})—$ group, a $R_{43}O—$ group, a $R_{41}S—$ group, a halogen atom, or a $R_{41}N(R_{43})—$ group;

d represents an integer of 0 to 3; and e represents an integer of 0 to 3.

5. A method for processing a silver halide color photographic material as in claim 1, wherein said processing solution having a bleaching ability is a bleaching solution.

6. A method for processing a silver halide color photographic material as in claim 5, wherein the replenishment rate of the bleaching solution is in the range of 200 ml or less per $m^2$ of the photographic material.

7. A method for processing a silver halide color photographic material as in claim 1, wherein the replenishment rate of the color developer is in the range of 100 to 400 ml/m$^2$.

8. A method for processing a silver halide color photographic material as in claim 1, wherein the replenishment rate of the color developer is in the range of 100 to 300 ml/m$^2$.

9. A method for processing a silver halide color photographic material as in claim 1, wherein said processing solution having a bleaching ability contains an oxidizer having a redox potential of 150 mV or higher.

10. A method for processing a silver halide color photographic material as in claim 1, wherein said processing solution having a bleaching ability contains a monobasic acid containing a carboxyl group.

11. A method for processing a silver halide color photographic material as in claim 1, wherein said processing solution having a bleaching ability contains acetic acid or glycolic acid.

12. A method for processing a silver halide color photographic material as in claim 1, wherein Q represents

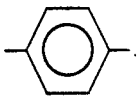

13. A method for processing a silver halide color photographic material as in claim 1, wherein $R_1$ represents a hydrogen atom, a methyl group, or a carboxyl group.

14. A method for processing a silver halide color photographic material as in claim 1, wherein $R_2$ represents a cyano group, a carbamoyl group, or a carboxyl group.

15. A method for processing a silver halide color photographic material as in claim 1, wherein $R_3$ represents an alkyl group having 1 to 7 carbon atoms or an aryl group having 6 to 10 carbon atoms.

16. A method for processing a silver halide color photographic material as in claim 1, wherein $R_4$ represents an acyl group represented by general formula (III) or a sulfonyl group represented by general formula (IV):

$$R_{14}C(\uparrow O)— \quad \text{(III)}$$

$$R_{14}SO_2— \quad \text{(IV)}$$

wherein $R_{14}$ represents an alkyl group, a cycloalkyl group, an aryl group, or a heterocyclic group.

17. A method for processing a silver halide color photographic material as in claim 1, wherein $R_5$ represents a $—NR_{15}R_{16}$ group or a $—OR_{17}$ group, wherein $R_{15}$, $R_{16}$ and $R_{17}$ each represent a hydrogen atom, an alkyl group, a cycloalkyl group, an aryl group, or a heterocyclic group, and $R_{15}$ and $R_{16}$ may together form a nitrogen-containing heterocyclic group.

18. A method for processing a silver halide color photographic material as in claim 1, wherein $R_6$ represents a cyano group, a carbamoyl group, an alkoxycarbonyl group, or a carboxyl group.

19. A method for processing a silver halide color photographic material as in claim 1, wherein $R_7$ represents an alkyl group having 1 to 7 carbon atoms or an aryl group having 6 to 10 carbon atoms.

20. A method for processing a silver halide color photographic material as in claim 1, wherein said at least one yellow colored cyan coupler is represented by general formula (CI) or (CII).

21. A method for processing a silver halide color photographic material as in claim 1, wherein said at least one yellow colored cyan coupler is represented by general formula (CI).

* * * * *